US012589919B2

(12) United States Patent
Barea et al.

(10) Patent No.: US 12,589,919 B2
(45) Date of Patent: Mar. 31, 2026

(54) LID ASSEMBLY FOR BEVERAGE CONTAINER

(71) Applicant: YETI Coolers, LLC, Austin, TX (US)

(72) Inventors: Hector Barea, Austin, TX (US); Dustin R. Bullock, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 0 days.

(21) Appl. No.: 18/735,909

(22) Filed: Jun. 6, 2024

(65) Prior Publication Data

US 2024/0409278 A1 Dec. 12, 2024

Related U.S. Application Data

(60) Provisional application No. 63/471,698, filed on Jun. 7, 2023.

(51) Int. Cl.
*B65D 43/02* (2006.01)

(52) U.S. Cl.
CPC ..... *B65D 43/022* (2013.01); *B65D 43/0229* (2013.01); *B65D 2543/00046* (2013.01); *B65D 2543/00564* (2013.01)

(58) Field of Classification Search
CPC ..... B65D 43/022; B65D 43/0229; B65D 2543/00046; B65D 2543/00564; A47J 41/0027
USPC ..... 220/260
See application file for complete search history.

(56) References Cited

U.S. PATENT DOCUMENTS 459,253 A 9/1891 Metz
1,477,936 A 12/1923 Bott
2,735,566 A 2/1956 Bramming
2,804,103 A 8/1957 Wall
2,881,776 A 4/1959 Wrage
2,957,596 A 10/1960 Rehborg
(Continued)

FOREIGN PATENT DOCUMENTS

AU 2005242173 B2 4/2012
AU 2017280047 A1 1/2019
(Continued)

OTHER PUBLICATIONS

Oct. 2, 2024—(WO) International Search Report & Written Opinion—PCT/US2024/032806.
(Continued)

*Primary Examiner* — Don M Anderson
*Assistant Examiner* — Eric C Baldrighi
(74) *Attorney, Agent, or Firm* — Banner & Witcoff, Ltd.

(57) ABSTRACT

A lid assembly for a beverage container includes an upper adapter and a lower adapter. The lid assembly may move between a closed configuration and an open configuration by rotating the upper adapter relative to the lower adapter. In some examples, the upper adapter may include a puck that is inserted into a receiver at a bottom of the upper adapter, where the puck has a tab that contacts a stop on the lower adapter to prohibit rotational movement of the upper adapter relative to the lower adapter beyond a predetermined amount to provide tactile feedback to a user that the lid assembly is in an open configuration. The puck may be secured to the upper adapter using a magnetic force between an upper adapter magnet in the upper adapter and a puck magnet in the puck.

20 Claims, 24 Drawing Sheets

(56) References Cited

U.S. PATENT DOCUMENTS 2,963,187 A 12/1960 Bramming
3,040,938 A 6/1962 Smith
3,089,603 A 5/1963 Leslie-Smith
3,124,266 A 3/1964 Morgan
3,140,799 A 7/1964 Mehr
3,141,586 A 7/1964 Wetterek
3,220,695 A 11/1965 Downey et al.
3,239,090 A 3/1966 Bramming
3,249,268 A 5/1966 Neuner
3,285,453 A 11/1966 Wagner
3,307,752 A 3/1967 Anderson
3,439,843 A 4/1969 Corsette
3,456,840 A 7/1969 Mcalaster
3,470,929 A 10/1969 Thornton
3,592,349 A 7/1971 Baugh
3,638,821 A 2/1972 Guala
3,752,347 A 8/1973 Bell
3,776,433 A 12/1973 De Treitas
3,785,539 A 1/1974 Wetterek
3,842,790 A 10/1974 Clark
3,863,798 A 2/1975 Kurihara et al.
3,874,541 A 4/1975 Lagneaux et al.
D248,373 S 7/1978 Allen
4,105,148 A 8/1978 Williams
4,190,173 A 2/1980 Mason et al.
4,241,855 A 12/1980 Yoshioka
4,358,024 A 11/1982 Underwood
4,452,381 A 6/1984 Freeman
4,497,422 A 2/1985 Klees
4,537,044 A 8/1985 Putnam
4,550,862 A 11/1985 Barker et al.
4,625,899 A 12/1986 Stull
4,723,677 A 2/1988 Nagel, Jr.
4,932,225 A 6/1990 Bighouse
4,981,233 A 1/1991 Scheurer
5,050,759 A 9/1991 Marble
5,105,975 A 4/1992 Patterson
5,181,632 A 1/1993 Latter
5,190,178 A 3/1993 Luch
5,211,299 A 5/1993 Manfredonia
5,232,112 A 8/1993 Howard
5,249,703 A 10/1993 Karp
5,251,788 A 10/1993 Moore
5,366,089 A 11/1994 Parker
5,392,967 A 2/1995 Satomi et al.
5,490,622 A 2/1996 Tardif
5,498,333 A 3/1996 Canther
5,605,241 A 2/1997 Imperioli
5,605,254 A 2/1997 Wagner, III et al.
5,647,389 A 7/1997 Holloway
5,667,106 A 9/1997 Robbins, III
5,791,507 A 8/1998 Harris et al.
5,813,557 A 9/1998 Oratz
5,839,611 A 11/1998 Obadia et al.
5,906,288 A 5/1999 Dwinell
5,909,820 A 6/1999 Yeh
5,947,319 A 9/1999 Sinski
6,029,858 A 2/2000 Srokose et al.
D423,300 S 4/2000 Matsuyama et al.
D427,021 S 6/2000 Moran
6,079,589 A 6/2000 Matsuyama et al.
6,102,227 A 8/2000 Cochrane
6,102,244 A * 8/2000 Kuwano ..... A47G 19/2272 220/711
6,170,720 B1 1/2001 Gnepper et al.
6,264,072 B1 7/2001 Johannes
D447,410 S 9/2001 Malmborg
6,321,924 B1 11/2001 Yurkewicz et al.
6,332,557 B1 12/2001 Moran
6,357,628 B1 3/2002 Long, Jr.
6,398,052 B1 6/2002 Cheng et al.
6,471,101 B1 10/2002 Vardanyan
6,530,496 B2 3/2003 Moran
6,536,618 B1 3/2003 Hwang et al.
6,601,740 B1 8/2003 Clive
6,648,158 B1 11/2003 Lawrence
6,651,838 B2 11/2003 Bissell
6,651,845 B1 11/2003 Schroeder
6,662,978 B2 12/2003 Lin et al.
6,675,998 B2 1/2004 Forsman et al.
6,702,138 B1 3/2004 Bielecki et al.
6,732,882 B2 5/2004 Belcastro
6,745,923 B2 6/2004 Julian
6,758,364 B1 7/2004 Rohrig
6,783,020 B2 8/2004 Featherston et al.
6,877,630 B2 4/2005 von Spreckelsen et al.
6,908,015 B2 6/2005 Choi et al.
6,926,179 B2 8/2005 Wagner, III et al.
6,994,233 B2 2/2006 Dygert et al.
7,073,678 B1 7/2006 Dibdin et al.
7,086,548 B2 8/2006 Bartlett
7,172,101 B2 2/2007 Find
7,270,244 B1 9/2007 Liu
7,275,665 B2 10/2007 Young
7,300,580 B2 11/2007 Lindsey et al.
D567,021 S 4/2008 Bach et al.
7,458,486 B2 12/2008 Weist et al.
7,533,783 B2 5/2009 Choi et al.
D594,346 S 6/2009 Mouquet
7,556,172 B2 7/2009 Lane
7,681,754 B1 3/2010 Ross
7,686,194 B2 3/2010 Kasting
D614,955 S 5/2010 Cresswell et al.
D621,207 S 8/2010 Bodum
D621,257 S 8/2010 Gullickson et al.
D621,258 S 8/2010 Gullickson et al.
D621,648 S 8/2010 Lown et al.
D625,560 S 10/2010 Olson et al.
7,845,524 B2 12/2010 Evans et al.
7,845,525 B2 * 12/2010 Lantz ..... B65D 51/2878 222/509
7,870,968 B2 1/2011 Hanson
D639,177 S 6/2011 Pape
7,959,044 B1 6/2011 Christian et al.
8,011,535 B2 9/2011 Tauber et al.
D648,984 S 11/2011 Gullickson et al.
8,113,239 B2 2/2012 Richards et al.
8,177,097 B2 5/2012 Duran
8,210,572 B2 7/2012 Davis
8,215,511 B1 7/2012 Lin
D665,621 S 8/2012 Eyal
8,245,600 B2 8/2012 Beard
8,245,870 B2 8/2012 McKinney et al.
8,251,247 B1 8/2012 Breckner
8,256,631 B2 9/2012 Hoffmann et al.
8,272,532 B2 9/2012 Michaelian et al.
8,292,133 B2 10/2012 Baughman et al.
8,336,732 B1 12/2012 Tobias
D675,865 S 2/2013 Wahl
D677,119 S 3/2013 Ying
D682,016 S 5/2013 Knight
8,443,993 B1 5/2013 Desselle
8,443,994 B1 5/2013 Desselle
8,459,468 B2 6/2013 Lin
8,459,502 B2 6/2013 Swanick
8,474,648 B1 7/2013 Ritzen
8,505,760 B2 8/2013 Ott
8,505,787 B2 8/2013 Fox et al.
8,523,024 B2 9/2013 Piscopo et al.
8,550,269 B2 10/2013 Lane
8,584,902 B2 11/2013 Dejonge
8,613,369 B2 12/2013 Kitto
8,622,229 B2 1/2014 Lane
8,636,166 B2 1/2014 Lane
8,657,148 B2 2/2014 Krammes et al.
8,695,822 B2 4/2014 Kwon
8,701,881 B2 4/2014 Gibson et al.
8,701,924 B2 4/2014 Dalbec
8,708,176 B2 4/2014 Andis
8,720,730 B2 5/2014 Bodden, Jr.
8,746,498 B2 6/2014 Maldonado et al.
8,752,720 B1 6/2014 Habig et al.
8,777,031 B2 7/2014 Aneas
8,833,586 B2 9/2014 Meyers et al.

(56) References Cited

U.S. PATENT DOCUMENTS 8,905,252 B2 12/2014 Latham et al.
8,919,596 B2 12/2014 Carino
8,960,506 B2 2/2015 Beilke et al.
8,967,414 B2 3/2015 Lane
8,985,406 B2 3/2015 Tachi
D735,033 S 7/2015 Lynd et al.
D735,038 S 7/2015 Tamarindo
9,113,698 B2 8/2015 Blain et al.
9,126,731 B2 9/2015 Chen
9,162,806 B2 10/2015 Fishel et al.
9,205,445 B2 12/2015 Fang et al.
9,215,942 B2 12/2015 Bodum
D748,472 S 2/2016 Seybel et al.
D751,345 S 3/2016 Lane et al.
D751,399 S 3/2016 Lynd et al.
D751,898 S 3/2016 D'Anglade
9,272,822 B2 3/2016 Samartgis
9,279,527 B2 3/2016 Davis
9,295,350 B2 3/2016 Smith et al.
9,302,827 B1 4/2016 Goss et al.
9,321,565 B2 4/2016 Yamada et al.
D755,561 S 5/2016 Eyal
9,346,591 B2 5/2016 Martinengo
D758,136 S 6/2016 Liotta et al.
D758,791 S 6/2016 Hanna et al.
9,376,243 B2 6/2016 Cerveny
D760,586 S 7/2016 Seiders et al.
D762,418 S 8/2016 Sorensen et al.
9,493,274 B2 11/2016 Ledun et al.
9,493,283 B2 11/2016 Tuyn
9,522,770 B2 12/2016 Pichrt
9,532,671 B2 1/2017 Lin
9,555,938 B2 1/2017 Syrkos
9,573,738 B1 2/2017 Lai
9,586,733 B2 3/2017 Garza
D787,893 S 5/2017 Seiders et al.
D787,894 S 5/2017 Seiders et al.
9,694,953 B2 7/2017 Meyers et al.
9,706,863 B2 * 7/2017 Huang ..... A47G 19/2288
9,708,108 B2 7/2017 Gregory et al.
D795,008 S 8/2017 Eyal
9,745,110 B2 8/2017 Boyer et al.
9,771,189 B2 9/2017 Miksovsky et al.
9,801,969 B2 10/2017 Griffis
D802,419 S 11/2017 Seiders et al.
D802,994 S 11/2017 Seiders et al.
D804,256 S 12/2017 Seiders et al.
D806,468 S 1/2018 Goodwin et al.
9,856,052 B2 1/2018 O'Leary et al.
9,896,247 B2 2/2018 Balkus
9,908,669 B2 3/2018 Stratton
9,919,860 B2 3/2018 Dabah et al.
9,926,115 B2 3/2018 Jung et al.
D814,852 S 4/2018 Melanson et al.
9,944,010 B2 4/2018 Matsuo et al.
D817,114 S 5/2018 Beckman
D818,775 S 5/2018 Woodruff
D824,217 S 7/2018 Seiders et al.
10,029,832 B2 7/2018 Isogai
10,040,593 B2 8/2018 Ross et al.
10,086,980 B2 10/2018 Isogai
D832,700 S 11/2018 Seiders et al.
D832,704 S 11/2018 Seiders et al.
D835,937 S 12/2018 Nichols
D836,387 S 12/2018 Silsby et al.
D836,388 S 12/2018 Abante et al.
D836,389 S 12/2018 Abante et al.
10,167,118 B1 1/2019 Piscopo
10,167,120 B1 1/2019 Levy et al.
10,183,791 B2 1/2019 Friedrich et al.
10,189,619 B1 1/2019 Crawley
10,196,179 B2 2/2019 Wisniewski
10,196,185 B2 2/2019 Zoppas
10,196,186 B2 2/2019 Cox
10,196,187 B2 2/2019 Hingorani
10,202,224 B2 2/2019 Painchaud
10,214,323 B2 2/2019 Conley et al.
D842,038 S 3/2019 Seiders et al.
10,301,083 B2 5/2019 Crawford
10,329,070 B2 6/2019 Wengerd
10,336,514 B1 7/2019 Briggs et al.
10,351,319 B1 7/2019 Mizer et al.
D860,716 S 9/2019 Abante et al.
10,414,558 B2 9/2019 Kim
10,421,587 B2 * 9/2019 Gilbert ..... B65D 43/18
10,457,450 B2 10/2019 Rios
D869,241 S 12/2019 Ellison et al.
10,512,347 B1 12/2019 Shepard et al.
10,569,940 B2 2/2020 Davies
D876,905 S 3/2020 Seiders et al.
D878,166 S 3/2020 Rane et al.
10,633,150 B2 4/2020 Webber et al.
D883,737 S 5/2020 Bullock et al.
D883,738 S 5/2020 Bullock et al.
D887,776 S 6/2020 Bo
D887,793 S 6/2020 Rane et al.
D888,508 S 6/2020 Rane et al.
D888,509 S 6/2020 Rane et al.
10,676,251 B2 6/2020 Krafft
10,689,166 B1 6/2020 Cheng
10,689,168 B2 6/2020 Stolle
10,698,368 B2 6/2020 Briggs et al.
10,745,186 B2 8/2020 Ma et al.
D897,151 S 9/2020 Bullock et al.
D899,871 S 10/2020 Seiders et al.
10,799,047 B2 10/2020 Lockhart et al.
10,894,650 B1 1/2021 Robinson et al.
10,899,512 B2 1/2021 Lane
10,926,924 B2 2/2021 Mutch
10,959,552 B2 3/2021 Nichols et al.
10,968,029 B1 4/2021 Rane et al.
11,021,314 B2 6/2021 Tolman et al.
11,034,505 B2 6/2021 Bullock et al.
D934,033 S 10/2021 Seiders et al.
D935,268 S 11/2021 Bullock et al.
11,213,146 B1 1/2022 Sletten
11,246,434 B2 2/2022 Siegenthaler
11,273,460 B1 3/2022 Dolph et al.
11,278,139 B2 3/2022 Sorensen et al.
11,279,528 B2 3/2022 Davies
11,312,546 B2 4/2022 Smaldone et al.
11,337,534 B2 5/2022 Silsby et al.
11,365,033 B2 6/2022 Berresheim
D960,660 S 8/2022 Seiders et al.
11,401,098 B2 8/2022 Schultz et al.
11,447,309 B2 9/2022 Jinkins et al.
11,524,833 B2 12/2022 Tolman et al.
11,801,979 B2 10/2023 Lei
11,840,365 B2 12/2023 Tolman et al.
D1,015,803 S 2/2024 Henkel
11,897,674 B2 * 2/2024 Huang ..... A45F 3/18
D1,018,214 S 3/2024 Seiders et al.
2002/0014498 A1 2/2002 Forsman et al.
2003/0141321 A1 7/2003 Sekendur
2003/0155323 A1 8/2003 Ekkert
2003/0209547 A1 11/2003 Lin
2004/0016715 A1 1/2004 Strikovic
2004/0045967 A1 3/2004 Becker et al.
2004/0094552 A1 5/2004 Featherston et al.
2004/0099674 A1 5/2004 McDonough et al.
2004/0201224 A1 10/2004 Chang
2004/0206721 A1 10/2004 Swanberg et al.
2005/0035158 A1 2/2005 Benoit-Gonin et al.
2005/0274741 A1 12/2005 Cho
2006/0180585 A1 8/2006 Cunningham et al.
2006/0180613 A1 8/2006 Manesis
2007/0051727 A1 3/2007 Holley, Jr.
2007/0108153 A1 5/2007 Weist
2007/0251956 A1 11/2007 Wasserman et al.
2008/0142466 A1 6/2008 Balitski
2008/0149651 A1 6/2008 Samson
2008/0230506 A1 9/2008 Lantz et al.
2009/0045194 A1 2/2009 Rhee
2009/0084752 A1 4/2009 Coulson

(56) References Cited

U.S. PATENT DOCUMENTS

2009/0101644 A1 4/2009 Maiwald et al.
2009/0314778 A1 12/2009 Back
2010/0012615 A1 1/2010 Brooks
2010/0044389 A1 2/2010 Logue
2010/0089151 A1 4/2010 Mantilla et al.
2010/0155358 A1 6/2010 George
2010/0200602 A1 8/2010 Chan
2010/0215294 A1 8/2010 Berman
2010/0237078 A1 9/2010 Lentz et al.
2011/0036836 A1 2/2011 Lantheaume
2011/0056386 A1 3/2011 Taketani
2011/0186585 A1 8/2011 Lu
2011/0198352 A1 8/2011 Lown et al.
2011/0220656 A1 9/2011 Gau
2011/0278216 A1 11/2011 Hull et al.
2012/0031902 A1 2/2012 Gilbert
2012/0074143 A1 3/2012 Lin
2012/0199548 A1 8/2012 Kitto
2012/0312031 A1 12/2012 Olsen et al.
2013/0008919 A1 1/2013 Honan et al.
2013/0136382 A1 5/2013 Barron
2013/0306642 A1 11/2013 Dabah et al.
2014/0069917 A1 3/2014 Meyers et al.
2014/0251938 A1 9/2014 Rose et al.
2014/0312077 A1 10/2014 Tajima et al.
2014/0319143 A1 10/2014 Connors, Jr. et al.
2015/0090714 A1 4/2015 Le Masurier et al.
2015/0191293 A1 7/2015 Forcella
2015/0232232 A1 8/2015 Shibuki et al.
2015/0251812 A1 9/2015 Gillie
2015/0314929 A1 11/2015 Tebbe et al.
2015/0374151 A1 12/2015 Lin
2016/0159538 A1 6/2016 Michie
2016/0167852 A1 6/2016 Moradi
2016/0176587 A1 6/2016 Heraud
2016/0192797 A1 7/2016 Yang
2016/0256359 A1 9/2016 Trawick et al.
2016/0318693 A1 11/2016 Hein et al.
2016/0355305 A1 12/2016 Hoskins
2016/0368663 A1 12/2016 Hizon
2017/0001772 A1 1/2017 Rho
2017/0027350 A1 2/2017 Onza et al.
2017/0043916 A1 2/2017 Seiders et al.
2017/0066573 A1 3/2017 Karussi et al.
2017/0081090 A1 3/2017 Boyer et al.
2017/0119212 A1 5/2017 Petrillo et al.
2017/0127859 A1 5/2017 Hornung et al.
2017/0144811 A1 5/2017 Wohlgenannt
2017/0158398 A1 6/2017 Shively
2017/0158412 A1 6/2017 Seiders et al.
2017/0325607 A1 11/2017 Choltco-Devlin et al.
2017/0354289 A1 12/2017 Marina et al.
2018/0029762 A1 2/2018 Eyal
2018/0050845 A1 2/2018 Chin et al.
2018/0050849 A1 2/2018 Egan et al.
2018/0105346 A1 4/2018 Tolman et al.
2018/0118427 A1 5/2018 Lee et al.
2018/0134457 A1 5/2018 Mutterle et al.
2018/0141722 A1 5/2018 Langelaan
2018/0162608 A1 6/2018 Kim
2018/0162610 A1 6/2018 Kim
2018/0186528 A1* 7/2018 Tonn ..... G01F 11/16
2018/0265264 A1 9/2018 Graybill et al.
2018/0360244 A1 12/2018 Kelaher et al.
2019/0002164 A1 1/2019 Nakatani et al.
2019/0039782 A1 2/2019 Campbell
2019/0047754 A1 2/2019 Dubiel et al.
2019/0047773 A1 2/2019 Bullock et al.
2019/0062010 A1 2/2019 Apte et al.
2019/0125111 A1 5/2019 Morewitz et al.
2019/0210775 A1 7/2019 Brown
2019/0352059 A1 11/2019 Mutch
2020/0002054 A1 1/2020 Gronkowski
2020/0130904 A1 4/2020 Jones et al.
2020/0245818 A1 8/2020 Halkes et al.
2020/0245858 A1 8/2020 Takeno et al.
2020/0339314 A1 10/2020 Meyers
2021/0206539 A1 7/2021 Lovern, IV et al.
2022/0024655 A1 1/2022 Humphrey et al.
2022/0063876 A1* 3/2022 Jones ..... B65D 81/3841
2022/0087454 A1 3/2022 Meyers et al.
2022/0097916 A1 3/2022 Smith et al.
2022/0354283 A1 11/2022 Schneider et al.

FOREIGN PATENT DOCUMENTS

AU 2016368382 B2 2/2019
AU 2019101119 A4 10/2019
CA 1321776 C 8/1993
CA 2504722 A1 1/2006
CA 2567706 C 1/2013
CA 3030583 A1 11/2018
CA 3012127 A1 2/2019
CA 174841 S 1/2020
CA 3009405 C 9/2020
CA 201651 S 10/2022
CA 202000 S 11/2022
CH 1380800001 S1 7/2011
CN 2035210 U 4/1989
CN 1244846 A 2/2000
CN 201019201 Y 2/2008
CN 300984030 8/2009
CN 201349991 Y 11/2009
CN 201640878 U 11/2010
CN 101945812 A 1/2011
CN 201694495 U 1/2011
CN 201734576 U 2/2011
CN 201777557 U 3/2011
CN 202030152 U 11/2011
CN 202060630 U 12/2011
CN 202086330 U 12/2011
CN 102307497 A 1/2012
CN 301888124 S 4/2012
CN 202287503 U * 7/2012 ..... A47G 19/22
CN 302228747 S 12/2012
CN 103112651 A 5/2013
CN 202981686 U 6/2013
CN 203127394 U 8/2013
CN 203199308 U 9/2013
CN 203207847 U 9/2013
CN 103619723 A 3/2014
CN 203723819 U 7/2014
CN 104108520 A 10/2014
CN 104129579 A 11/2014
CN 203914463 U 11/2014
CN 102730301 B 3/2015
CN 303176279 S 4/2015
CN 103086061 B 8/2015
CN 103538798 A 9/2015
CN 303413115 S 10/2015
CN 204776594 U 11/2015
CN 204802300 U 11/2015
CN 204813172 U 12/2015
CN 204979595 U 1/2016
CN 204979648 U 1/2016
CN 303748684 S 7/2016
CN 205697016 U 11/2016
CN 106263476 A 1/2017
CN 304025064 S 2/2017
CN 205998332 U 3/2017
CN 206202961 U 5/2017
CN 304174286 S 6/2017
CN 103803166 B 8/2017
CN 206813608 U 12/2017
CN 206900951 U 1/2018
CN 207041437 U 2/2018
CN 107802148 A 3/2018
CN 108137191 A 6/2018
CN 108313494 A 7/2018
CN 207590425 U 7/2018
CN 107224167 B 8/2018
CN 108394633 A 8/2018
CN 108471910 A 8/2018
CN 304799330 S 9/2018

(56) References Cited

FOREIGN PATENT DOCUMENTS

| | | | |
|---|---|---|---|
| CN | 106458394 | B | 10/2018 |
| CN | 105050907 | B | 12/2018 |
| CN | 105358441 | B | 12/2018 |
| CN | 105595863 | B | 2/2019 |
| CN | 106255648 | B | 2/2019 |
| CN | 106414269 | B | 2/2019 |
| CN | 106458396 | B | 2/2019 |
| CN | 109319295 | A | 2/2019 |
| CN | 208470495 | U | 2/2019 |
| CN | 208485029 | U | 2/2019 |
| CN | 208531194 | U | 2/2019 |
| CN | 208755575 | U | 4/2019 |
| CN | 305248333 | S | 7/2019 |
| CN | 210276755 | U | 4/2020 |
| CN | 211432100 | U | 9/2020 |
| CN | 211883255 | U | 11/2020 |
| CN | 212015230 | U | 11/2020 |
| CN | 212196650 | U | 12/2020 |
| CN | 212402043 | U | 1/2021 |
| CN | 212402050 | U | 1/2021 |
| CN | 212448714 | U | 2/2021 |
| CN | 306635234 | S | 6/2021 |
| CN | 213962827 | U | 8/2021 |
| CN | 306807664 | S | 9/2021 |
| CN | 214548686 | U | 11/2021 |
| CN | 214803958 | U | 11/2021 |
| CN | 214987304 | U | 12/2021 |
| CN | 215157264 | U | 12/2021 |
| CN | 307080421 | S | 1/2022 |
| CN | 307092037 | S | 1/2022 |
| CN | 216020348 | U | 3/2022 |
| CN | 307177266 | S | 3/2022 |
| CN | 307209145 | S | 3/2022 |
| CN | 307209146 | S | 3/2022 |
| CN | 216364643 | U | 4/2022 |
| CN | 216510227 | U | 5/2022 |
| CN | 307321161 | S | 5/2022 |
| CN | 307388266 | S | 6/2022 |
| CN | 216907536 | U | 7/2022 |
| CN | 307478808 | S | 8/2022 |
| CN | 115067724 | A | 9/2022 |
| CN | 307535910 | S | 9/2022 |
| CN | 307553570 | S | 9/2022 |
| CN | 307866948 | S | 9/2022 |
| CN | 217524521 | U | 10/2022 |
| CN | 217659132 | U | 10/2022 |
| CN | 307584616 | S | 10/2022 |
| CN | 307584617 | S | 10/2022 |
| CN | 307584653 | S | 10/2022 |
| CN | 307590815 | S | 10/2022 |
| CN | 307614407 | S | 10/2022 |
| CN | 307619842 | S | 10/2022 |
| CN | 307620098 | S | 10/2022 |
| CN | 307642519 | S | 11/2022 |
| CN | 307676278 | S | 11/2022 |
| CN | 307710601 | S | 12/2022 |
| CN | 307722462 | S | 12/2022 |
| CN | 307766731 | S | 1/2023 |
| CN | 307773605 | S | 1/2023 |
| CN | 307780074 | S | 1/2023 |
| CN | 307780144 | S | 1/2023 |
| CN | 307788631 | S | 1/2023 |
| CN | 307788635 | S | 1/2023 |
| CN | 307825484 | S | 2/2023 |
| CN | 307868100 | S | 2/2023 |
| CN | 307884737 | S | 3/2023 |
| CN | 307893947 | S | 3/2023 |
| CN | 219699560 | U | 9/2023 |
| DE | 2233565 | A1 | 6/1973 |
| DE | 2226556 | B2 | 8/1977 |
| DE | 3514261 | A1 | 1/1986 |
| DE | 29612345 | U1 | 9/1996 |
| DE | 29611746 | U1 | 11/1997 |
| DE | 29720426 | U1 | 4/1998 |
| DE | 69509827 | T2 | 10/1999 |
| DE | 29912668 | U1 | 12/1999 |
| DE | 202008009584 | U1 | 10/2008 |
| DE | 102014011506 | B3 | 7/2015 |
| DK | 402016101176-0008 | | 11/2016 |
| DK | 402016101176-0010 | | 11/2016 |
| EM | 0005444160001 | A1 | 8/2006 |
| EM | 0017252430001 | A1 | 7/2010 |
| EM | 002759605 | A1 | 10/2015 |
| EM | 004539732-0003 | | 12/2017 |
| EM | 0091870080001 | | 10/2022 |
| EP | 1088764 | A1 | 4/2001 |
| EP | 0681441 | B1 | 11/2005 |
| EP | 1693310 | A1 | 8/2006 |
| EP | 1878667 | A1 | 1/2008 |
| EP | 1934106 | A1 | 6/2011 |
| EP | 2457842 | B1 | 5/2015 |
| EP | 3066018 | A4 | 11/2016 |
| EP | 2851311 | B1 | 6/2018 |
| EP | 3157833 | A | 8/2018 |
| EP | 2796078 | B1 | 10/2018 |
| EP | 3398484 | A1 | 11/2018 |
| EP | 3398871 | A1 | 11/2018 |
| EP | 3441320 | A1 | 2/2019 |
| EP | 3426563 | A4 | 10/2019 |
| FR | 1359912 | A | 4/1964 |
| FR | 2521957 | B1 | 10/1986 |
| FR | 2623166 | A1 | 5/1989 |
| FR | 2786465 | | 6/2000 |
| FR | 2830848 | A1 | 4/2003 |
| FR | 20214014001 | S1 | 2/2022 |
| GB | 729903 | A | 5/1955 |
| GB | 2114959 | B | 7/1985 |
| GB | 2438391 | B | 1/2012 |
| GB | 6188752 | S | 2/2022 |
| JP | S50-64 | A | 1/1975 |
| JP | S59044941 | U | 3/1984 |
| JP | 1987052853 | A | 3/1987 |
| JP | H02-052759 | U | 4/1990 |
| JP | H08-0117119 | A | 5/1996 |
| JP | 2000333847 | A | 12/2000 |
| JP | 2001315831 | A | 11/2001 |
| JP | 2002068227 | A | 3/2002 |
| JP | 2002145294 | A | 5/2002 |
| JP | 2002284176 | A | 10/2002 |
| JP | 2002321755 | A | 11/2002 |
| JP | 2003125912 | A | 5/2003 |
| JP | 2005075449 | A | 3/2005 |
| JP | 2006230731 | A | 9/2006 |
| JP | 2008162679 | A | 7/2008 |
| JP | 1363566 | | 6/2009 |
| JP | 2010280402 | A | 12/2010 |
| JP | 2011093544 | A | 5/2011 |
| JP | 2012025436 | A | 2/2012 |
| JP | 2012517386 | A | 8/2012 |
| JP | 2014210136 | A | 11/2014 |
| JP | 1530358 | S | 8/2015 |
| JP | 2016141412 | A | 8/2016 |
| JP | 6175877 | B2 | 8/2017 |
| JP | 6387862 | B2 | 9/2018 |
| JP | 6408837 | B2 | 10/2018 |
| JP | 6409250 | B1 | 10/2018 |
| JP | 3218672 | U | 11/2018 |
| JP | 2019001538 | A | 1/2019 |
| JP | 2019503943 | A | 2/2019 |
| JP | 1725331 | S | 9/2022 |
| JP | 7225651 | B2 | 2/2023 |
| KR | 300151505 | S | 6/1994 |
| KR | 3001515050001 | S | 6/1994 |
| KR | 200169857 | Y1 | 2/2000 |
| KR | 20100008131 | A | 1/2010 |
| KR | 300636271 | S | 3/2012 |
| KR | 101581270 | B1 | 1/2016 |
| KR | 30-0847946 | | 4/2016 |
| KR | 101668309 | B1 | 10/2016 |
| KR | 101785906 | B1 | 10/2017 |
| KR | 301014708 | S | 7/2019 |
| KR | 301197177 | S | 12/2022 |
| NO | 338414 | B1 | 8/2016 |
| NZ | 766884 | A | 3/2021 |

(56) References Cited

FOREIGN PATENT DOCUMENTS

| | | | | | |
|---|---|---|---|---|---|
| RU | 00100680 | | 11/2016 | | |
| WO | 2005028317 | A2 | 3/2005 | | |
| WO | 2006023238 | A2 | 3/2006 | | |
| WO | 2012022475 | | 2/2012 | | |
| WO | 2012107790 | A1 | 8/2012 | | |
| WO | 2014114493 | A1 | 7/2014 | | |
| WO | D088688-002 | | 1/2016 | | |
| WO | 2016204623 | A1 | 12/2016 | | |
| WO | 2018075540 | A1 | 4/2018 | | |
| WO | 2018145645 | A1 | 8/2018 | | |
| WO | 2017/223093 | A3 | 2/2019 | | |
| WO | 2019025589 | A1 | 2/2019 | | |
| WO | WO-2020081705 | A1 * | 4/2020 | ..... | A47J 41/0016 |

OTHER PUBLICATIONS

"YETI Rambler Bottle Cup Cap Accessory." Found online: Jun. 18, 2019 at www.amazon.com. Product reviewed May 30, 2019. Retrieved from URL: http://tinyurl.com/y32g688u (Year: 2019).

Youtube. YETI Rambler R12 Bottle with Hotshot Cap Demo, Features & Review by Tentworld—The Camping Experts. Oct. 30, 2019. https://www.youtube.com/watch?v=cLZsvhUMydM (Year: 2019).

Amazon. YETI Rambler 12 oz Bottle, Stainless Steel, Vacuum Insulated, with Hot Shot Cap. Apr. 4, 2019. https://www.amazon.com/YETI-Rambler-Stainless-Vacuum-Insulated/dp/B07QD7Z2ZP (Year: 2019).

Amazon. YETI Rambler Bottle Hot Shot Cap Accessory, Video "YETI Hotshot Cap". Aug. 1, 2018. https://www.amazon.com/YETI-Bottle-Shot-Rambler-Each/dp/B07G3BW24T (Year: 2018).

Jan. 26, 2026—(CA) First Office Action—App. No. 3294785.

Dec. 16, 2025—(AU) First Examination Report—App. No. 2024286454.

Jan. 16, 2026—(NZ) First Examination Report—App. No. 827838.

* cited by examiner

LID ASSEMBLY FOR BEVERAGE CONTAINER

CROSS-REFERENCE TO RELATED APPLICATION

This application claims priority to and benefit of U.S. Provisional Application No. 63/471,698 filed on Jun. 7, 2023, which is incorporated by reference in its entirety.

TECHNICAL FIELD

This disclosure relates to a lid assembly for a beverage container.

BACKGROUND

A container may be configured to store a volume of liquid. Containers can be filled with hot or cold drinkable liquids, such as water, coffee, tea, a soft drink, or an alcoholic beverage, such as beer. These containers can be formed of a double-wall vacuumed formed construction to provide insulative properties to help maintain the temperature of the liquid within the container. In some cases, a lid may be used with the container to prevent the liquid in the container from inadvertently being released.

BRIEF SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

Aspects of this disclosure may relate to a lid assembly for a beverage container, where the lid assembly comprises: (a) an upper adapter that includes: (1) a first upper cylindrical portion, (2) a top wall connected to the first upper cylindrical portion, and (3) a first lower cylindrical portion connected to the first upper cylindrical portion, where the top wall comprises a primary opening and where the first lower cylindrical portion includes a receiver; (b) a lower adapter that includes: (1) a second upper cylindrical portion, (2) a second lower cylindrical portion connected to the second upper cylindrical portion, and (3) an opening extending through the second upper cylindrical portion and the second lower cylindrical portion, where the opening at least partially receives the upper adapter; and (c) a puck that is removably coupled with the receiver of the upper adapter, where the puck includes a puck body and a tab extending outward from the puck body. The receiver may include a side wall that surrounds a cavity that is open to an area below the lid assembly, and the puck body may be at least partially received within the cavity of the receiver. The lid assembly may have a closed configuration and an open configuration, where the upper adapter is moved relative to the lower adapter to move the lid assembly from the closed configuration to the open configuration. The tab of the puck may contact the lower adapter to limit movement of the upper adapter relative to the lower adapter. An end of the tab may extend beyond an external surface of the first lower cylindrical portion of the upper adapter. The tab of the puck may contact a stop surface of the lower adapter when the lid assembly is in the open configuration. When the puck is installed into the receiver of the upper adapter, the puck may be rotationally fixed with the upper adapter. The upper adapter may include an upper adapter magnet and the puck may include a puck magnet, where the puck is axially secured in the receiver by an attractive force between the upper adapter magnet and the puck magnet. The upper adapter magnet may be secured within an enclosed cavity formed between the top wall and the receiver. The first lower cylindrical portion may include an external threaded portion with a first channel that interrupts the external threaded portion, and the second lower cylindrical portion may include an internal threaded portion, where the internal threaded portion of the second lower cylindrical portion comprises a second channel and a third channel that interrupt the internal threaded portion in two locations. When the lid assembly is in the open configuration, the first channel and either the second channel or the third channel may be substantially aligned with the primary opening on the top wall. When the upper adapter rotates relative to the lower adapter, an end of the tab is guided by a ramped surface of the lower adapter as the upper adapter moves vertically. When the puck is removed from the upper adapter, the upper adapter is removable from the lower adapter.

Other aspects of this disclosure may relate to a lid assembly for a beverage container, where the lid assembly comprises: (a) an upper adapter that includes: (1) a first upper cylindrical portion, (2) a top wall connected to the first upper cylindrical portion, (3) a first lower cylindrical portion connected to the first upper cylindrical portion, and (4) an upper adapter magnet, where the first lower cylindrical portion includes a receiver; (b) a lower adapter that comprises: (1) a second upper cylindrical portion, (2) a second lower cylindrical portion connected to the second upper cylindrical portion, and (3) an opening extending through the second upper cylindrical portion and the second lower cylindrical portion, where the opening at least partially receives the upper adapter; and (c) a puck that is removably coupled with the receiver of the upper adapter, where the puck includes a puck body, a puck magnet, and a tab extending outward from the puck body. When the puck is coupled to the upper adapter, the upper adapter may be movably coupled to the lower adapter. The puck is axially secured to the receiver by an attractive force between the upper adapter magnet and the puck magnet. The lid assembly may have a closed configuration that prevents fluid from flowing through the lid assembly, and an open configuration that allows fluid to flow through the opening on the top wall of the lid assembly. The upper adapter may be rotated relative to the lower adapter to move the lid assembly from the closed configuration to the open configuration. The upper adapter may include an upper gasket and a lower gasket such that when the lid assembly is in the closed configuration, the upper gasket contacts the lower adapter and the lower gasket contacts the lower adapter. When the lid assembly is in the open configuration, the upper gasket contacts the lower adapter and the lower gasket is free of contact with the lower adapter. The upper gasket and the lower gasket may both be located above an external threaded portion of the first lower cylindrical portion of the upper adapter. The tab of the puck may contact a stop surface of the lower adapter to limit movement of the upper adapter relative to the lower adapter. The stop surface may be located at an end of a ramped surface, where the stop surface and the ramped surface are located on the second lower cylindrical portion of the lower adapter. When the puck is coupled with the receiver of the upper adapter, the puck may be rotationally fixed with the upper adapter. The upper adapter magnet may comprise a pair of upper adapter magnets, and the puck magnet may comprise a pair of puck magnets, where a first upper adapter magnet of the pair of upper adapter magnets is substantially aligned with a first puck magnet of the pair of puck magnets.

Still other aspects of this disclosure may relate to a lid assembly of a beverage container, where the lid assembly comprises: (a) an upper adapter that includes: (1) a first upper cylindrical portion, (2) a top wall connected to the first upper cylindrical portion, (3) a first lower cylindrical portion connected to the first upper cylindrical portion, and (4) an upper adapter magnet, where the first lower cylindrical portion includes a receiver and the receiver comprises a cavity; (b) a lower adapter comprising: (1) a second upper cylindrical portion, (2) a second lower cylindrical portion connected to the second upper cylindrical portion, and (3) an opening extending through the second upper cylindrical portion and the second lower cylindrical portion, where the opening at least partially receives the upper adapter; and (c) a puck that is removably coupled with the receiver of the upper adapter, where the puck includes a puck body, a puck magnet, and a tab extending outward from the puck body. The puck body may be at least partially received within the cavity of the receiver, and the puck may be axially secured to the receiver by an attractive force between the upper adapter magnet and the puck magnet. The lid assembly may have a closed configuration and an open configuration, where the upper adapter is rotated relative to the lower adapter to move the lid assembly from the closed configuration to the open configuration. The puck may include a projection that extends from an outer surface of the puck body. The cavity of the receiver may be surrounded by a side wall and a protrusion may extend from the side wall into the cavity such that when the puck is coupled to the receiver the projection and the protrusion may be substantially aligned. The upper adapter may include an upper gasket and a lower gasket such that when the lid assembly is in the closed configuration, the upper gasket contacts the lower adapter and the lower gasket contacts the lower adapter, and when the lid assembly is in the open configuration, the upper gasket contacts the lower adapter and the lower gasket is free of contact with the lower adapter.

BRIEF DESCRIPTION OF DRAWINGS

To allow for a fuller understanding of the present disclosure, it will now be described by way of example, with reference to the accompanying drawings in which.

DETAILED DESCRIPTION

Figure 1:
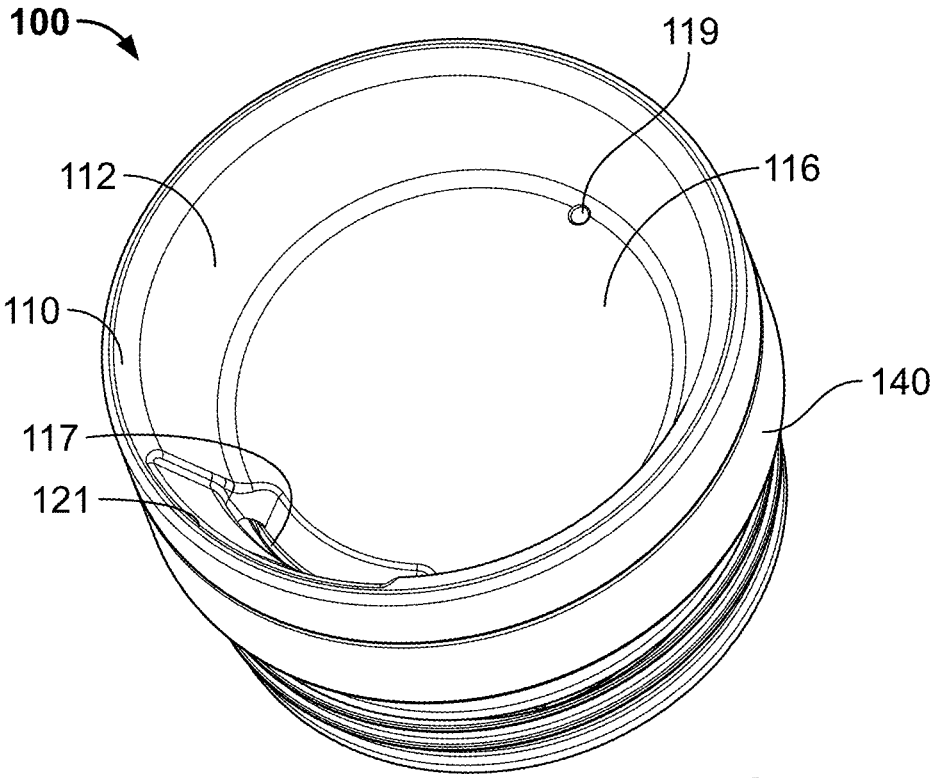
FIG. 1 illustrates a top perspective view of an exemplary lid assembly in accordance with aspects of this disclosure.
Figure 2:
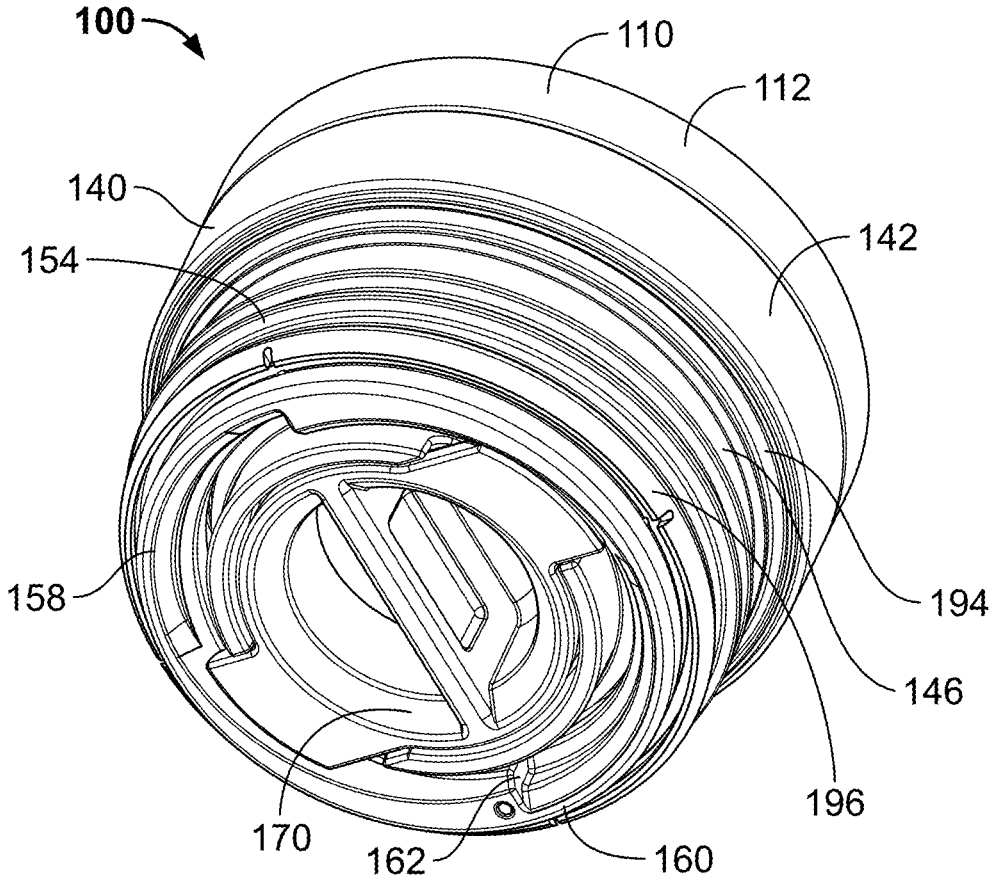
FIG. 2 illustrates a bottom perspective view of the exemplary lid assembly of FIG. 1 in accordance with aspects of this disclosure.
Figure 3:
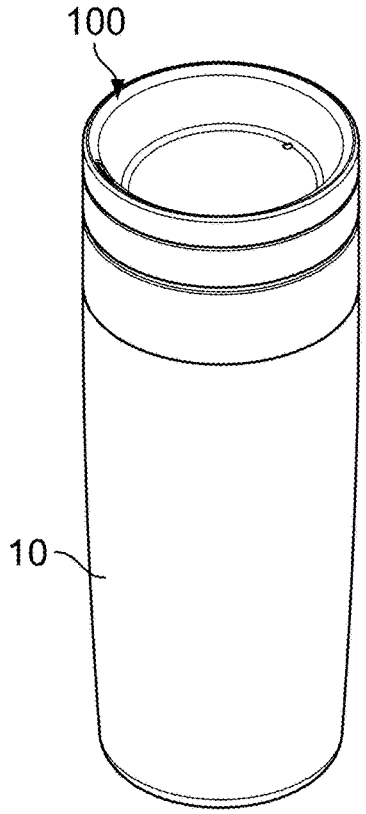
FIG. 3 illustrates a top perspective view of the lid assembly of FIG. 1 attached to a container in accordance with aspects of this disclosure.
Figure 4A:
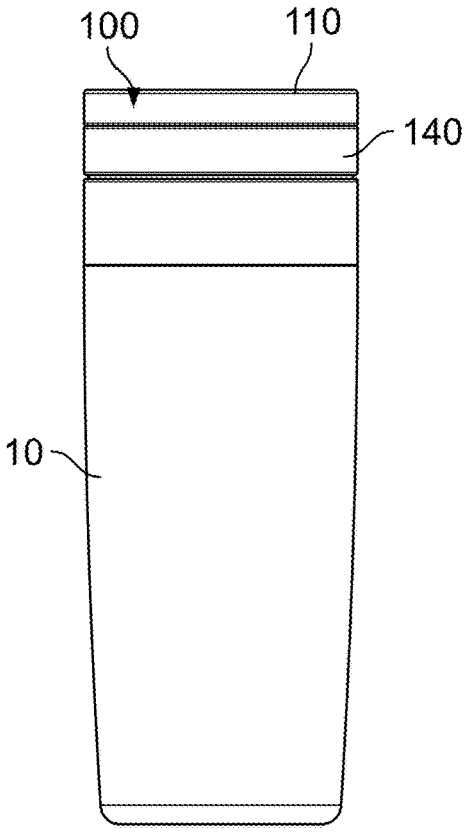
FIG. 4A illustrates a front view of the lid assembly of FIG. 1 attached to a container, where the lid assembly is in a closed configuration in accordance with aspects of this disclosure.
Figure 4B:
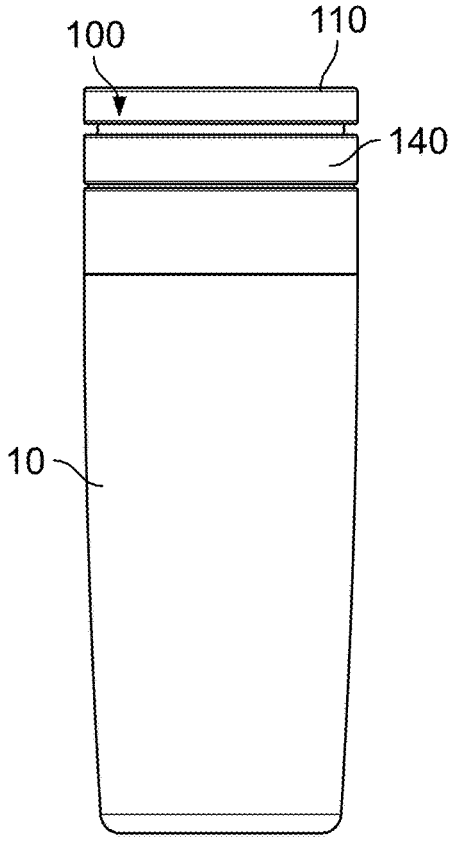
FIG. 4B illustrates a front view of the lid assembly of FIG. 1 attached to a container, where the lid assembly is in an open configuration in accordance with aspects of this disclosure.
Figure 5:
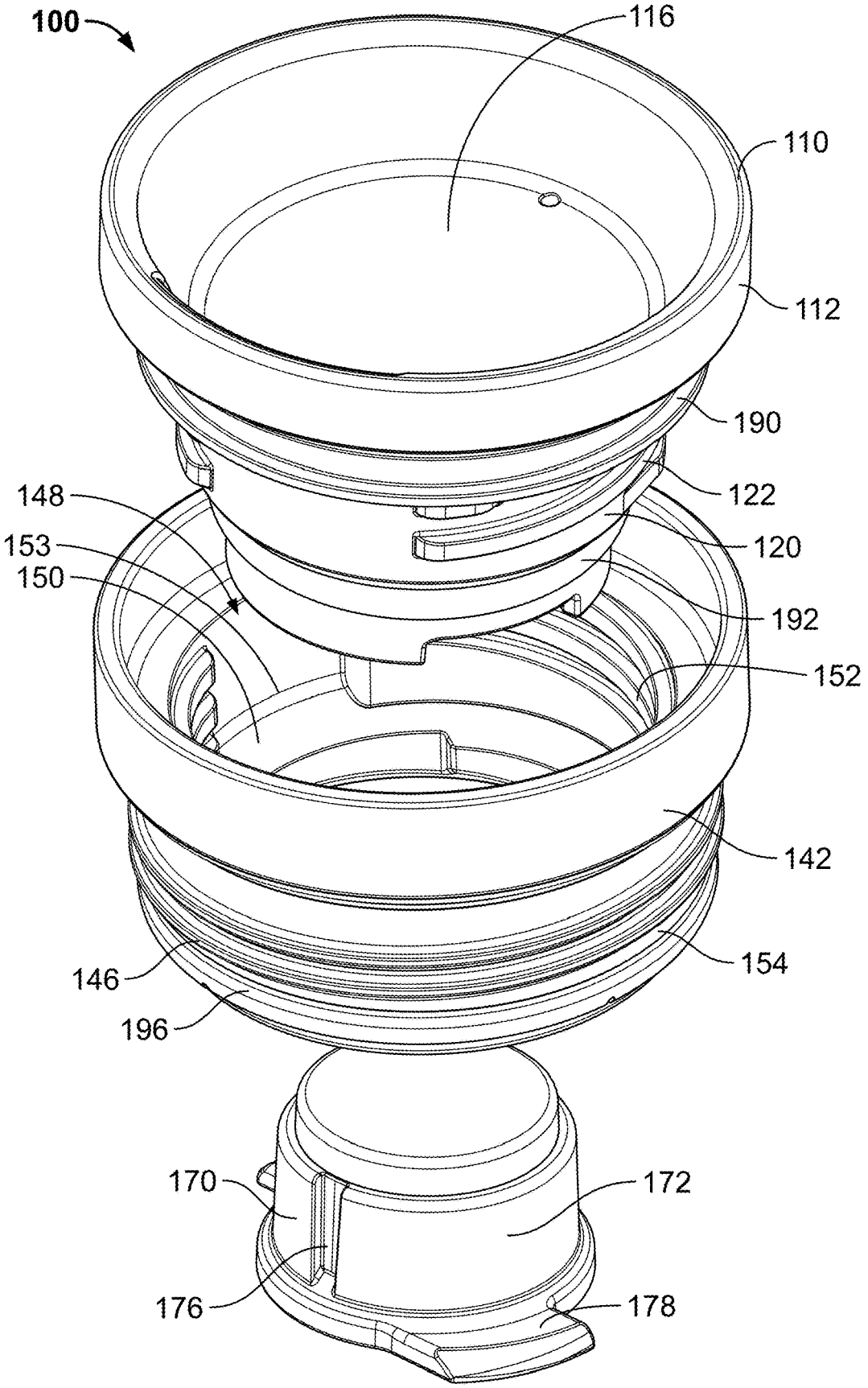
FIG. 5 illustrates a partially exploded top perspective view of the lid assembly of FIG. 1 in accordance with aspects of this disclosure.
Figure 6:
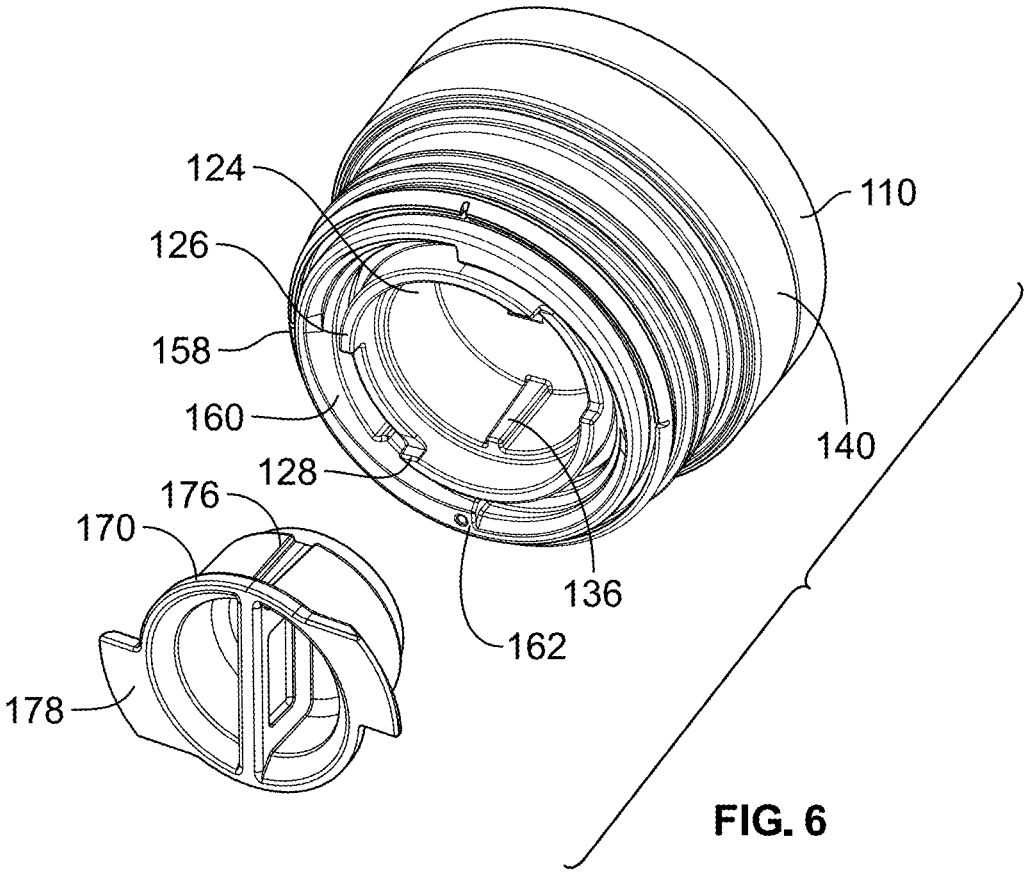
FIG. 6 illustrates a partially exploded bottom perspective view of the lid assembly of FIG. 1 in accordance with aspects of this disclosure.
Figure 7:
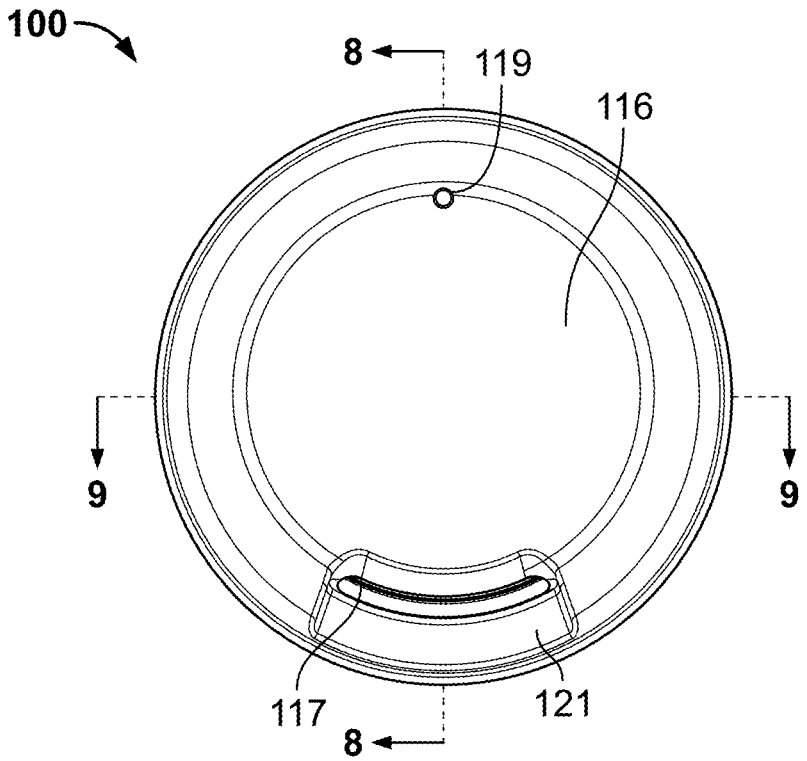
FIG. 7 illustrates a top view of lid assembly of FIG. 1 in accordance with aspects of this disclosure.

While this invention is susceptible of embodiments in many different forms, there are shown in the drawings and will herein be described in detail example embodiments of the invention with the understanding that the present disclosure is to be considered as an exemplification of the principles of the invention and is not intended to limit the broad aspect of the invention to the embodiments illustrated. In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

Also, while the terms "top," "side," "bottom," "front" and the like may be used in this specification to describe various example features and elements of the invention, these terms are used herein as a matter of convenience, e.g., based on the example orientations shown in the figures or the orientation during typical use. Nothing in this specification should be construed as requiring a specific three-dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Plurality," as used herein, indicates any number greater than one, either disjunctively or conjunctively, as necessary, up to an infinite number.

"Cylindrical portion," as used herein, indicates an element or feature that may have a generally cylindrically shape but may include threaded portions or other aspects such that the shape may not be a cylindrical shape with constant circular cross-section for the entire height of the described element.

As used herein, the term "substantially" means mostly, or almost the same as, within the constraints of sensible commercial engineering objectives, costs, manufacturing tolerances, and capabilities in the field of manufacturing the article being formed.

The term "connect," as used herein indicates that components, surfaces, or features and the like may be directly or indirectly (i.e. through an intermediary) joined, linked or attached.

The term "magnetic," as utilized herein, may refer to a material (e.g. a ferromagnetic material) that may be magnetized. As such, the term "magnetic" may imply that a material (i.e. a surface, or object, and the like) may be magnetically attracted to a magnet (i.e. a temporary or permanent magnet) that has an associated magnetic field. In one example, a magnetic material may be magnetized (i.e. may form a permanent magnet). Additionally, various examples of magnetic materials may be utilized with the disclosures described herein, including nickel, iron, and cobalt, and alloys thereof, among others.

In general, this disclosure relates a lid assembly for a beverage or liquid container, where the lid assembly may comprise an upper adapter that rotates relative to a lower adapter to open and close the passageway that allows a liquid to flow from the container.

FIGS. 1-11C illustrate views of the lid assembly 100. The lid assembly 100 may include an upper adapter 110 that is coupled to a lower adapter 140 and a puck 170 that may be magnetically coupled to the upper adapter 110. The upper adapter 110 may be rotationally coupled to the lower adapter 140 such that the upper adapter 110 and the lower adapter 140 can rotate relative to each other. The puck 170 may be removably coupled to the upper adapter 110 where the puck 170 has features to limit the amount of rotation of the upper adapter 110 relative to the lower adapter 140. Additionally, the puck 170, when installed, may prevent the removal of the upper adapter 110 from the lower adapter 140. The puck 170 may also be easily removed from the upper adapter 110 to disassemble the lid assembly 100 (i.e. removal of the upper adapter 110 from the lower adapter 140) for easy cleaning and maintenance such as gasket replacement. In addition, the upper adapter 110 may be rotationally fixed with the puck 170 such that when the upper adapter 110 rotates that the puck 170 also rotates. The lid assembly 100 may be configured to connect to a container 10 shown in FIGS. 3-4B. The upper adapter 110 may rotate relative to the lower adapter 140 to move the lid assembly 100 between a closed configuration where liquid does not flow from the container 10 as shown in FIG. 4A and an open configuration where liquid is allowed to flow from the container 10 as shown in FIG. 4B.

In some examples, the container 10 may be an insulating container that includes a first inner wall that has a first end with a threaded sidewall that is configured to receive the lid assembly 100, and an opening extending into an internal reservoir for receiving liquid, and a second outer wall forming an outer shell of the container 10. The second outer wall can include a second end configured to support the container 10 on a surface. The container 10 may also include a sealed vacuum cavity forming an insulated double wall structure between the first inner wall and the second outer wall. In other examples, the container 10 may be a single walled container with a threaded sidewall that is configured to receive the lid assembly 100.

The upper adapter 110 may comprise an upper cylindrical portion 112 with a shelf 114, a top wall 116 connected to the upper cylindrical portion 112, an upper gasket groove 118 located below the shelf 114, and a lower cylindrical portion 120. The lower cylindrical portion 120 may include an external threaded portion 122, and a receiver 124 that receives the puck 170. The top wall 116 may include a primary opening 117 that is an outlet for the fluid in the container 10 when the lid assembly 100 is in an open configuration. The primary opening 117 may be adjacent a tapered channel 121 along an interior surface of the upper cylindrical portion 112 to act as a spout for a user. In addition, the top wall 116 may include a secondary opening 119 that acts as an air vent for the lid assembly 100. The top wall 116 may also be angled or tilted from a back region that comprises the secondary opening 119 towards a front region that comprises the primary opening 117 such that the front region of the top wall 116 is lower, when measured from a top surface of the upper cylindrical portion 112, than the back region. The angled top wall 116 allows for room for a user's nose when drinking from the lid assembly 100.

The lower cylindrical portion 120 may comprise a receiver 124 that helps to secure the puck 170 to the upper adapter 110. The receiver 124 may be located at a bottom region of the lower cylindrical portion 120. The receiver 124 may comprise a support wall 130, a side wall 132 connecting the support wall 130 and a bottom surface 126. The receiver 124 may have a cavity 133 surrounded by the side wall 132, where the cavity 133 is open to an area below the lid assembly 100. The bottom surface 126 of the receiver 124 may include a stop 128, where the stop 128 may be a notch in the bottom surface 126 of the receiver 124. The side wall 132 may include an interior surface that includes a protrusion or key 136 that is received in a slot or groove 176 on the puck 170 to rotationally fix the puck 170 to the receiver 124. In some examples, the side wall 132 may include more than one protrusion 136. For example, the receiver 124 in the illustrated example includes a pair of protrusions 136 that are located opposite each other on the side wall 132. Each protrusion 136 may have a generally rectangular cross-sectional profile, although in other examples, each protrusion 136 may have a different cross-sectional shape. Each protrusion 136 may have a tapered shape such that the width is larger near the support wall 130 than at the bottom surface 126. Alternatively, the receiver 124 may have grooves to receive a protrusion located on the puck 170 to rotationally fix the puck 170 to the receiver 124.

Figure 8:
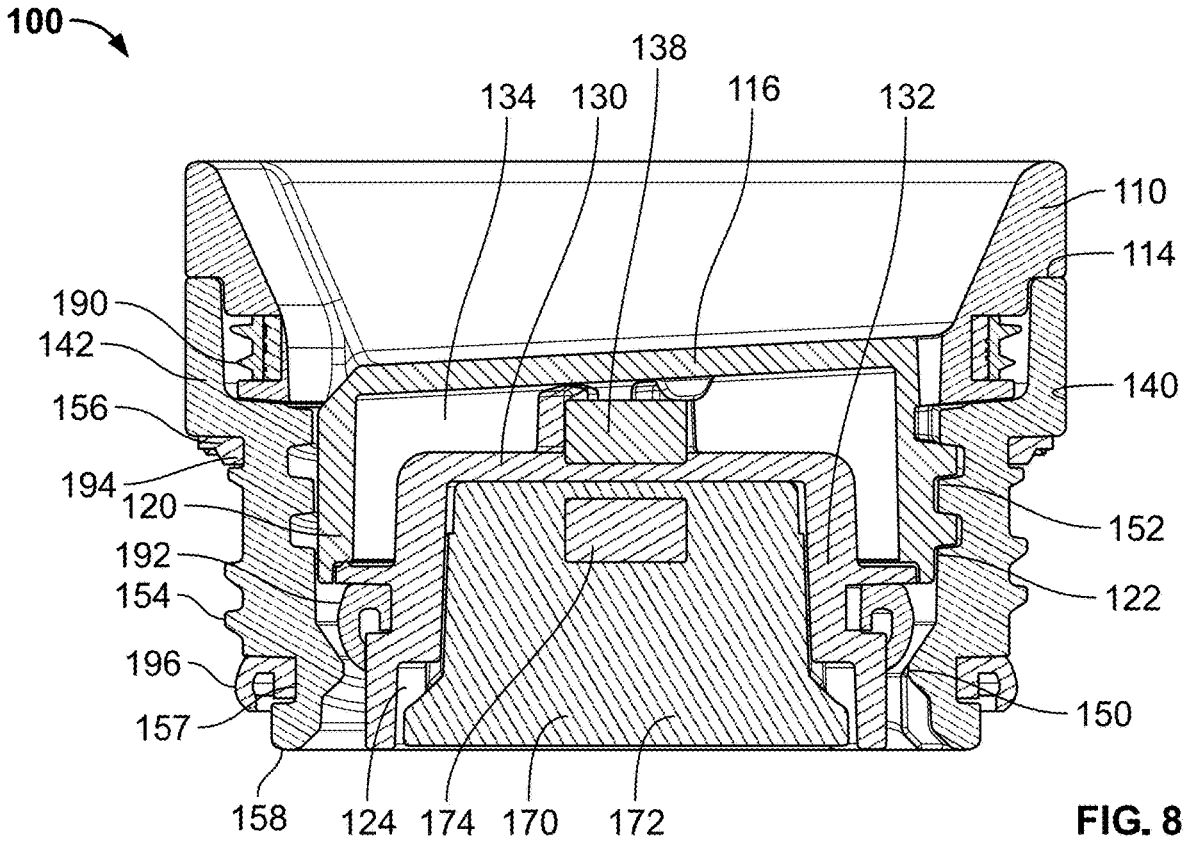
FIG. 8 illustrates a side cross-sectional view of the lid assembly of FIG. 1 in a closed configuration along line 8-8 of FIG. 7 in accordance with aspects of this disclosure.
Figure 9:
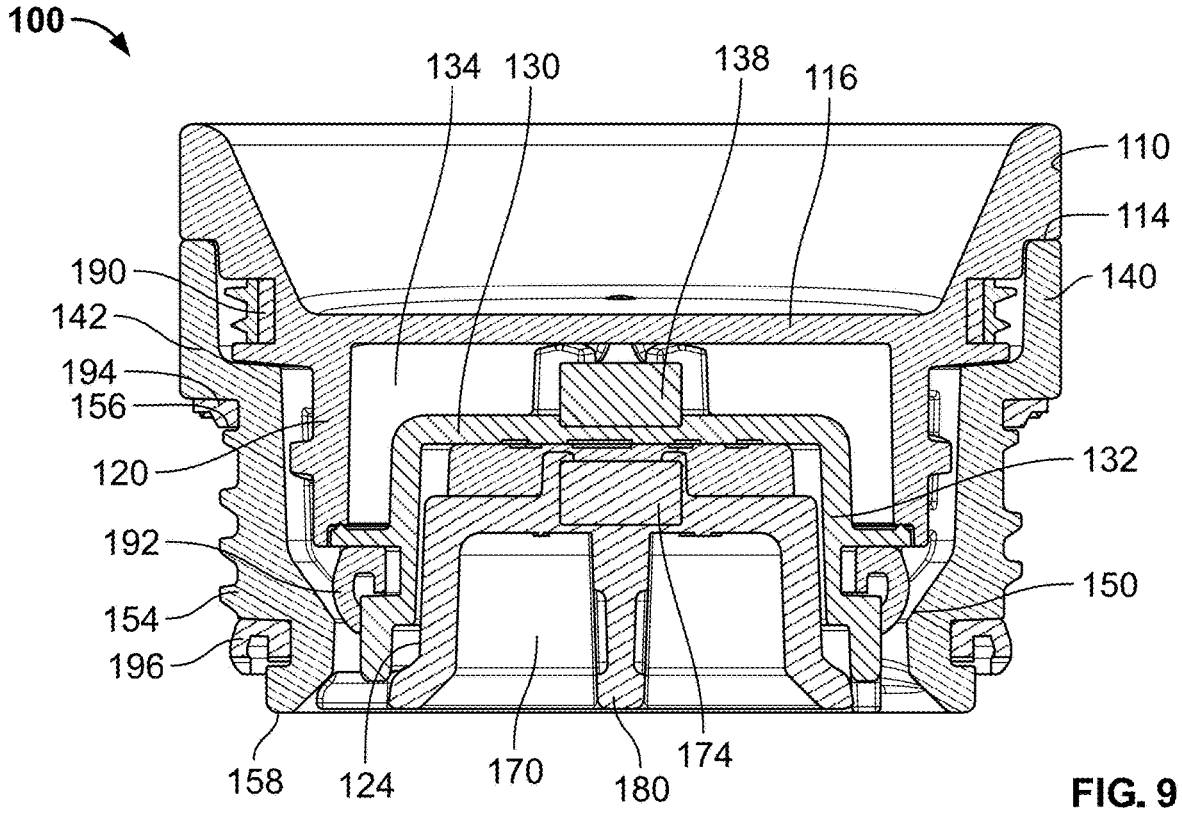
FIG. 9 illustrates a side cross-sectional view of the lid assembly of FIG. 1 in a closed configuration along line 9-9 of FIG. 7 in accordance with aspects of this disclosure.

The upper adapter 110 may also include an enclosed cavity 134 between top wall 116 and opposite the support wall 130 of the receiver 124. As best shown in FIGS. 8 and 9, the enclosed cavity 134 may be formed between the top wall 116 and a support wall 130 of the receiver 124, where an upper adapter magnet 138 may be secured within the enclosed cavity 134. In particular, the upper adapter magnet 138 may be secured to the support wall 130 via a plurality of tabs that secure the upper adapter magnet 138 to the support wall 130. In some examples, the upper adapter magnet 138 may be secured using an adhesive or other means known to one skilled in the art. The enclosed cavity 134 may, in certain examples, be filled, or partially filled, with air to form air pockets for insulation, or a mass of material such as a polymer material, or a polymer foam material. In one specific example, the enclosed cavity 134 may be filled, or partially filled, with an insulating foam, such as polystyrene. However, additional or alternative insulating materials may be utilized to fill, or partially fill the enclosed cavity 134, without departing from the scope of this disclosure.

The lower adapter 140 may comprise an upper cylindrical portion 142 with a shelf 144, a lower cylindrical portion 146 extending below the shelf 144, and an opening 148 extending through the upper cylindrical portion 142 and the lower cylindrical portion 146 that includes an interior surface 150, where the opening 148 at least partially receives the lower cylindrical portion 120 of the upper adapter 110. The interior surface 150 may include an internal threaded portion 152 that engages the external threaded portion 122 of the upper adapter to rotatably couple the upper adapter 110 to the lower adapter 140 when the upper adapter 110 is received in the opening 148 of the lower adapter 140.

In some examples, the internal threaded portion 152 may include one or more channels 153. The channels 153 may interrupt the internal threaded portion 152 forming interrupted threaded portions. The channels 153 may provide a flow path for the fluid to flow when the lid assembly 100 is in an open configuration. The lower cylindrical portion 146 of the lower adapter may further include an external threaded portion 154, an upper gasket groove 156 above the external threaded portion 154, and a lower gasket groove 157 below the external threaded portion 154. A bottom end 158 of the lower cylindrical portion 146 may include a pair of ramped surfaces 160, where each ramped surface 160 has a stop surface 162 at an end of each ramped surface 160.

The puck 170 may be secured within the receiver 124 in the upper adapter 110. The puck 170 may comprise a puck body 172, a puck magnet 174 located within the puck body 172, a groove or slot 176 on an external surface of the puck body 172, and a tab 178 extending outward from an end of the puck 170. The puck body 172 may have a generally cylindrical shape or a shape that corresponds to the receiver 124 such that the puck body 172 can slidably engage with the receiver 124. The puck body 172 may be at least partially received within the cavity 133 of the receiver 124. The groove 176 may be a pair of grooves that are opposite each other on the puck body 172. Each groove 176 may be sized to receive a corresponding protrusion 136 of the receiver 124. When each protrusion 136 is received in its corresponding groove 176, the puck 170 may be rotationally fixed relative to the receiver 124. Additionally, the puck magnet 174 of the puck 170 is magnetically attracted to the upper adapter magnet 138 to secure the puck 170 to the upper adapter 110 in an axial direction (along the axis longitudinally oriented with the lower cylindrical portion 120 of the upper adapter 410). A user may remove the puck 170 by overcoming the magnetic attraction between the puck magnet 174 and the upper adapter magnet 138. To remove the puck 170, a user may grasp a grip element 180 and exert a force greater than the magnetic attraction of the upper adapter magnet 138 and the puck magnet 174 to remove the puck 170 from the receiver 124. The removal of the puck 170 may be needed to disassemble lid assembly 100 to allow for cleaning of the components. In some cases, the puck 170 may include an accessory (not shown) such as a tea strainer or other flavor infusion holder.

Additionally, the lid assembly 100 may include a plurality of gaskets to assist in sealing the lid assembly 100 to the container 10 and also to prevent liquid from flowing when the lid assembly 100 is in the closed configuration. For example, the upper adapter 110 may include a first upper adapter gasket 190 arranged in an upper groove between the shelf 114 and the lower cylindrical portion 120 that contacts the lower adapter 140 and a second upper adapter gasket 192 located in a lower groove spaced above the bottom surface 126 of the receiver 124. The second upper adapter gasket 192 may contact an interior surface 150 of the lower adapter 140 when the lid assembly 100 is in a closed configuration and where the second upper adapter gasket 192 is free of contact with the interior surface when the lid assembly 100 is in an open configuration. In addition, the lower adapter 140 may include a first lower adapter gasket 194 near the junction of the shelf 144 and the lower cylindrical portion 146 and a second lower adapter gasket 196 arranged in a groove near a bottom end of the lower adapter 140. Both lower adapter gaskets 194, 196 contact an interior surface of the container 10 when the lid assembly 100 is installed in the container 10.

Figure 10:
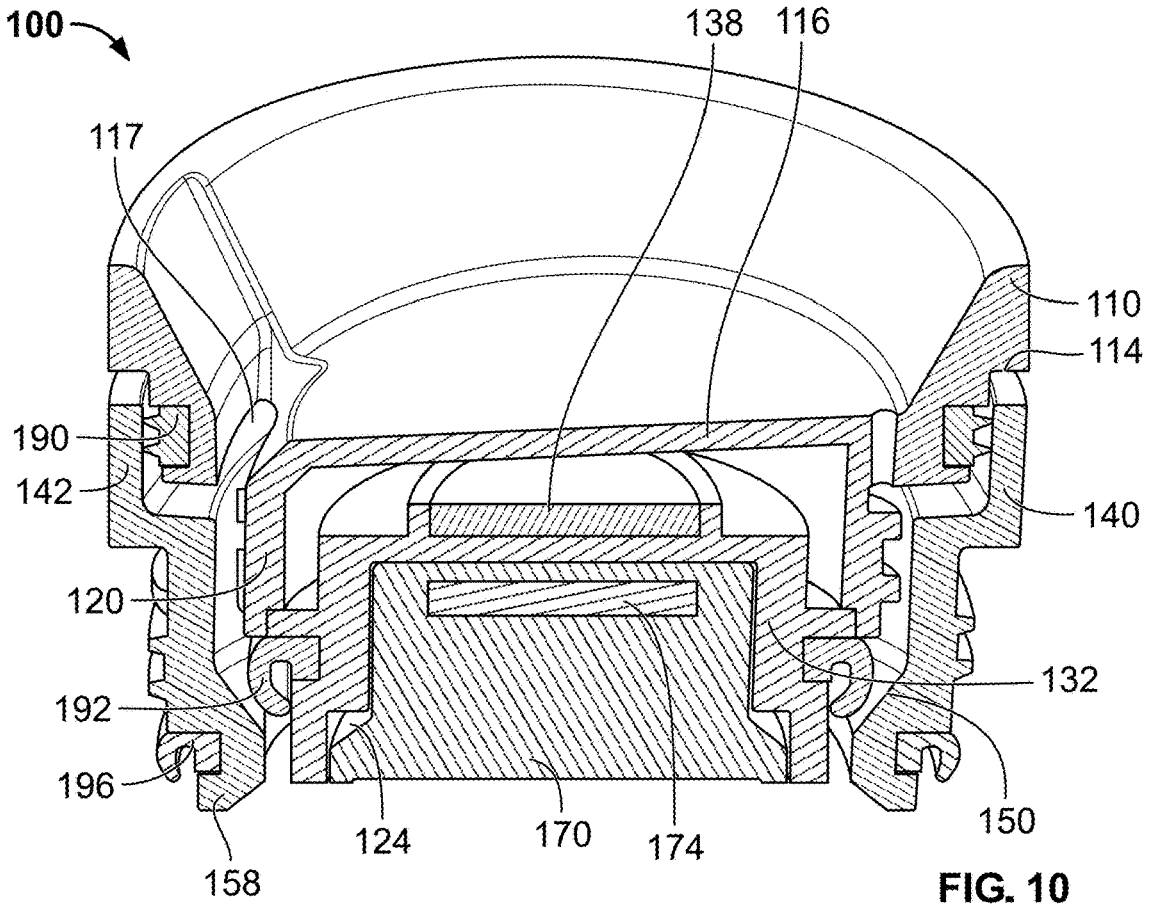
FIG. 10 illustrates a side perspective cross-sectional view of an alternate embodiment of the lid assembly of FIG. 1 in an open configuration in accordance with aspects of this disclosure.
Figure 11A:
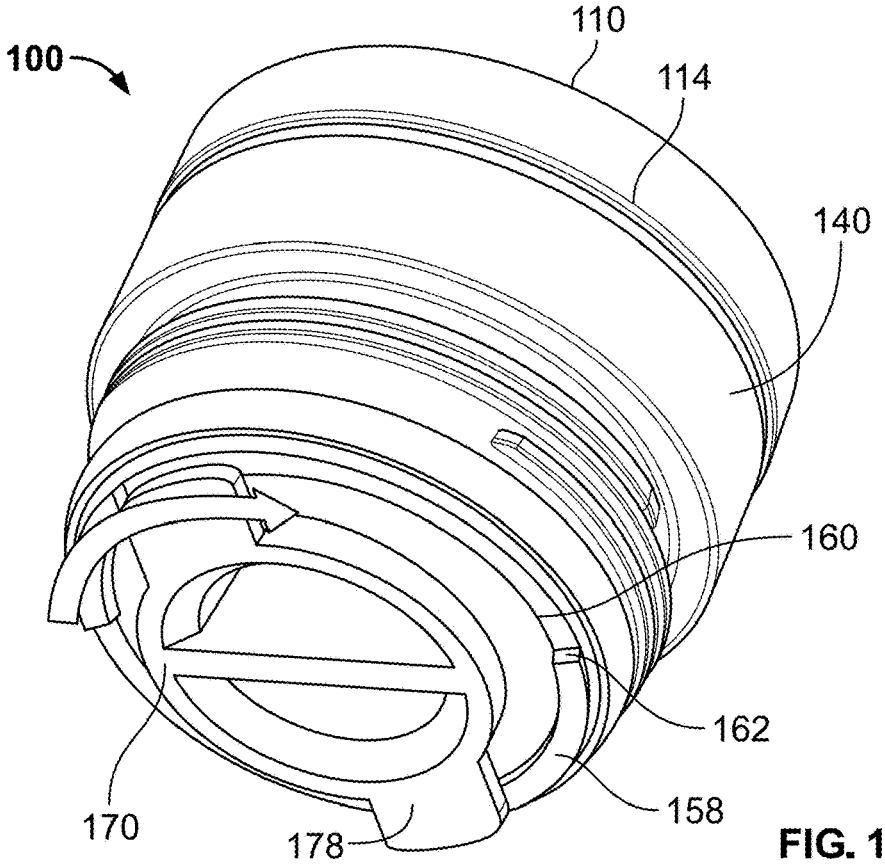
FIG. 11A illustrates a bottom perspective view of the lid assembly of FIG. 1 as the lid assembly moves from a closed configuration to an open configuration in accordance with aspects of this disclosure.
Figure 11B:
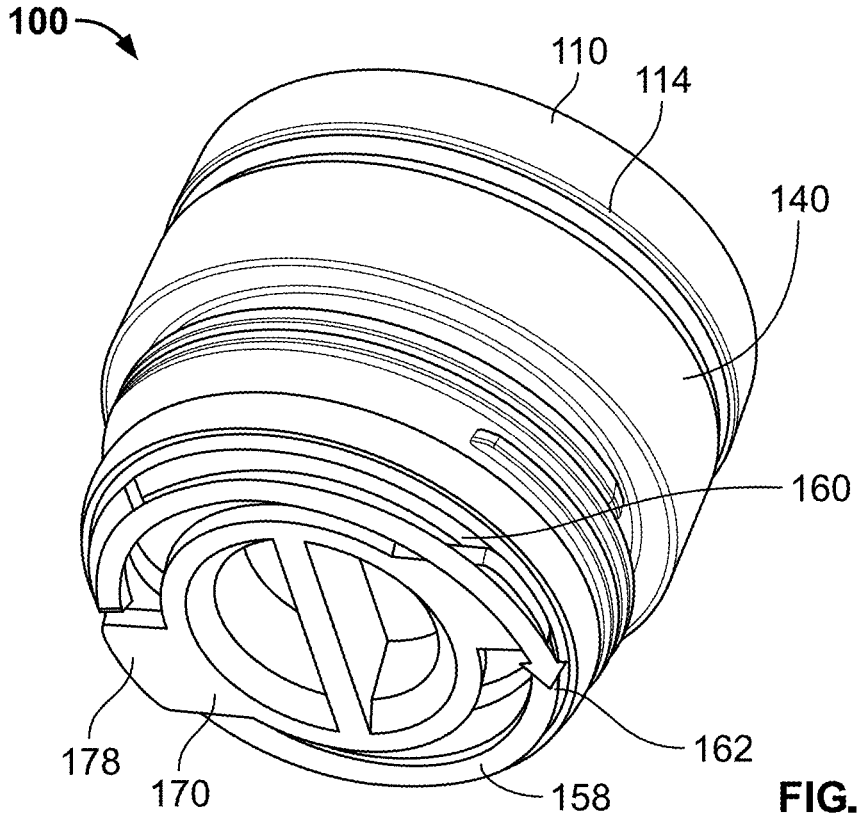
FIG. 11B illustrates a bottom perspective view of the lid assembly of FIG. 1 as the lid assembly moves from a closed configuration to an open configuration in accordance with aspects of this disclosure.
Figure 11C:
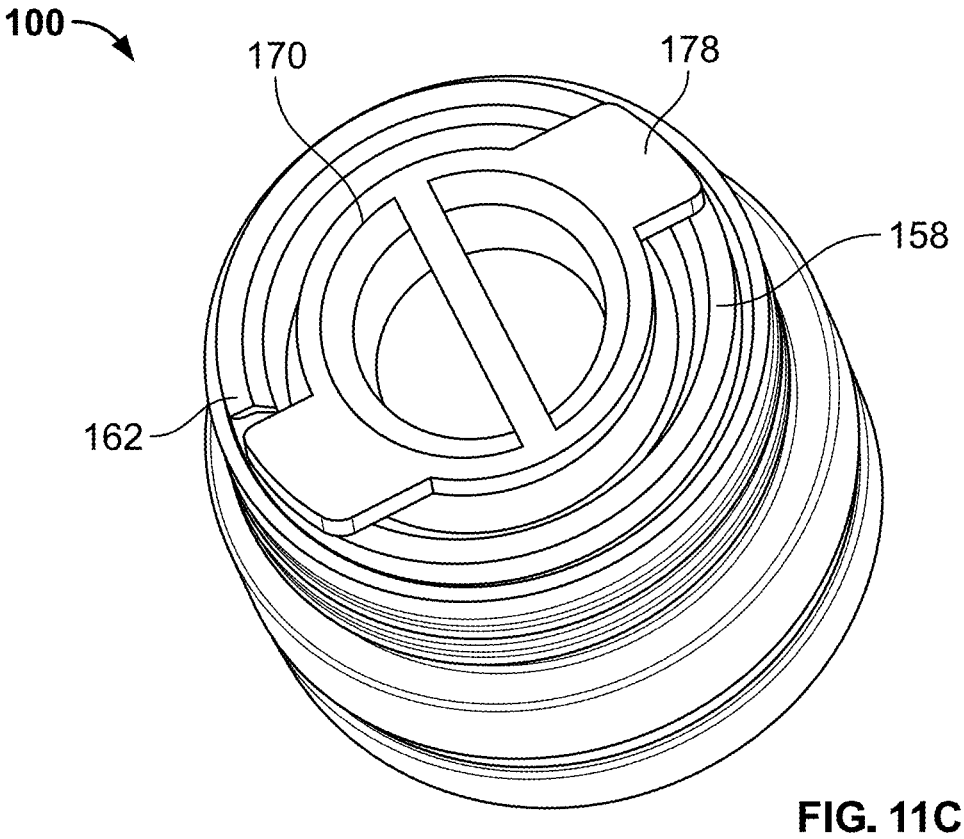
FIG. 11C illustrates a bottom perspective view of the lid assembly of FIG. 1 as the lid assembly moves from a closed configuration to an open configuration in accordance with aspects of this disclosure.
Figure 12:
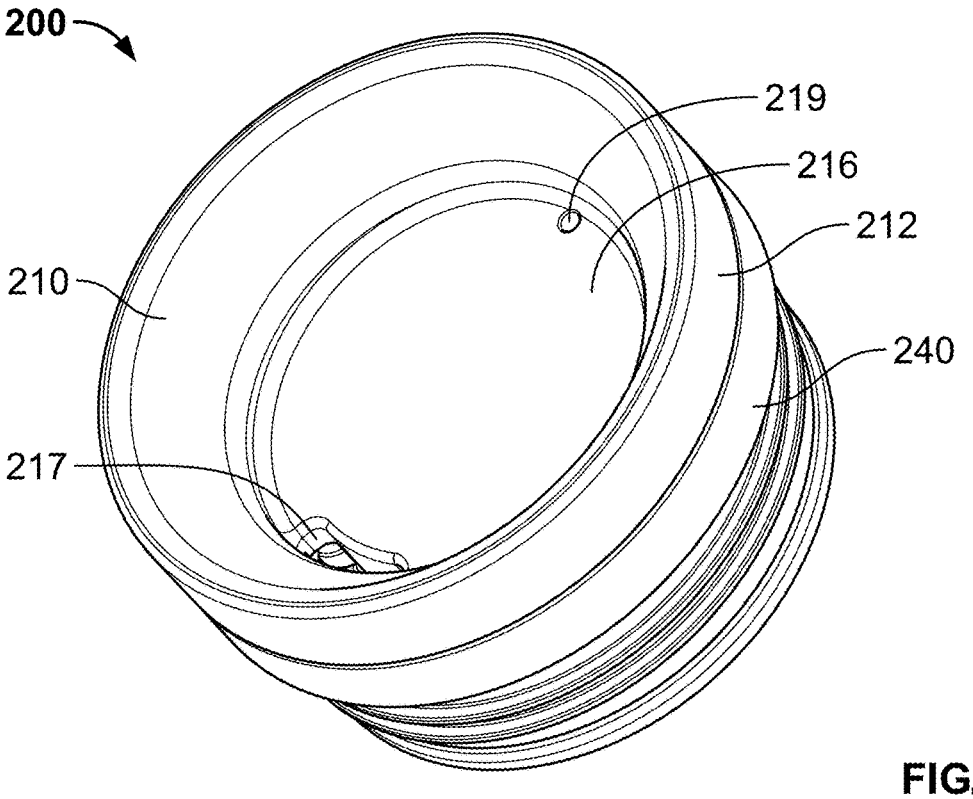
FIG. 12 illustrates a top perspective view of an alternate exemplary lid assembly in accordance with aspects of this disclosure.
Figure 13:
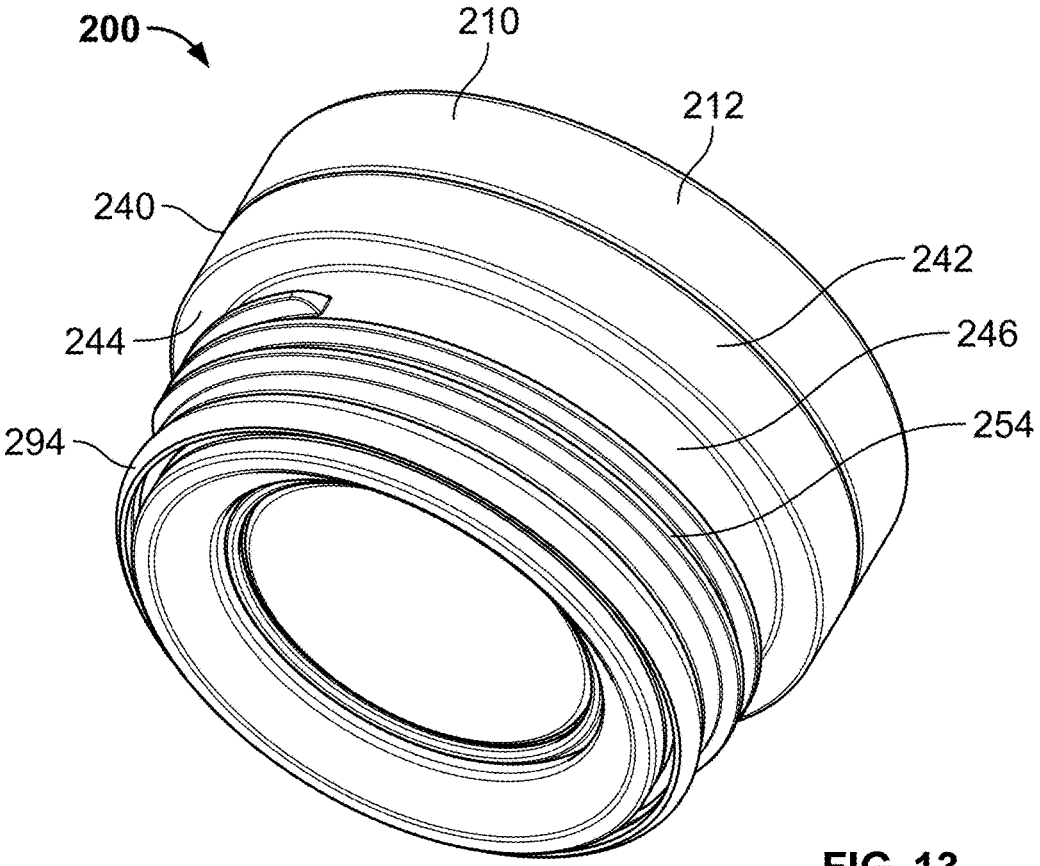
FIG. 13 illustrates a bottom perspective view of the exemplary lid assembly of FIG. 12 in accordance with aspects of this disclosure.
Figure 14:
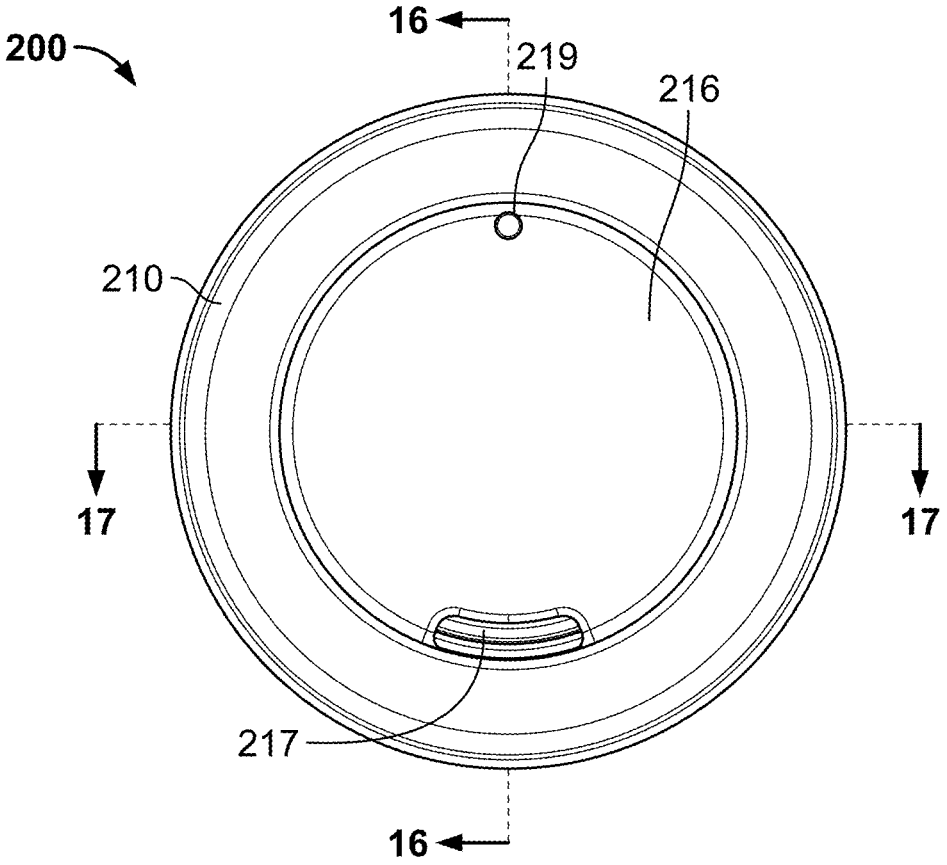
FIG. 14 illustrates a top view of lid assembly of FIG. 12 in accordance with aspects of this disclosure.
Figure 15:
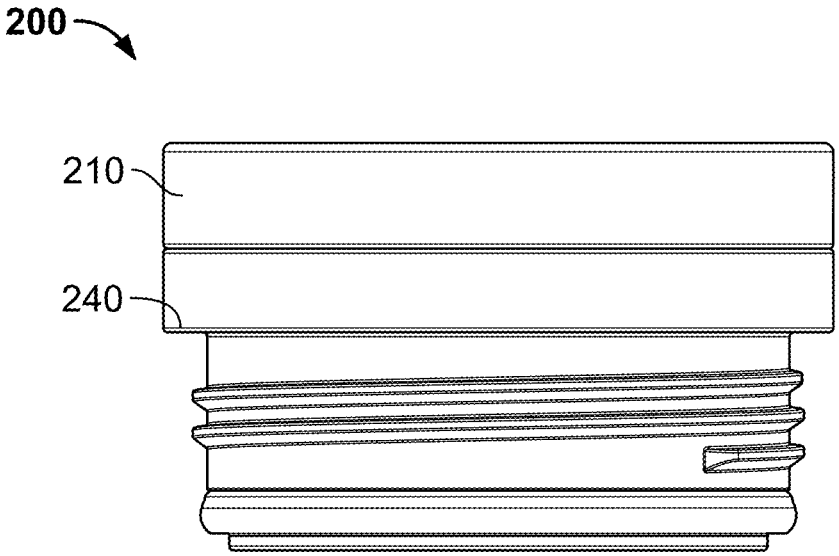
FIG. 15 illustrates a front view of lid assembly of FIG. 12 in accordance with aspects of this disclosure.
Figure 16:
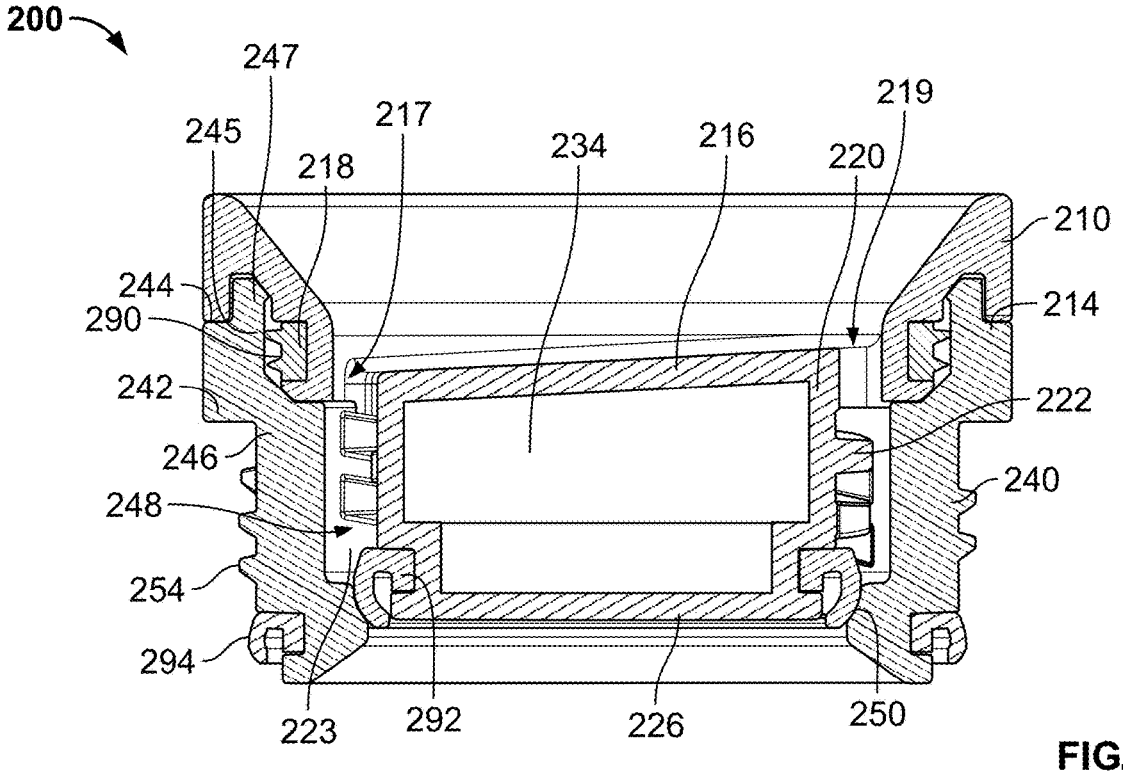
FIG. 16 illustrates a side cross-sectional view of the lid assembly of FIG. 12 in a closed configuration along line 16-16 of FIG. 14 in accordance with aspects of this disclosure.
Figure 17:
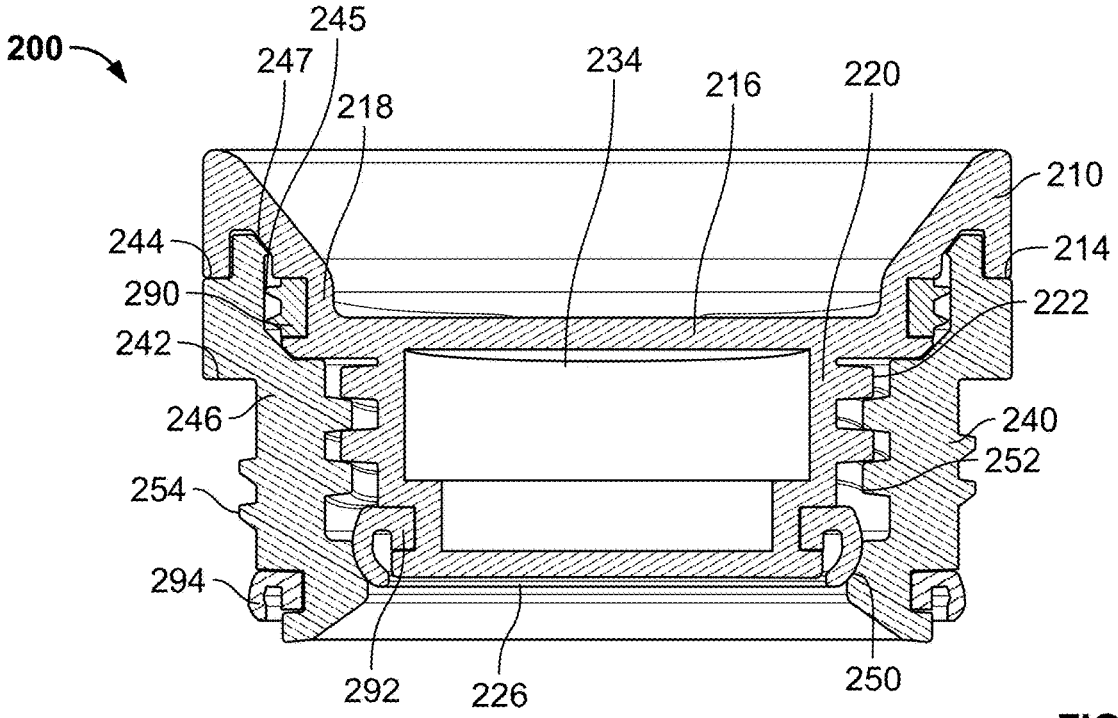
FIG. 17 illustrates a side cross-sectional view of the lid assembly of FIG. 12 in a closed configuration along line 17-17 of FIG. 14 in accordance with aspects of this disclosure.

As discussed above, the lid assembly 100 has a closed configuration and an open configuration. When in the closed configuration, liquid does not flow from the container 10 and when in the open configuration, liquid is allowed to flow from the container 10 through the primary opening 117 of the upper adapter 110. FIGS. 11A-11C illustrate the installation movement of the lid assembly from a closed configuration to an open configuration. As shown in FIG. 11A, when the upper adapter 110 is rotated in a first direction relative to the lower adapter 140, the shelf 114 of the upper adapter 110 moves away from the upper cylindrical portion 142 of the lower adapter 140 creating a space between the shelf 114 and the upper cylindrical portion 142 of the lower adapter 140. The upper adapter 110 may move away from the lower adapter 140 a vertical distance of approximately 5 mm or within a range of 3 mm and 8 mm. As the upper adapter 110 rotates in the first direction, the second upper adapter gasket 192 moves away from an interior surface of the lower adapter 140 creating a gap between the upper adapter 110 and the lower adapter 140 that allows fluid to flow from the container through the primary opening 117 as shown in FIG. 10. As shown in FIGS. 11B and 11C, the upper adapter 110 continues to rotate in the first direction until the tabs 178 of the puck 170 contact the stop surfaces 162 on the bottom end 158 of the lower adapter 140. In some examples, as the upper adapter 110 rotates, the ends of the tabs 178 may contact or be guided by the ramped surfaces 160 at the bottom end 158 of the lower adapter 140 as the tabs 178 approach the stop surfaces 162. The contact between the tab 178 and the lower adapter 140 may limit movement between the upper adapter 110 relative to the lower adapter 140. Once each tab 178 contacts its corresponding stop surface 162, the upper adapter 110 is prevented from further rotation, and further vertical movement, providing a firm tactile feel for a user to know the lid assembly 100 has reached the fully open configuration. In some examples, the upper adapter 110 may rotate relative to the lower adapter 140 approximately 180 degrees from a closed orientation to a fully open orientation. A user may control the fluid amount by rotating the upper adapter 110 less than 180 degrees, such that an open configuration may have a variety of fluid flow options. In some other embodiments, the upper adapter 110 may rotate relative to the lower adapter 140 approximately 90 degrees from a closed orientation to a fully open orientation. In such embodiments, a user may control the fluid amount by rotating the upper adapter 110 less than 90 degrees, such that an open configuration may have a variety of fluid flow options. To move the lid assembly 100 to a closed configuration, a user rotates the upper adapter 110 in a second direction, which is opposite the first direction, until the shelf 114 contacts the upper cylindrical portion 142. As the upper adapter 110 is rotated in the second direction the shelf 114 moves toward the upper cylindrical portion 142 of the lower adapter 140 and the second upper adapter gasket 192 moves into contact with the interior surface of the lower adapter 140. Once the shelf 114 contacts the upper cylindrical portion 142, the second upper adapter gasket 192 is fully engaged with the interior surface of the lower adapter 140 preventing fluid from flowing from the lid assembly 100. In addition, the area between the shelf 114 and the upper cylindrical portion 142 may also include a different color than the remainder of the lid assembly 100 to give a user a visual indication that the lid assembly 100 is in an open configuration.

FIGS. 12-19 illustrate an alternative lid assembly 200. Lid assembly 200 is configured to releasably connect to the container 10 shown in FIG. 3 and described above. Lid assembly 200 may include an upper adapter 210 that is rotatably coupled to a lower adapter 240. The upper adapter 210 may rotate relative to the lower adapter 240 to move the lid assembly 200 between an open configuration, where the open configuration allows fluid to flow from the container 10 and a closed configuration such that liquid does not flow from the container 10.

The upper adapter 210 may comprise an upper cylindrical portion 212 with a shelf surface 214, a top wall 216 connected to the upper cylindrical portion 212, an upper gasket groove 218 located inward from the shelf surface 214, and a lower cylindrical portion 220. The lower cylindrical portion 220 may include an external threaded portion 222, where the external threaded portion include a channel 223. The channel 223 may interrupt the external threaded portion 222 forming an interrupted threaded portion. The channel 223 may provide a flow path for the fluid to flow when the lid assembly 200 is in an open configuration. The top wall 216 may include a primary opening 217 that is an outlet for the fluid in the container 10 when the lid assembly 200 is in an open configuration. In addition, the top wall 216 may include a secondary opening 219 that acts as an air vent for the lid assembly 200. The top wall 216 may also be angled or tilted from a back region that comprises the secondary opening 219 towards a front region that comprises the primary opening 217 such that the front region of the top wall 216 is lower, when measured from a top surface of the upper cylindrical portion 212, than the back region, than the back region. The angled top wall 216 allows for room for a user's nose when drinking from the lid assembly 200.

The lower cylindrical portion 220 may include a lower gasket groove located below the external threaded portion 222 and a bottom wall 226. A cavity 234 may be formed between the top wall 116 and the bottom wall 226. The cavity 234 may, in certain examples, be filled, or partially filled, with air to form air pockets for insulation, or a mass of material such as a polymer material, or a polymer foam material. In one specific example, the cavity 234 may be filled, or partially filled, with an insulating foam, such as polystyrene. However, additional or alternative insulating materials may be utilized to fill, or partially fill the cavity 234, without departing from the scope of these disclosures.

The lower adapter 240 may be coupled to the upper adapter 210 to control the fluid flow from the container 10. The lower adapter 240 may comprise an upper cylindrical portion 242 with a shelf surface 244, and a lower cylindrical portion 246 extending below upper cylindrical portion 242. An opening 248 may extend through the upper cylindrical portion 242 and the lower cylindrical portion 246 and may include an interior surface 250. The opening 248 may at least partially receive the lower cylindrical portion 220 of the upper adapter 210. The interior surface 250 may include an internal threaded portion 252 that engages the external threaded portion 222 of the upper adapter 210 to rotatably couple the upper adapter 210 to the lower adapter 240 when the upper adapter 210 is received in the opening 248 of the lower adapter 240.

In some examples, the internal threaded portion 252 may include one or more channels. The channels may interrupt the internal threaded portion 252 forming interrupted threaded portions. The channels may provide a flow path for the fluid to flow when the lid assembly 200 is in an open configuration. The lower cylindrical portion 246 of the lower adapter 240 may further include an external threaded portion 254 and a lower gasket groove below the external threaded portion 254.

Additionally, the lid assembly 200 may include a plurality of gaskets to assist in scaling the lid assembly 200 to the container 10 and also to prevent liquid from flowing when the lid assembly 200 is in the closed configuration. For example, the upper adapter 210 may include a first upper adapter gasket 290 arranged in an upper groove located inboard of the shelf surface 214 that contacts an interior surface of the upper cylindrical portion 242. In particular, the first upper adapter gasket 290 may contact an interior surface of an indicator 245, where the indicator 245 includes an overhang 247. The indicator 245 may be located inboard of and also extend above the shelf surface 244 of the lower adapter 240. The overhang 247 may comprise a tab that extends inboard of the interior surface of the indicator 245. A second upper adapter gasket 292 may be located in a lower gasket groove near a bottom end of the lower adapter 240. The second upper adapter gasket 292 may contact an interior surface 250 of the lower adapter 240 when the lid assembly 200 is in a closed configuration and may be free of contact with the interior surface when the lid assembly 200 is in an open configuration. In addition, the lower adapter 240 may include a lower adapter gasket 294 arranged in a groove near a bottom end of the lower adapter 240. The lower adapter gasket 294 may contact an interior surface of the container 10 when the lid assembly 200 is installed in the container 10 to prevent liquid from escaping around the lid assembly 200.

Figure 18:
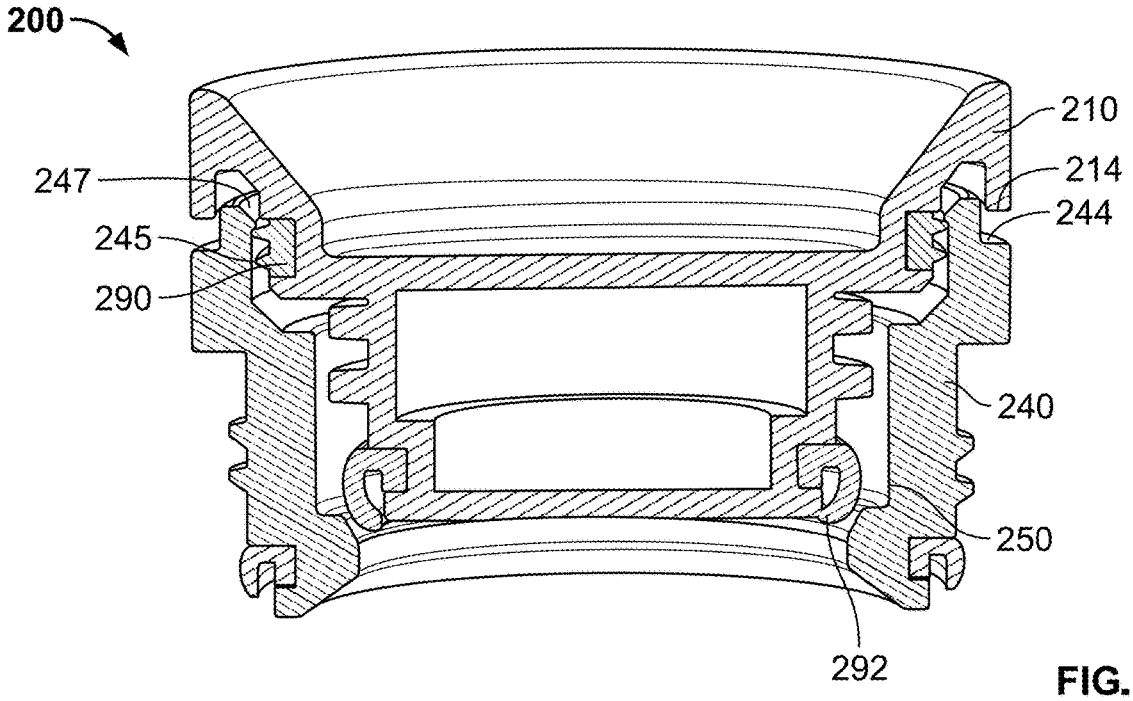
FIG. 18 illustrates a side perspective cross-sectional view of the lid assembly of FIG. 12 in an open configuration in accordance with aspects of this disclosure.
Figure 19:
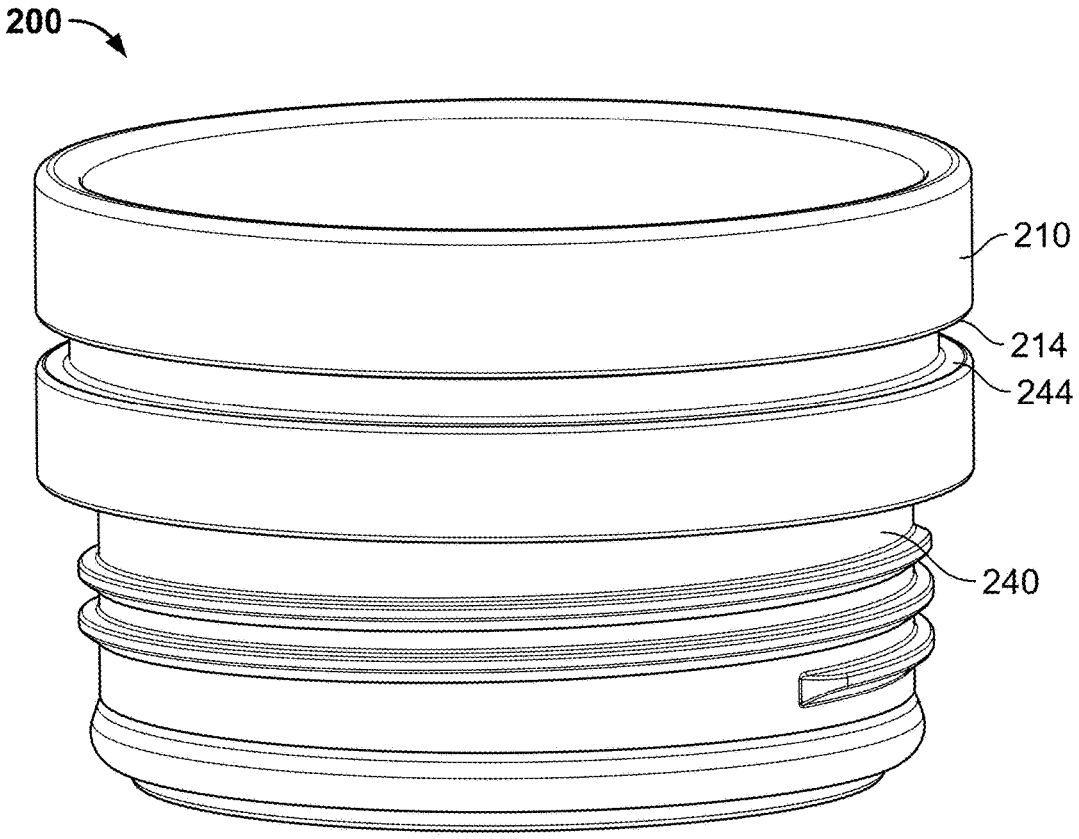
FIG. 19 illustrates a side perspective view of the lid assembly of FIG. 12 in an open configuration in accordance with aspects of this disclosure.
Figure 20:
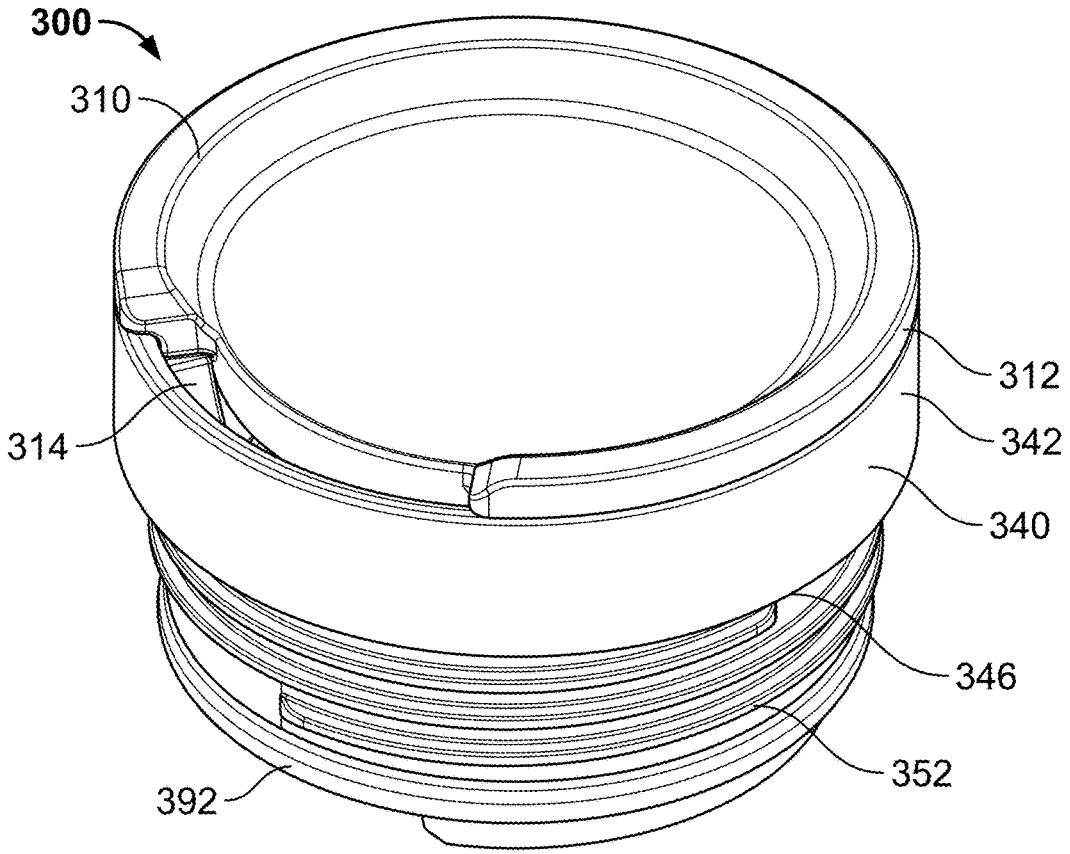
FIG. 20 illustrates a top perspective view of an alternate exemplary lid assembly in accordance with aspects of this disclosure.
Figure 21:
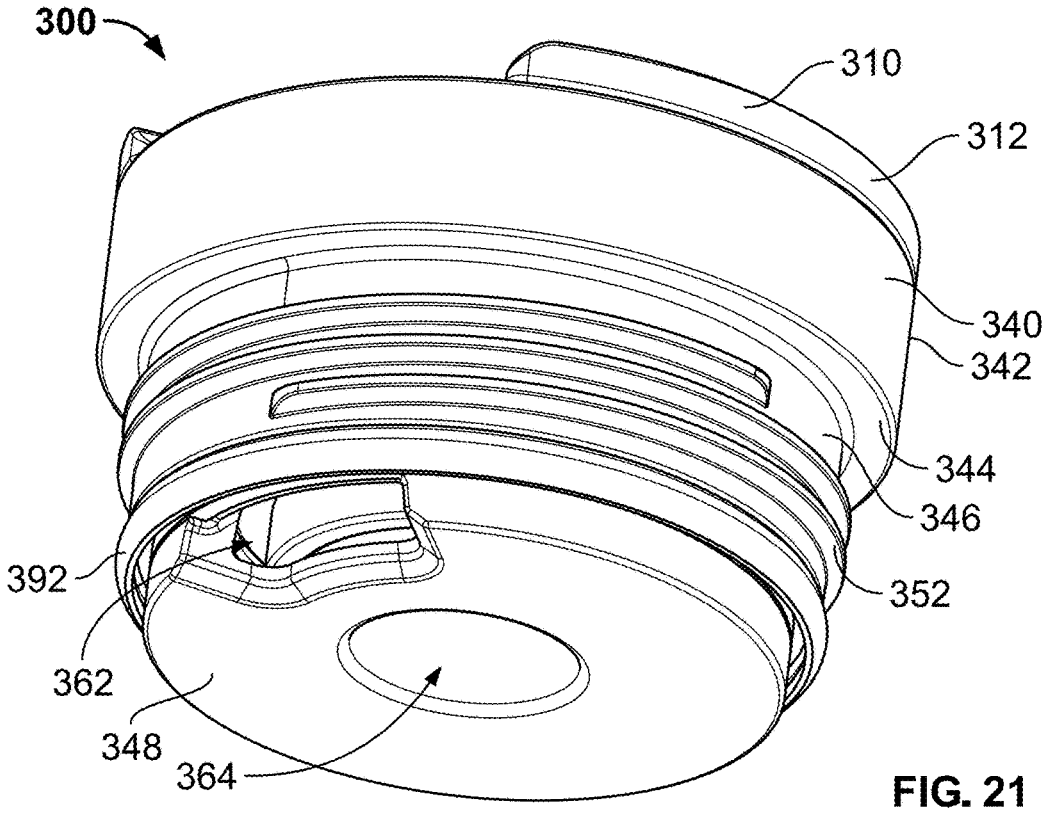
FIG. 21 illustrates a bottom perspective view of the exemplary lid assembly of FIG. 20 in accordance with aspects of this disclosure.
Figure 22:
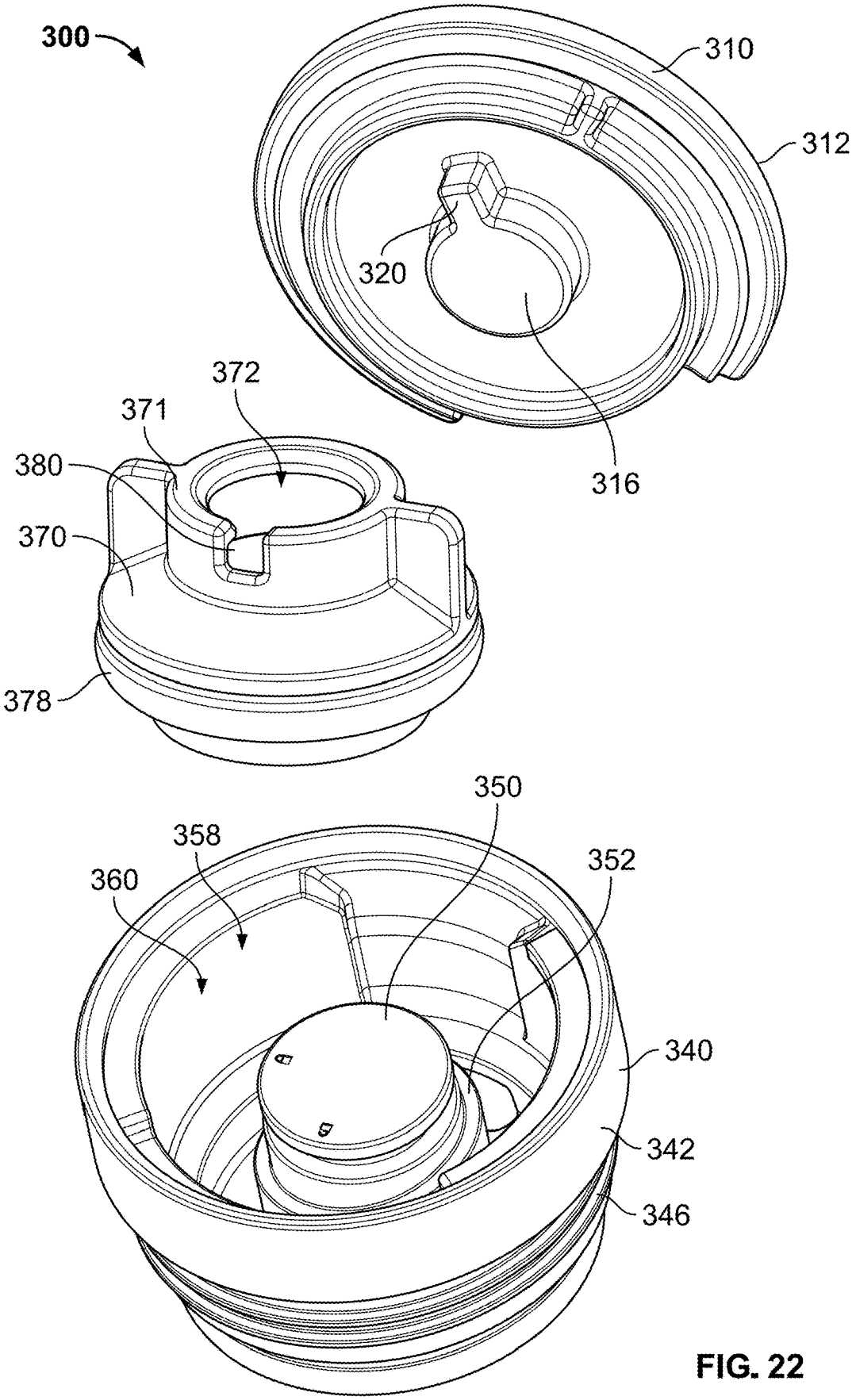
FIG. 22 illustrates a partially exploded perspective view of the lid assembly of FIG. 20 in accordance with aspects of this disclosure.
Figure 23:
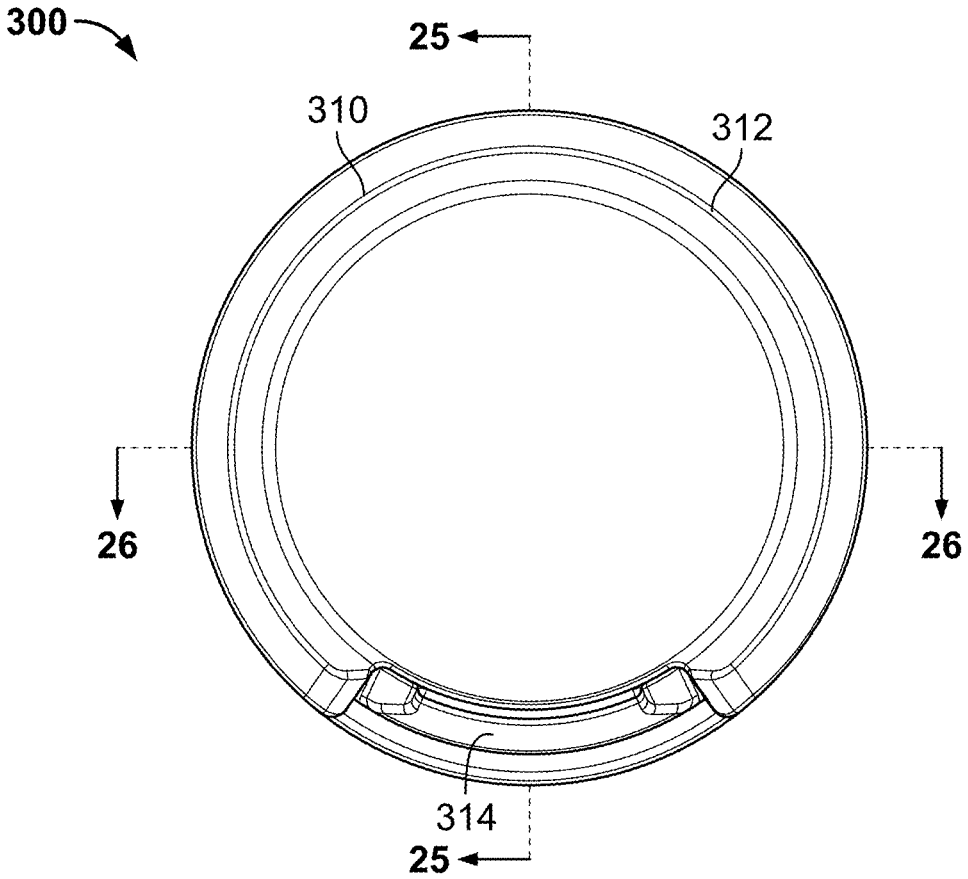
FIG. 23 illustrates a top view of lid assembly of FIG. 20 in accordance with aspects of this disclosure.
Figure 24:
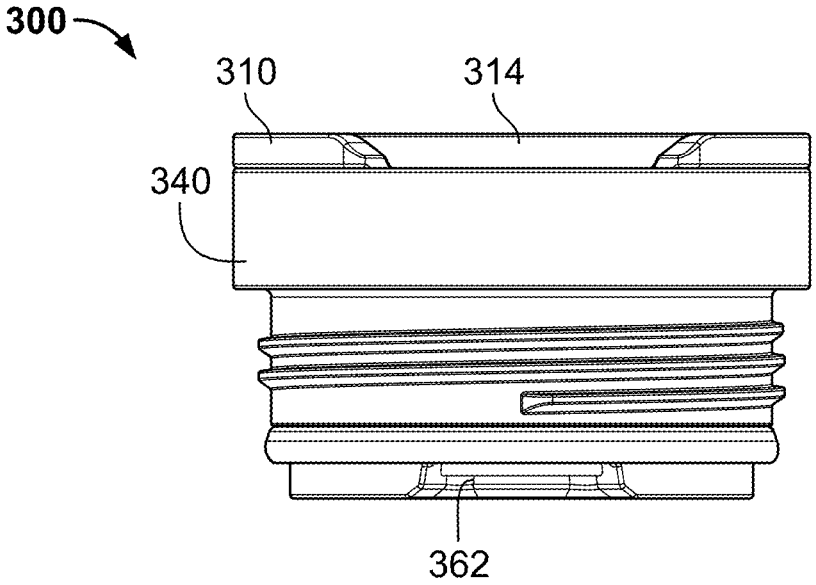
FIG. 24 illustrates a front view of lid assembly of FIG. 20 in accordance with aspects of this disclosure.
Figure 25:
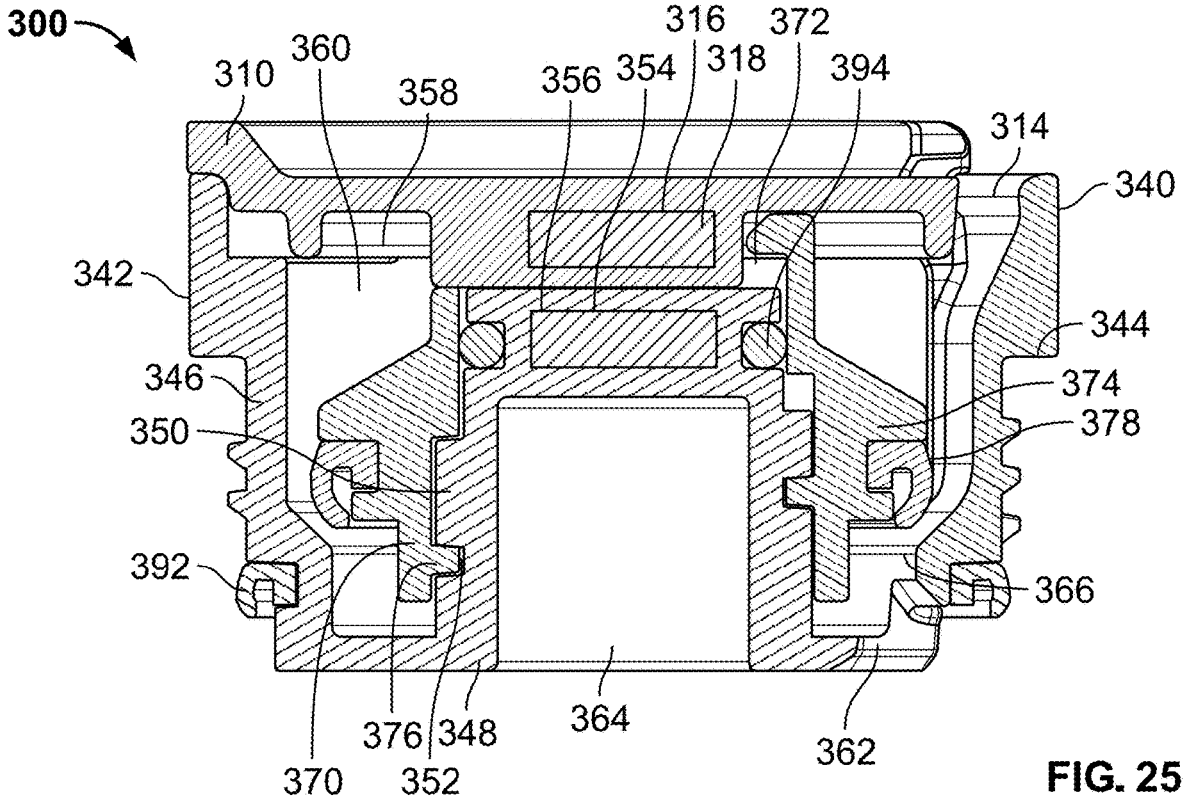
FIG. 25 illustrates a side cross-sectional view of the lid assembly of FIG. 20 in an open configuration along line 25-25 of FIG. 23 in accordance with aspects of this disclosure.
Figure 26:
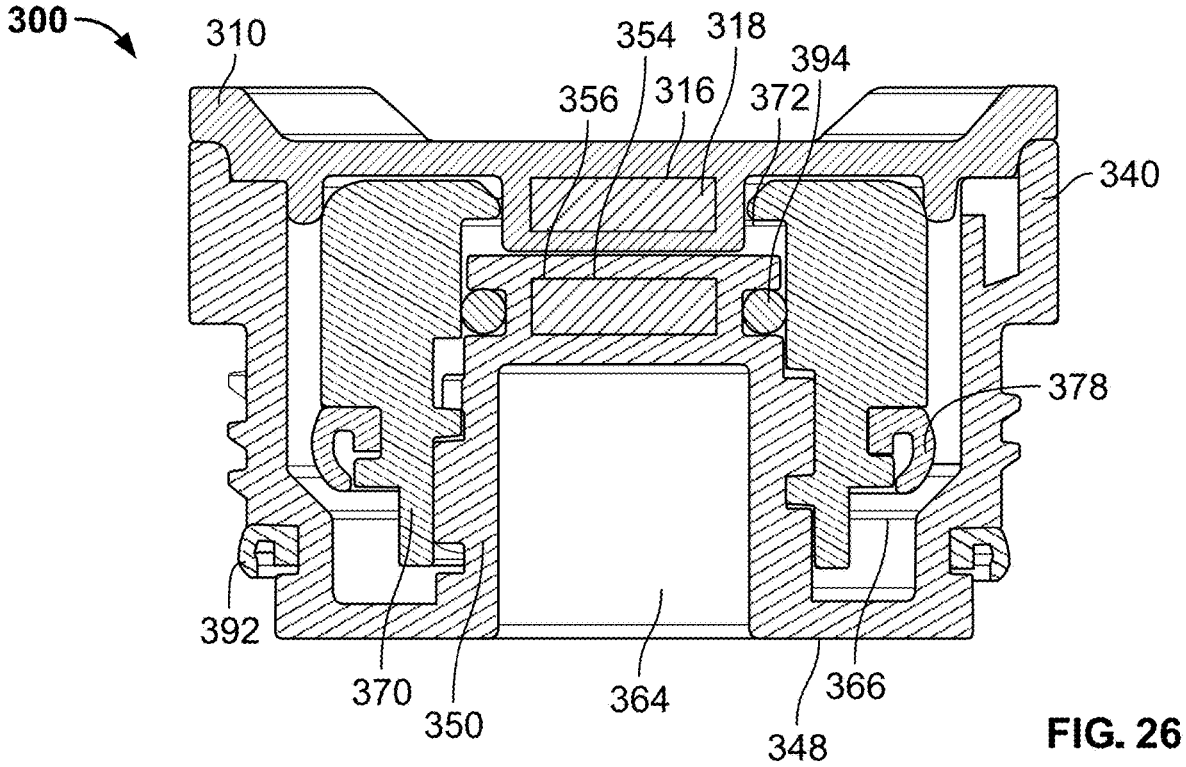
FIG. 26 illustrates a side cross-sectional view of the lid assembly of FIG. 20 in an open configuration along line 26-26 of FIG. 23 in accordance with aspects of this disclosure.
Figure 27:
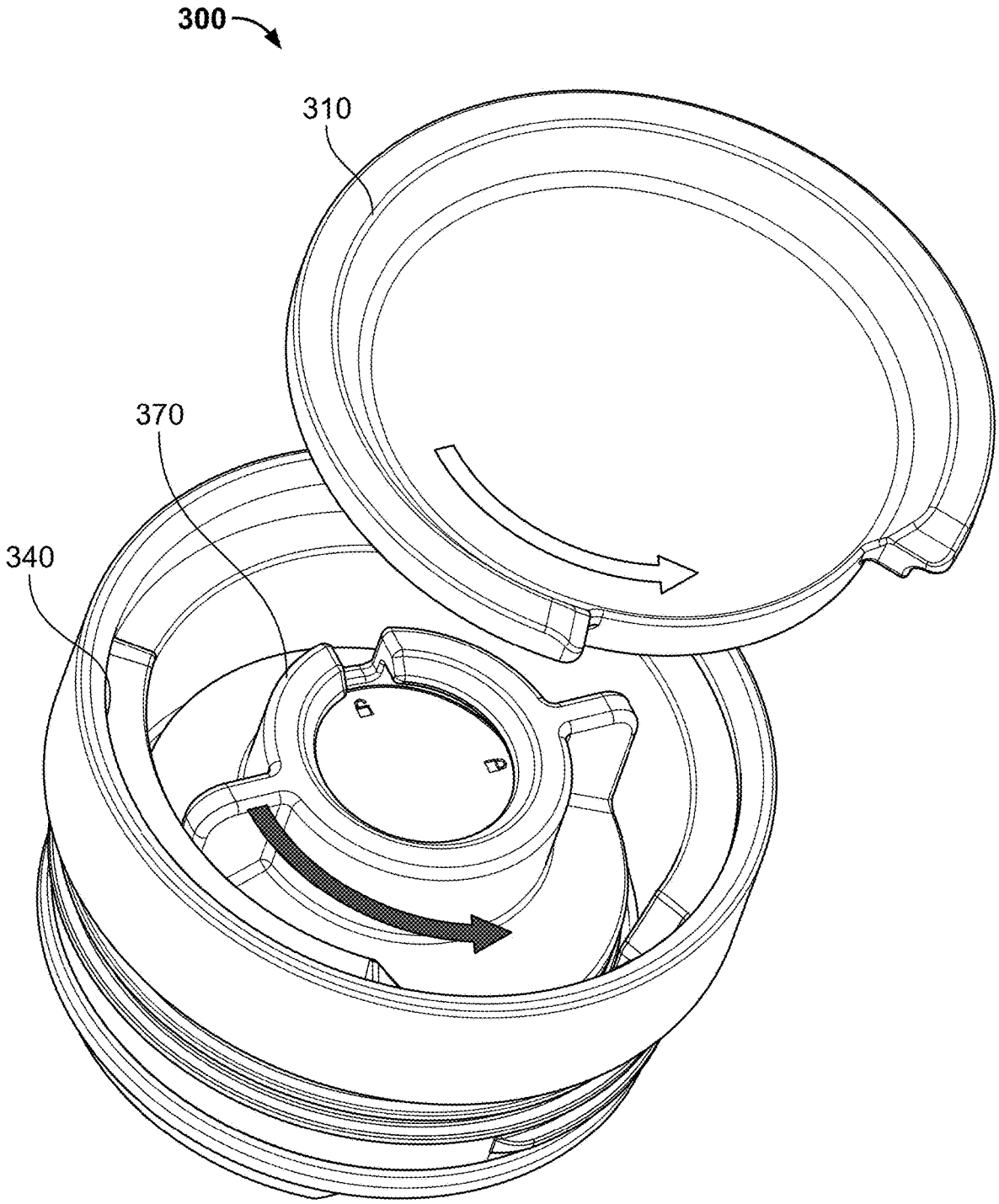
FIG. 27 illustrates a partially exploded top perspective view of the lid assembly of FIG. 20 in accordance with aspects of this disclosure.
Figure 28:
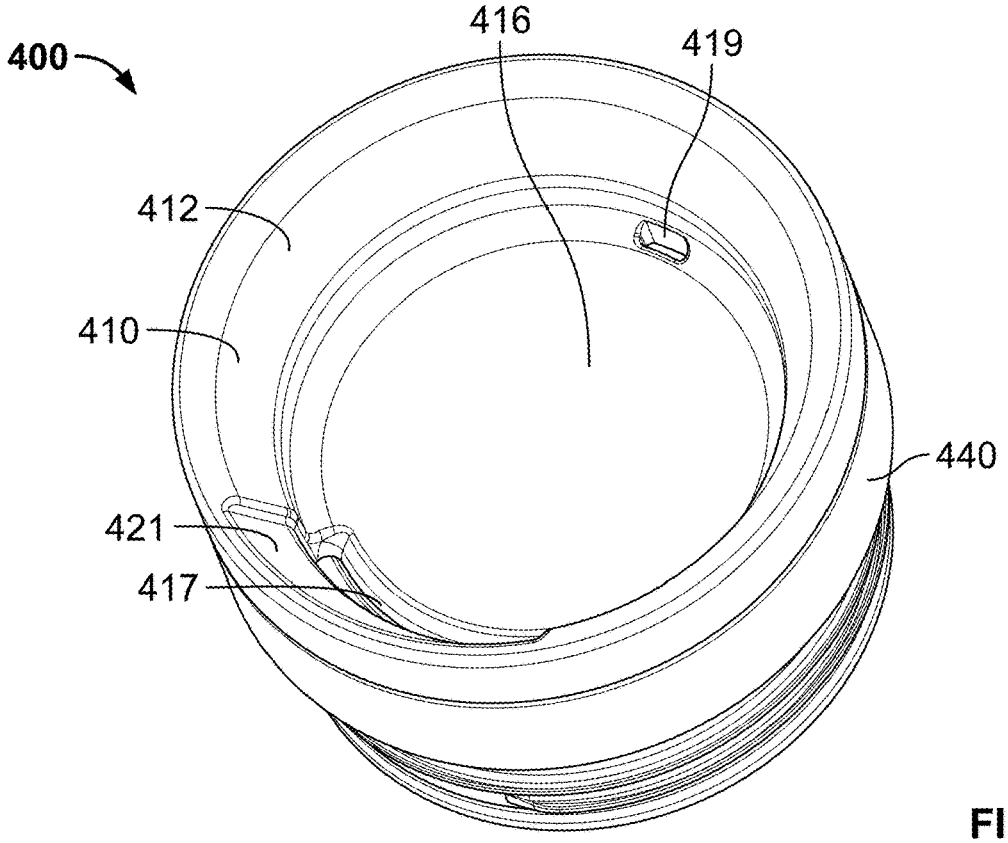
FIG. 28 illustrates a top perspective view of an alternate exemplary lid assembly in accordance with aspects of this disclosure.
Figure 29:
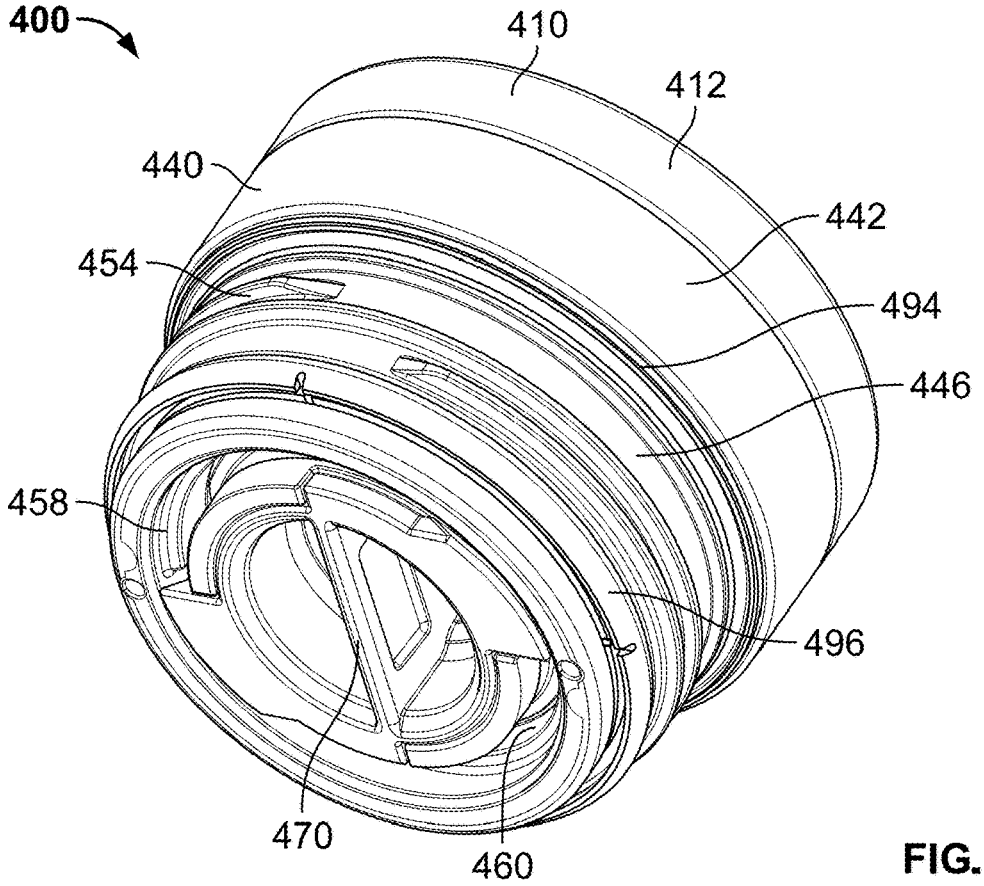
FIG. 29 illustrates a bottom perspective view of the exemplary lid assembly of FIG. 28 in accordance with aspects of this disclosure.
Figure 30:
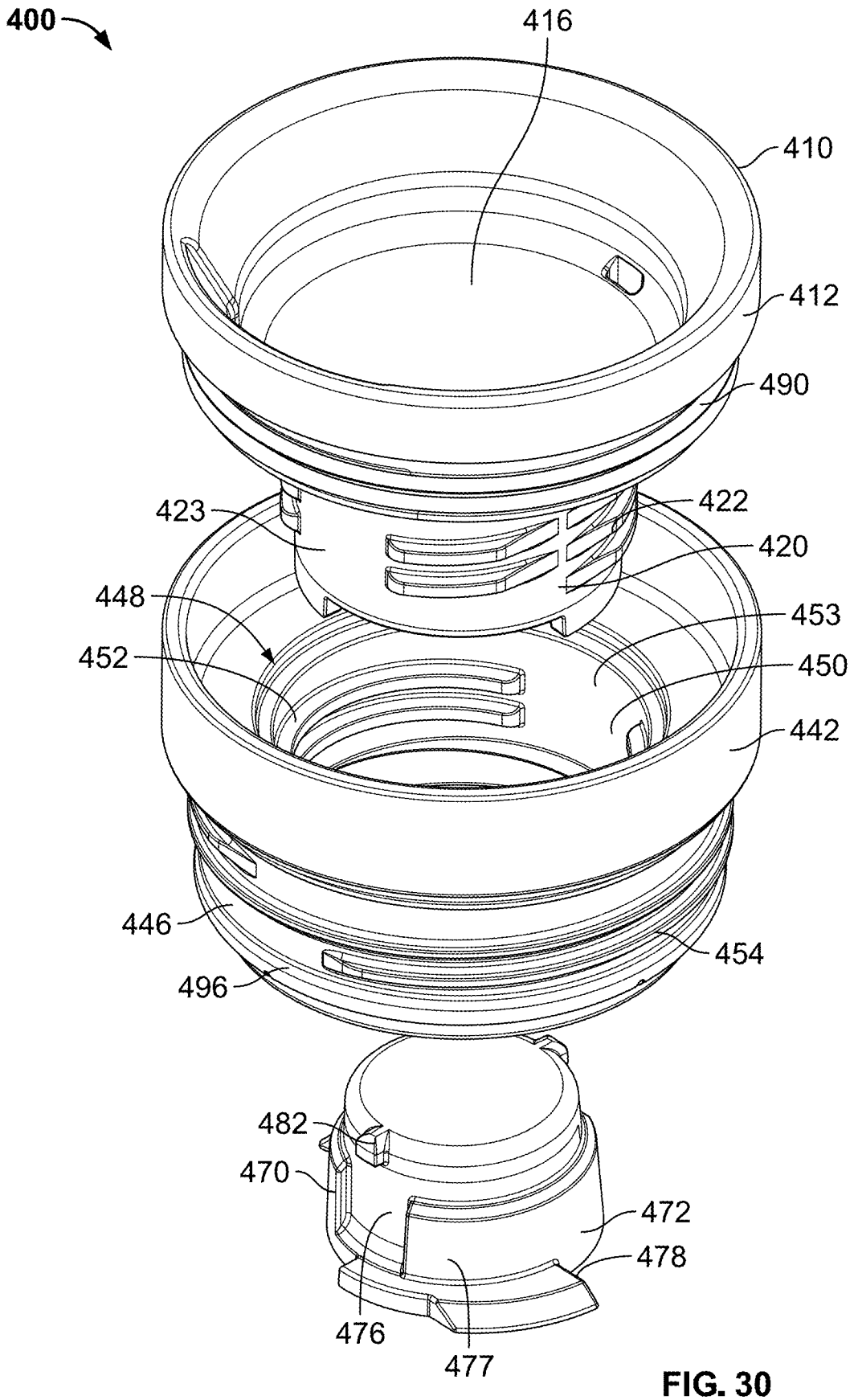
FIG. 30 illustrates a partially exploded top perspective view of the lid assembly of FIG. 28 in accordance with aspects of this disclosure.
Figure 31:
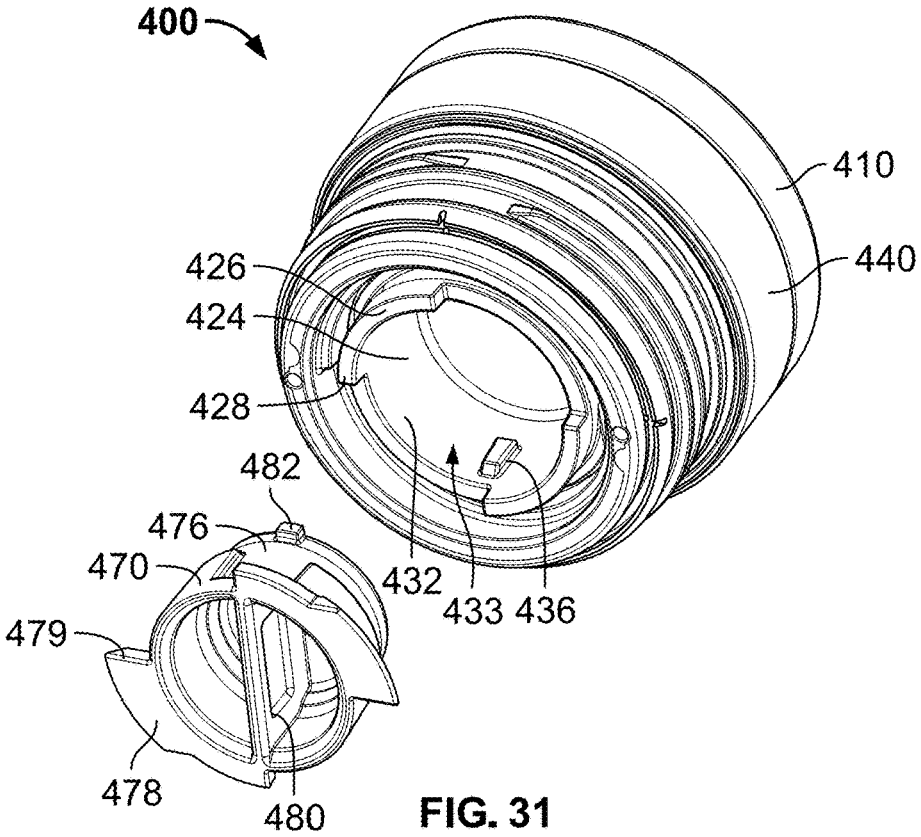
FIG. 31 illustrates a partially exploded bottom perspective view of the lid assembly of FIG. 28 in accordance with aspects of this disclosure.
Figure 32:
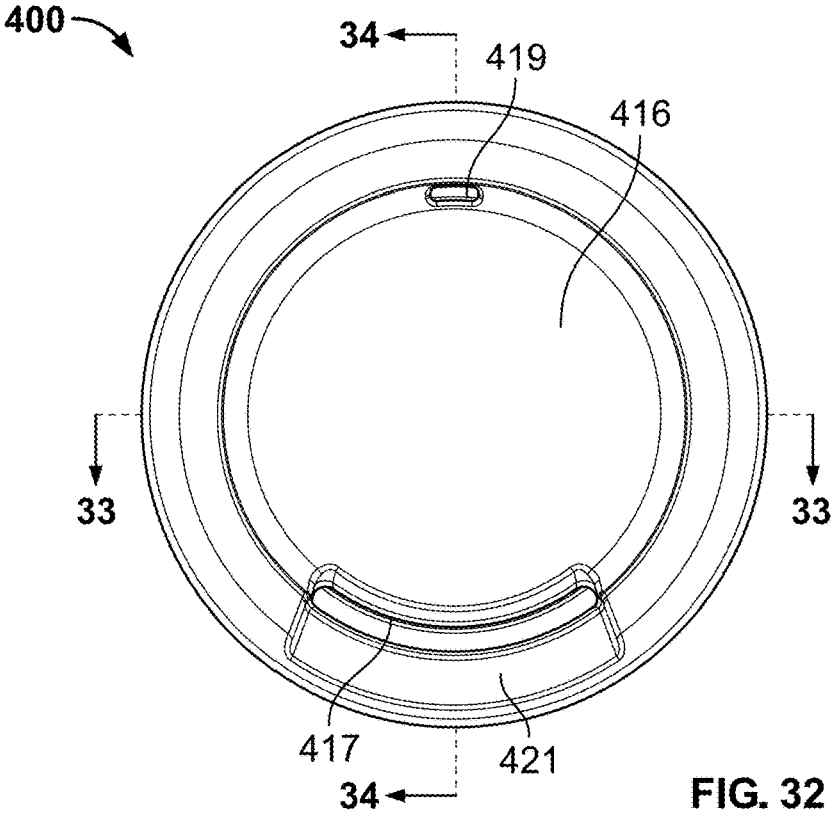
FIG. 32 illustrates a top view of lid assembly of FIG. 28 in accordance with aspects of this disclosure.

As discussed above, the lid assembly 200 may have a closed configuration and an open configuration. When in the closed configuration, liquid does not flow from the container 10 and when in an open configuration, liquid is allowed to flow from the container 10 through the primary opening 217 of the upper adapter 210. To move the lid assembly 200 from a closed configuration to an open configuration, the upper adapter 210 rotates relative to the lower adapter 240. When the upper adapter 210 is rotated in a first direction relative to the lower adapter 240, the shelf surface 214 of the upper adapter 210 moves away from the shelf surface 244 of the upper cylindrical portion 242 of the lower adapter 240 creating a space between the shelf surface 214 and the upper cylindrical portion 242 as shown in FIGS. 18-19. As the upper adapter 210 rotates in the first direction, the second upper adapter gasket 292 moves away from an interior surface 250 of the lower adapter 240 creating a gap between the upper adapter 210 and the lower adapter 240 that allows fluid to flow from the container through the primary opening 217. As the upper adapter 210 moves away from the lower adapter 240 to a predetermined distance, the first upper adapter gasket 290 may contact the overhang 247 of the indicator 245. When the first upper adapter gasket 290 contacts the overhang 247, any continued rotation of the upper adapter 210 in the first direction will become more difficult providing feedback to the user that the lid assembly 200 is in a fully open configuration. If a user wishes to remove the upper adapter 210 from the lower adapter 240, the user can continue to rotate the upper adapter 210 until the upper adapter 210 is free from the lower adapter 240. The overhang 247 does not prevent removal of the upper adapter 210 from the lower adapter 240, but the overhang 247 makes rotation more difficult to provide tactile feedback to the user of the state of the lid assembly 200 such that the lid assembly 200 is in an open configuration. A user may control the fluid amount by the amount of rotation of the upper adapter 210. The area between the shelf surface 214 and the upper cylindrical portion 242 may also include a different color than the remainder of the lid assembly 100 to give a user a visual indication that the lid assembly 200 is in an open configuration. To move the lid assembly 200 to a closed configuration, a user rotates the upper adapter 210 in a second direction, which is opposite the first direction, until the shelf surface 214 contacts the shelf surface 244 of the upper cylindrical portion 242. As the upper adapter 210 is rotated in the second direction, the shelf surface 214 moves toward the upper cylindrical portion 242 of the lower adapter 240, and the second upper adapter gasket 292 moves into contact with the interior surface of the lower adapter 240. Once the shelf surface 214 contacts the shelf surface 244 of the upper cylindrical portion 242, the second upper adapter gasket 292 is fully engaged with the interior surface of the lower adapter 240 preventing fluid from flowing from the lid assembly 200. Thus, the lid assembly 200 is in a closed configuration.

FIGS. 20-27 illustrate an alternative lid assembly 300. Lid assembly 300 is configured to releasably connect to the container 10 shown in FIG. 3 and described above. Lid assembly 300 may include an upper adapter 310 that is coupled to a lower adapter 340 and an inner adapter 370. The upper adapter 310 may be rotationally fixed to the inner adapter 370 such that when the upper adapter 310 rotates, the inner adapter 370 rotates with it. In addition, when the upper adapter 310 rotates relative to the lower adapter 340, the lid assembly 300 may move between an open configuration that allows fluid to flow from the container 10 and a closed configuration that prevents liquid from flowing from the container 10.

The upper adapter 310 may comprise a disc-shaped body 312 with a notch or opening 314 located along a portion of an edge of the disc-shaped body 312, and a cavity 316 that includes an upper adapter magnet 318. A protrusion or key 320 may extend from a lower surface of the disc-shaped body 312.

The lower adapter 340 may comprise an upper cylindrical portion 342 with a shelf surface 344, a lower cylindrical portion 346 extending below the shelf surface 344, a bottom wall 348 located at a bottom end of the lower cylindrical portion 346. The lower adapter 340 further comprising an inner cylindrical portion 350 extending upward from the bottom wall 348. The inner cylindrical portion 350 may include a threaded portion 352 and a pocket 354 connected to an upper end of the inner cylindrical portion 350. The pocket 354 may secure a lower adapter magnet 356. The lower adapter magnet 356 may be magnetically attracted to the upper adapter magnet 318 to removably secure the upper adapter 310 to the lower adapter 340. An opening 358 may extend from a top end of the upper cylindrical portion 342 and extend into a cavity 360 that extends between the lower cylindrical portion 346 and to the inner cylindrical portion 350. The bottom wall 348 may include an opening 362 that when the lid assembly 300 is in an open configuration, fluid flows from the container 10 through the opening 362 and through the opening 314 of the upper adapter 310. The bottom wall 348 may include a receiver 364 that in some examples, may receive an accessory (not shown) such as a tea strainer.

An inner adapter 370 may be received in the cavity 360 of the lower adapter 340 and may help control the fluid flow from the container 10 as the lid assembly 300 moves between an open configuration and a closed configuration. The inner adapter 370 may include a central opening 372 with an interior surface 374 that includes a threaded portion 376 that engages threaded portion 352 of the inner cylindrical portion 350 of the lower adapter 340. The inner adapter 370 may further comprise an inner adapter gasket 378 that contacts an interior surface 366 of the lower adapter 340 when the lid assembly 300 is in a closed configuration and is free of contact with an interior surface of the lower adapter 340 when the lid assembly 300 is in an open configuration. The upper surface 371 of the inner adapter 370 may include a notch or slot 380 that receives the key 320 to rotationally couple the upper adapter 310 and the inner adapter 370.

Additionally, the lid assembly 300 may include a plurality of gaskets to assist in sealing the lid assembly 300 to the container 10 and also to prevent liquid from flowing when the lid assembly 300 is in the closed configuration. For example, the lower adapter 340 may include an outer gasket 392 that is positioned near the bottom wall 348 of the lower adapter 340 around the lower cylindrical portion 346. The outer gasket 392 may be configured to seal the lid assembly 300 to the container 10. The outer gasket 392 may contact an interior surface of the container 10 when the lid assembly 300 is installed in the container 10 to prevent liquid from escaping around the lid assembly 300. The lower adapter 340 may also include an inner gasket 394 located between the inner adapter 370 and the inner cylindrical portion 350 of the lower adapter 340. Additionally, as discussed above, an inner adapter gasket 378 may be located in a groove on the inner adapter 370 to contact an interior surface 366 of the lower adapter 340 when the lid assembly 300 is in a closed configuration. The inner adapter gasket 378 may be contact with an interior surface 366 of the lower adapter 340 when the lid assembly 300 is in an open configuration.

The lid assembly 300 may have a closed configuration and an open configuration. When in the closed configuration, liquid does not flow from the container 10 and when in the open configuration, liquid is allowed to flow from the container 10 through the opening 314 of the upper adapter 310. To move the lid assembly 300 between a closed configuration and an open configuration, the upper adapter 310 rotates relative to the lower adapter 340. When the upper adapter 310 is rotated in a first direction relative to the lower adapter 340, the inner adapter 370, being rotationally fixed with the upper adapter 310, moves with the upper adapter 310. As the inner adapter 370 rotates in the first direction, the inner adapter 370 moves upward relative to the lower adapter 340 because of the interaction between the threaded portions 352, 376. As the inner adapter 370 moves upward the inner adapter gasket 378 moves upward and away from the interior surface 366 of the lower adapter 340. When the inner adapter gasket 378 is free of contact with the interior surface 366, fluid is allowed to flow from the container 10 through the opening 362 in the lower adapter 340 and the opening 314 of the upper adapter 310. To move the lid assembly 300 to a closed configuration from an open configuration, a user may rotate the upper adapter 310 in a second direction, opposite the first direction, which causes the inner adapter 370 to be lowered until the inner adapter gasket 378 contacts the interior surface of the lower adapter 340. Once the inner adapter gasket 378 seals against the interior surface 366 of the lower adapter 340, the lid assembly 300 is in the closed configuration.

FIGS. 28-42 illustrate views or partial views of the lid assembly 400. The lid assembly 400 may include an upper adapter 410 that is coupled to a lower adapter 440 and a puck 470 that may be removably coupled to the upper adapter 410, where the puck 470 may be magnetically coupled to the upper adapter 410. When the puck 470 is coupled to the upper adapter 410, the upper adapter 410 may be movably coupled to the lower adapter 440, where the upper adapter 410 may be rotationally coupled to the lower adapter 440 such that the upper adapter 410 and the lower adapter 440 can rotate relative to each other. The upper adapter 410 and lower adapter 440 may also be axially or linearly coupled, where the upper adapter 410 may also move vertically along a longitudinal axis of the lid assembly 400. In addition, when installed into the upper adapter 410, the puck 470 may be rotationally fixed with the puck 470 such that when the upper adapter 410 rotates that the puck 470 also rotates. The puck 470 may be removably coupled to the upper adapter 410 where the puck 470 has features to limit the amount of rotation of the upper adapter 410 relative to the lower adapter 440. The puck 470, when installed, may prevent the removal of the upper adapter 410 from the lower adapter 440. Additionally, the puck 170 may also be easily removed from the upper adapter 410 to disassemble the lid assembly 400 (e.g., removal of the upper adapter 410 from the lower adapter 440) for easy cleaning and maintenance such as gasket replacement. The lid assembly 400 may be configured to connect to a container 10 shown in FIGS. 3-4B in the same manner as lid assembly 100. The upper adapter 410 may rotate relative to the lower adapter 440 to move the lid assembly 400 between a closed configuration to prevent a fluid or liquid to flow from the container 10 and through the lid assembly 400 and an open configuration where a fluid or liquid is allowed to flow from the container 10 and through the lid assembly 400.

The upper adapter 410 may comprise an upper cylindrical portion 412 with a shelf 414, a top wall 416 connected to the upper cylindrical portion 412, an upper gasket groove 418 located below the shelf 414, and a lower cylindrical portion 420. The lower cylindrical portion 420 may include an external threaded portion 422, and a receiver 424 that receives the puck 470. The top wall 416 may include a primary opening 417 that is an outlet for the fluid in the container 10 when the lid assembly 400 is in an open configuration. The primary opening 417 may be adjacent a tapered channel 421 along an interior surface of the upper cylindrical portion 412 to act as a spout for a user. In some examples, the top wall 416 may be substantially parallel with a top surface of the upper cylindrical portion 412. Alternatively, the top wall 416 may include a secondary opening 419 that acts as an air vent for the lid assembly 400. The top wall 416 may also be angled or tilted from a back region that comprises the secondary opening 419 towards a front region that comprises the primary opening 417 such that the front region of the top wall 416 is lower, when measured from a top surface of the upper cylindrical portion 412, than the back region. The angled top wall 416 allows for room for a user's nose when drinking from the lid assembly 400.

The lower cylindrical portion 420 may comprise a receiver 424 that helps to secure the puck 470 to the upper adapter 410. The receiver 424 be located at a bottom region 458 of the lower cylindrical portion 420. The receiver 424 may comprise a support wall 430, a side wall 432 connecting the support wall 430 and a bottom surface 426. The side wall 432 may be substantially cylindrical in shape and may surround a cavity 433 that is open to the area below the lid assembly 400. The bottom surface 426 of the receiver 424 may include a stop 428, where the stop 428 may be a notch in the bottom surface 426 of the receiver 424. The bottom surface 426 may comprise a pair of stops 428 arranged opposite each other on the bottom surface 426. The stops 428 may contact a tab 478 of the puck 470 to rotationally fix the puck 470 to the receiver 424, which rotationally fixes the puck 470 to the upper adapter 410. The side wall 432 may include an interior surface that has a protrusion 436 that is received in a recess 476 on an external surface of the puck 470. In some examples, the side wall 432 may include more than one protrusion 436. For example, the receiver 424 in the illustrated example includes a pair of protrusions 436 that are located opposite each other on the side wall 432. Each protrusion 436 may have a generally rectangular cross-sectional profile, although in other examples, the protrusions 436 may have a different cross-sectional shape. Each protrusion 436 may have a tapered shape such that the width is larger near the support wall 430 than at the bottom surface 426. Alternatively, the receiver 424 may have grooves to receive a protrusion located on the puck 470 to rotationally fix the puck 470 to the receiver 424.

Figure 33:
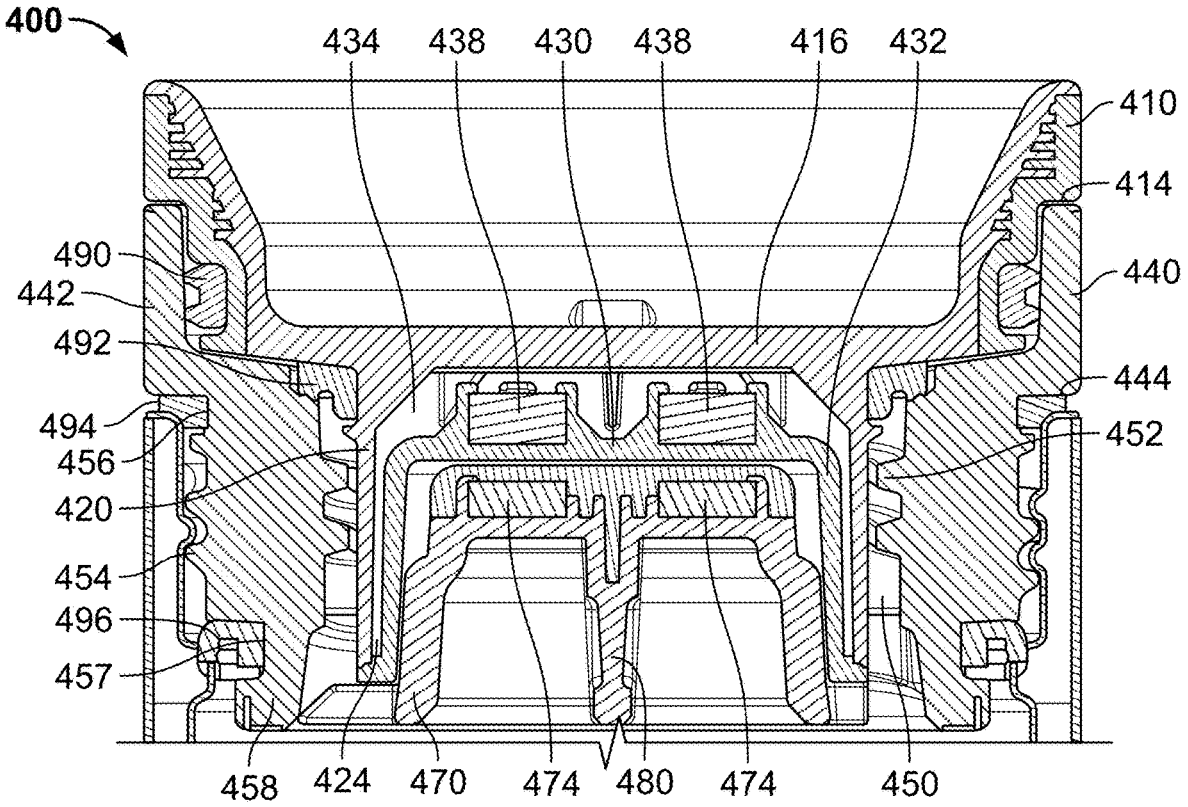
FIG. 33 illustrates a side cross-sectional view of the lid assembly of FIG. 28 in a closed configuration along line 33-33 of FIG. 32 in accordance with aspects of this disclosure.
Figure 34:
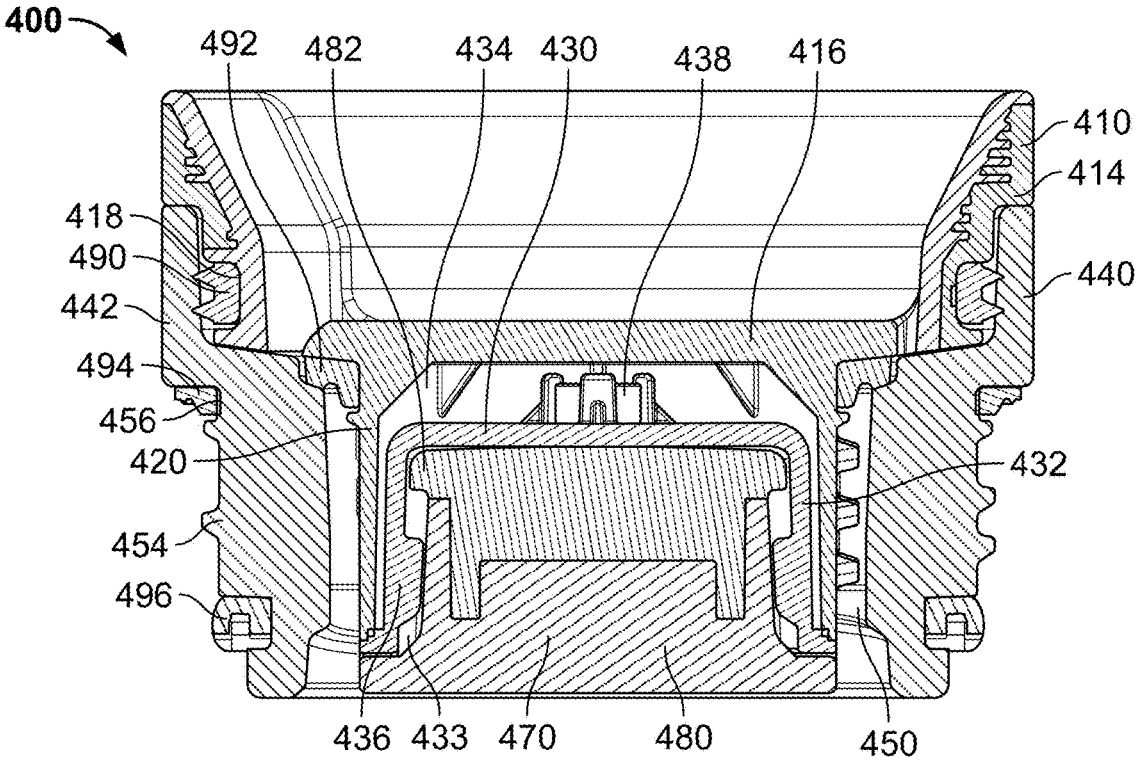
FIG. 34 illustrates a side cross-sectional view of the lid assembly of FIG. 28 in a closed configuration along line 34-34 of FIG. 32 in accordance with aspects of this disclosure.

The upper adapter 410 may also include an enclosed cavity 434 between top wall 416 and opposite the support wall 430 of the receiver 424. As best shown in FIGS. 33 and 34, the enclosed cavity 434 may be formed between the top wall 416 and a support wall 430 of the receiver 424, where one or more upper adapter magnets 438 may be secured within the enclosed cavity 434. In particular, the upper adapter magnets 438 may be secured to the support wall 430 via a plurality of tabs that secure the upper adapter magnets 438 to the support wall 430. The one or more upper adapter magnets 438 may comprise a pair of upper adapter magnets 438 that are both secured to the support wall 430 spaced apart from each other. In some examples, the upper adapter magnets 438 may be secured using an adhesive, overmolding process, or other means known to one skilled in the art. The enclosed cavity 434 may, in certain examples, be filled, or partially filled, with air to form air pockets for insulation, or a mass of material such as a polymer material, or a polymer foam material. In one specific example, the enclosed cavity 434 may be filled, or partially filled, with an insulating foam, such as polystyrene. However, additional or alternative insulating materials may be utilized to fill, or partially fill the enclosed cavity 434, without departing from the scope of this disclosure.

The lower cylindrical portion 420 of the upper adapter 410 may include an external threaded portion 422. In some examples, the external threaded portion 422 may include a channel 423. The channel 423 may interrupt the external threaded portion 422 forming interrupted threaded portions 425. When in an open configuration, the channel 423 may align with the primary opening 417 of the top wall 416 to provide a flow path for the fluid to flow when the lid assembly 400 is in an open configuration. The external threaded portion 422 may comprise three interrupted threaded portions 425, where the channel 423 and a pair of breaks 427 may interrupt the external threaded portion 422. At least one end of each of the three interrupted threaded portions 425 may comprise a tapered or chamfered region 429, where the chamfered regions 429 are adjacent the breaks 427 in the external threaded portion 422. In some examples, the chamfered region 429 on an interrupted threaded portion 425 on one side may be substantially parallel to a chamfered region 429 of an interrupted threaded portion 425 on an opposite side of the lower cylindrical portion 420. These breaks 427 and chamfered regions 429 of the threaded portions 425 may help improve manufacturability of the upper adapter 410.

The lower adapter 440 may comprise an upper cylindrical portion 442 with a shelf 444, a lower cylindrical portion 446 extending below the shelf 444, and an opening 448 extending through the upper cylindrical portion 442 and the lower cylindrical portion 446 that includes an interior surface 450, where the opening 448 at least partially receives the lower cylindrical portion 420 of the upper adapter 410. The interior surface 450 may include an internal threaded portion 452 that engages the external threaded portion 422 of the upper adapter 410 to rotatably couple the upper adapter 410 to the lower adapter 440 when the upper adapter 410 is received in the opening 448 of the lower adapter 440.

In some examples, the internal threaded portion 452 may include one or more channels 453. The channels 453 may interrupt the internal threaded portion 452 forming interrupted threaded portions. One of the channels 453 may align with the primary opening 417 in the top wall 416 to provide a flow path 402 for the fluid to flow when the lid assembly 400 is in an open configuration. The lower cylindrical portion 446 of the lower adapter 440 may further include an external threaded portion 454, an upper gasket groove 456 above the external threaded portion 454, and a lower gasket groove 457 below the external threaded portion 454. The lower cylindrical portion 446 may include a pair of ramped surfaces 460, where each ramped surface 460 has a stop surface 462 at an end of each ramped surface 460. Each ramped surface 460 may extend from the interior surface 450 of the opening 448 and gradually spiral upward along the interior surface 450.

The puck 470 may be secured within the receiver 424 in the upper adapter 410. The puck 470 may comprise a puck body 472, one or more puck magnets 474 located within the puck body 172, a recess 476 on an external surface 477 of the puck body 472, and a tab 478 extending outward from a first end 481 of the puck 470. As shown in the illustrated examples, the puck 470 comprises a pair of tabs 478. An end of each tab 478 may extend beyond an external surface of the first lower cylindrical portion 420 of the upper adapter 410. The puck body 472 may have a generally cylindrical shape or a shape that corresponds to the receiver 424 such that the puck body 172 can slidably engage with the receiver 424. The puck body 472 may be at least partially received within the cavity 433 of the receiver 424. The puck body 472 may include a pair of projections 482 that extend outward from the puck body 472 at a second end 483, where the second end 483 is opposite the first end 481. The recess 476 may be a pair of recesses 476 that are opposite each other on the puck body 472. Each recess 476 may be larger than a corresponding protrusion 436 to receive the corresponding protrusion 436 of the receiver 424. Each tab 478 may have a contact surface 479 that contacts the stop 428 to rotationally fix the puck 470 to the receiver 424, which rotationally fixes the puck 470 to the upper adapter 410. Additionally, each tab 478 may have a portion of the upper surface that is tapered to more easily engage a corresponding ramped surface 460 of the lower adapter 440. In some examples, the tapered upper surface 485 of each tab 478 may engage a corresponding ramped surface 460 where the ramped surface 460 may comprise an angled surface such that the tapered upper surface 485 and the ramped surface 460 slidingly engage each other to allow the tabs 478 of the puck 470 along with the upper adapter 410 to easily rotate relative to the lower adapter 440.

To install the puck 470 into the receiver 424, the puck 470 may slide into the receiver 424 with the projection 482 sliding next to or along the protrusion 436 of the receiver 424, where each protrusion 436 is received in a corresponding recess 476. Once the tabs 478 contact the bottom surface 426 of the upper adapter 410, the puck 470 is rotated within the receiver 424 until the contact surfaces 479 contact the stops 428 of the upper adapter 410. Once installed, the one or more puck magnets 474 may comprise a pair of puck magnets 474 that are both secured within the puck body 472. Each puck magnet 474 may be substantially aligned with a corresponding upper adapter magnet 438 such that the magnetic attraction between the puck magnet 474 and the upper adapter magnet 438 secures the puck 470 to the upper adapter 410 in an axial direction (along the axis longitudinally oriented with the lower cylindrical portion 420 of the upper adapter 410). In some embodiments where a pair of upper adapter magnets 438 are present, the magnetic attraction between the upper adapter magnets 438 and the puck magnet(s) 474 may rotationally bias the puck 470 into rotational alignment with the upper adapter 410 (e.g., about the axis longitudinally oriented with the lower cylindrical portion 420 of the upper adapter 410). Additionally, each protrusion 436 of the receiver 424 may substantially align with a corresponding projection 482 of the puck 470 to help prevent the puck 470 from inadvertently coming out of the receiver 424. A user may remove the puck 470 by overcoming the magnetic attraction between the puck magnet 474 and the upper adapter magnet 438. To remove the puck 170, a user may grasp a grip element 480 of the puck 470 and rotate such that the projection 482 is moved away from the protrusion 436 of the receiver 424 and then exert a force greater than the magnetic attraction of the upper adapter magnets 438 and the puck magnets 474 to remove the puck 470 from the receiver 424. The removal of the puck 470 may be needed to disassemble the lid assembly 400 to allow for cleaning of the components, such that when the puck 470 is removed from the upper adapter 410, the upper adapter 410 may be removed from the lower adapter 440. In some examples, the puck 470 may include an accessory (not shown) such as a tea strainer or other flavor infusion holder.

Additionally, the lid assembly 400 may include a plurality of gaskets to assist in sealing the lid assembly 400 to the container 10 and also to prevent liquid from flowing when the lid assembly 400 is in the closed configuration. For example, the upper adapter 410 may include a first upper adapter gasket 490 arranged in an upper groove 418 between the shelf 414 and the lower cylindrical portion 420 that contacts an interior surface of the upper cylindrical portion 442 of the lower adapter 440. The first upper adapter gasket 490 may be in contact with the interior surface of the upper cylindrical portion 442 when the lid assembly 400 is in both the closed configuration and an open configuration. A second upper adapter gasket 492 may be located in a lower groove spaced above the external threaded portion 422 of the lower cylindrical portion 420. Thus, both the first upper adapter gasket 490 and the second upper adapter gasket 492 may be located above the external threaded portion 422. The second upper adapter gasket 492 may contact an interior surface 450 of the lower adapter 440 when the lid assembly 400 is in a closed configuration. When the lid assembly 400 is in an open configuration, the second upper adapter gasket 492 may be free of contact with the interior surface 450 of the lower adapter 440 to allow fluid to flow through the lid assembly 400. In addition, the lower adapter 440 may include a first lower adapter gasket 494 near the junction of the shelf 444 and the lower cylindrical portion 446 and a second lower adapter gasket 496 arranged in a groove near a bottom end of the lower adapter 440. Both lower adapter gaskets 494, 496 contact an interior surface of a container when the lid assembly 400 is connected to a container, such as container 10.

Figure 35:
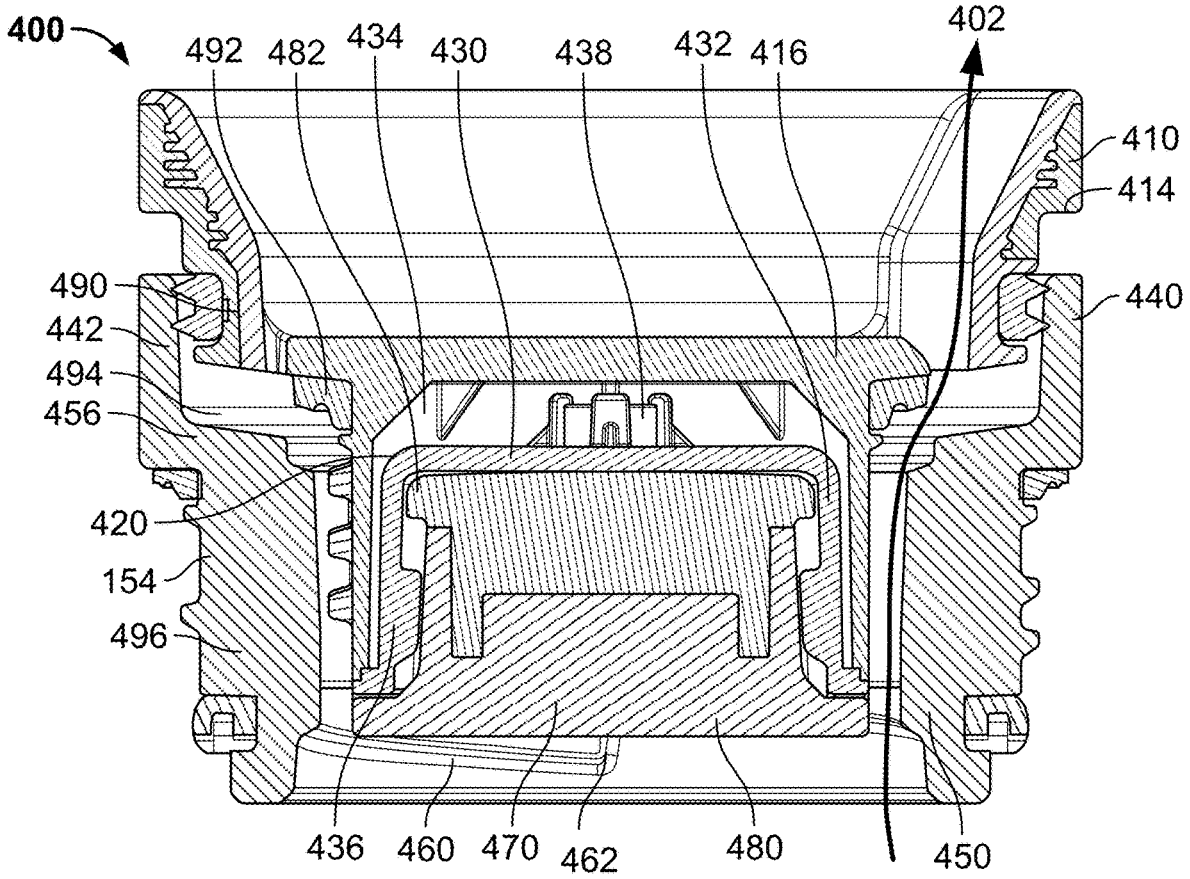
FIG. 35 illustrates a side cross-sectional view of the lid assembly of FIG. 28 in an open configuration along line 34-34 of FIG. 32 in accordance with aspects of this disclosure.
Figure 36:
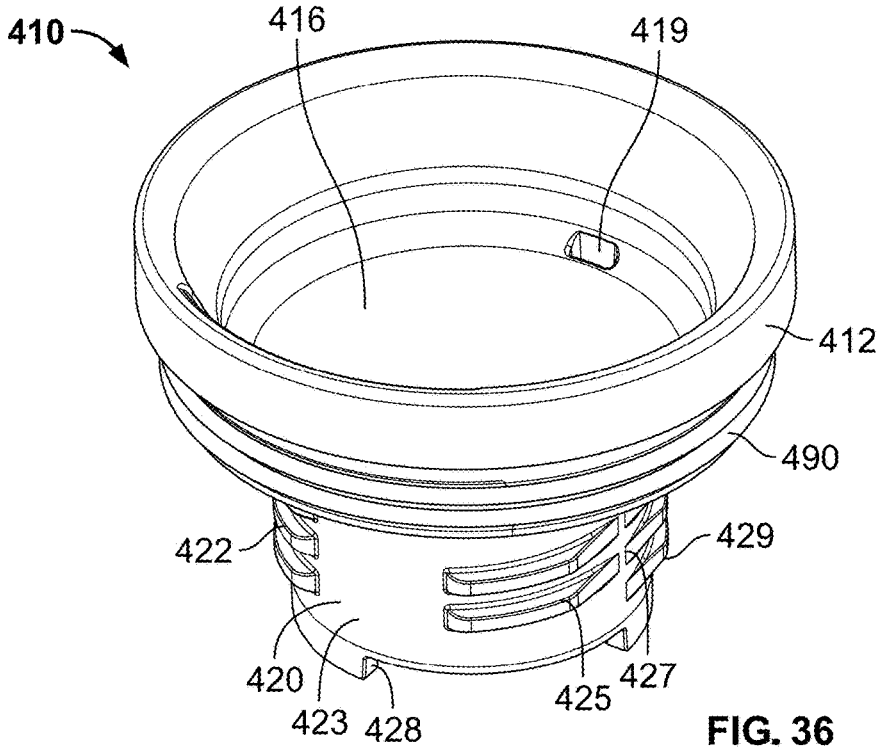
FIG. 36 illustrates a top perspective view of a portion of the lid assembly of FIG. 28 with some components removed for clarity in accordance with aspects of this disclosure.
Figure 37:
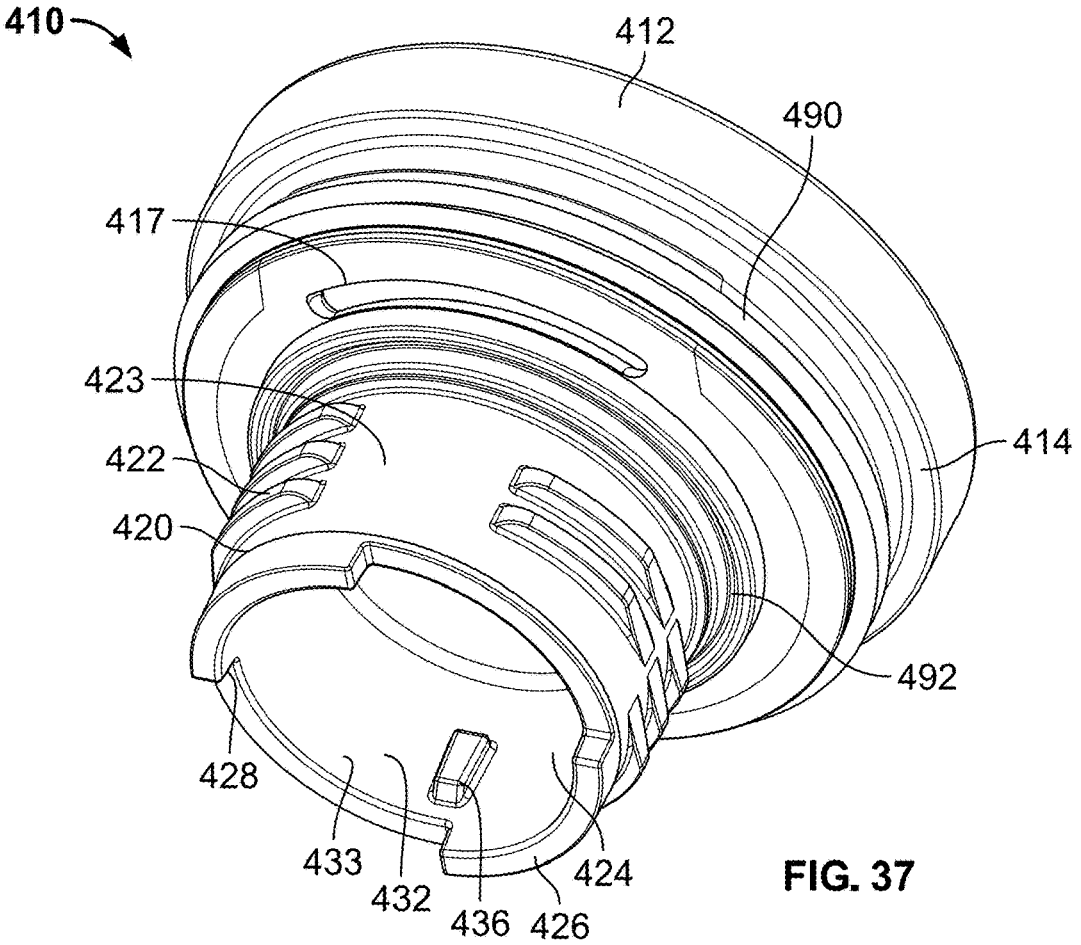
FIG. 37 illustrates a bottom perspective view of the portion of the lid assembly of FIG. 36 with some components removed for clarity in accordance with aspects of this disclosure.
Figure 38:
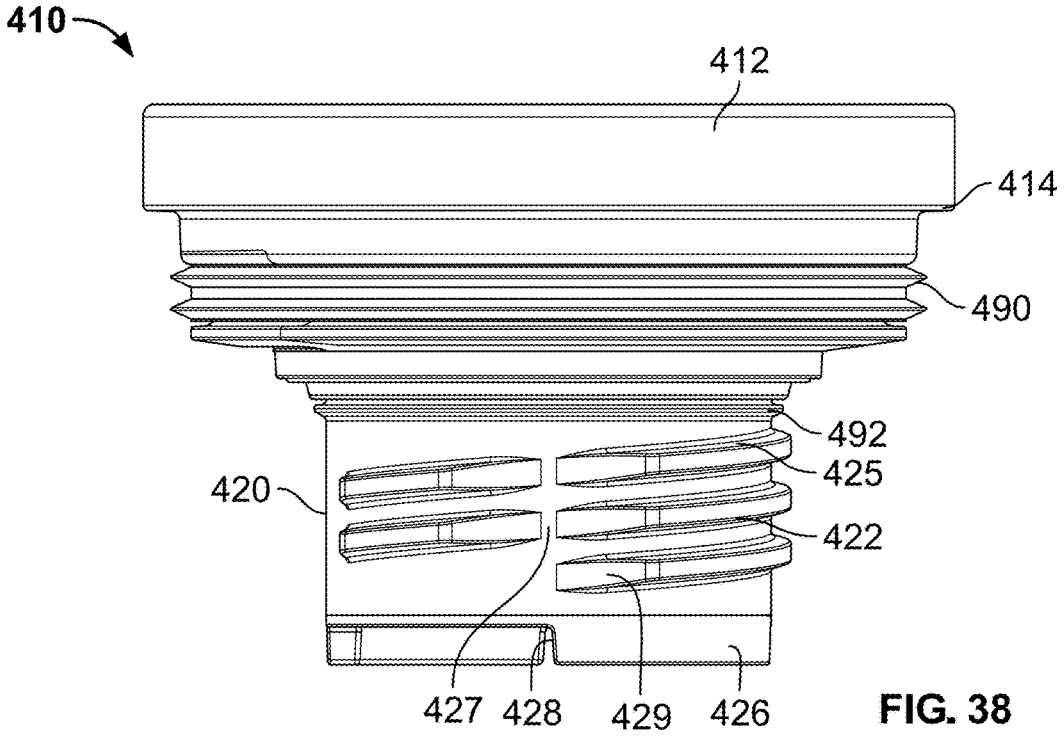
FIG. 38 illustrates a side view of the portion of the lid assembly of FIG. 36 with some components removed for clarity in accordance with aspects of this disclosure.
Figure 39:
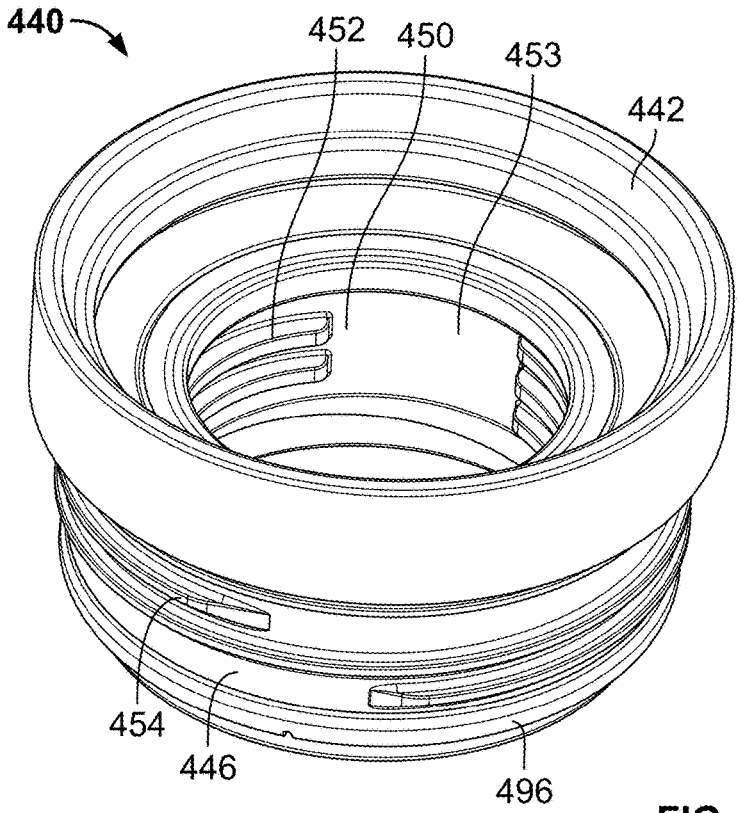
FIG. 39 illustrates a top perspective view of a portion of the lid assembly of FIG. 28 with some components removed for clarity in accordance with aspects of this disclosure.
Figure 40:
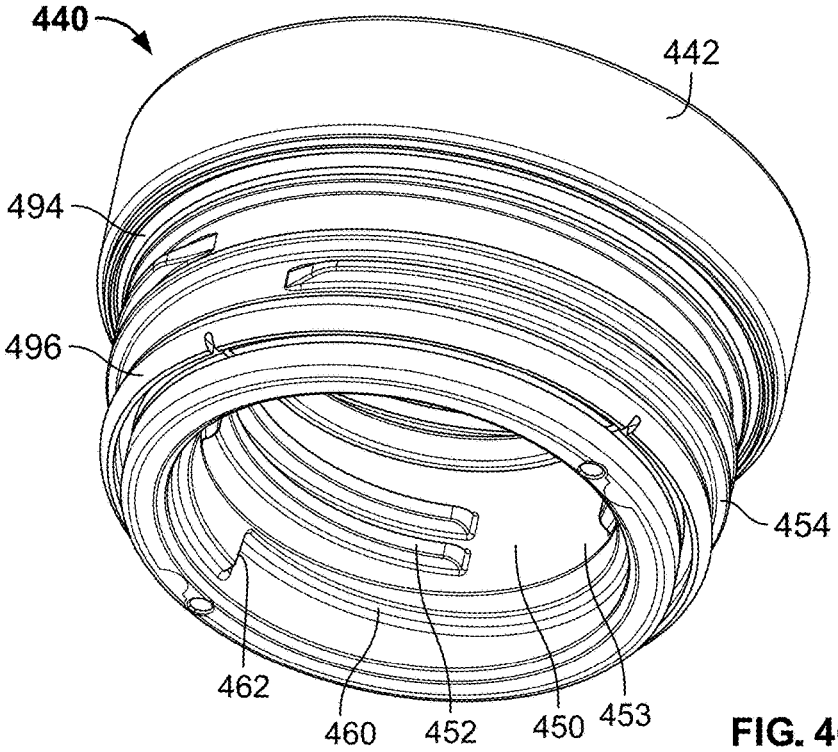
FIG. 40 illustrates a bottom perspective view of the portion of the lid assembly of FIG. 39 with some components removed for clarity in accordance with aspects of this disclosure.
Figure 41:
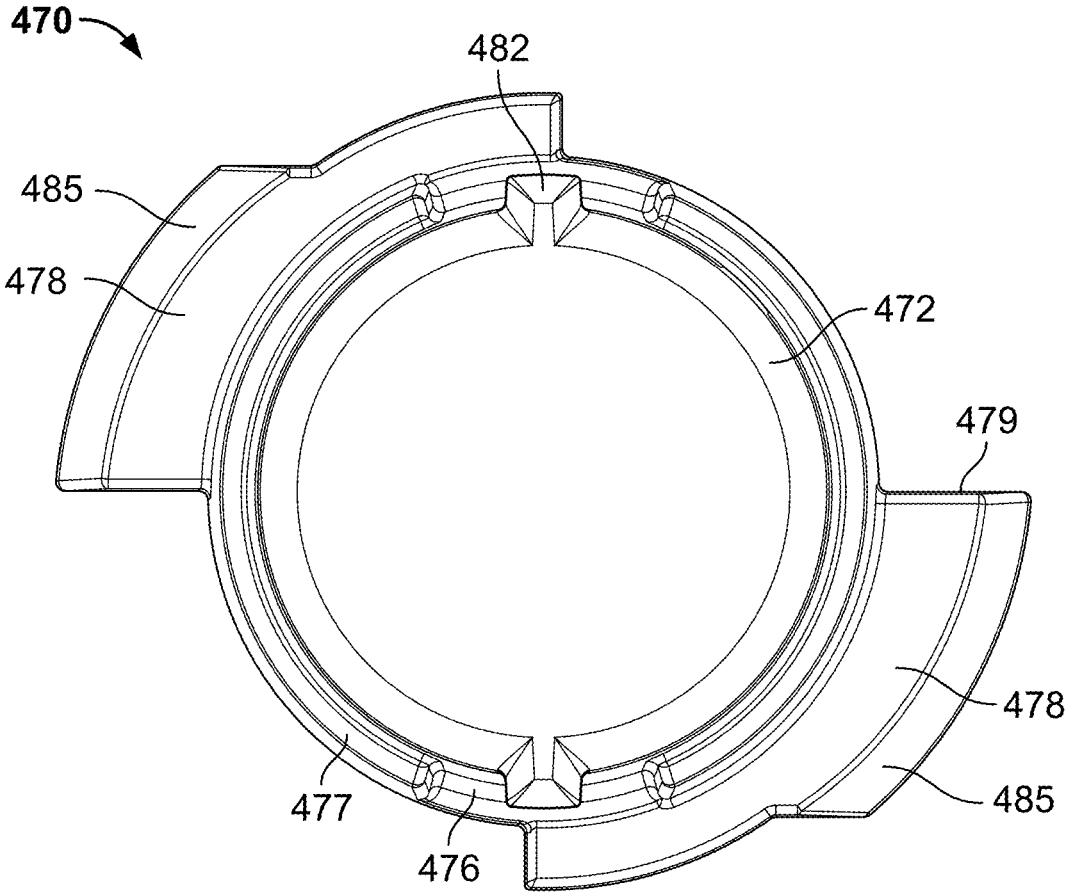
FIG. 41 illustrates a top view of a portion of the lid assembly of FIG. 28 with some components removed for clarity in accordance with aspects of this disclosure.
Figure 42:
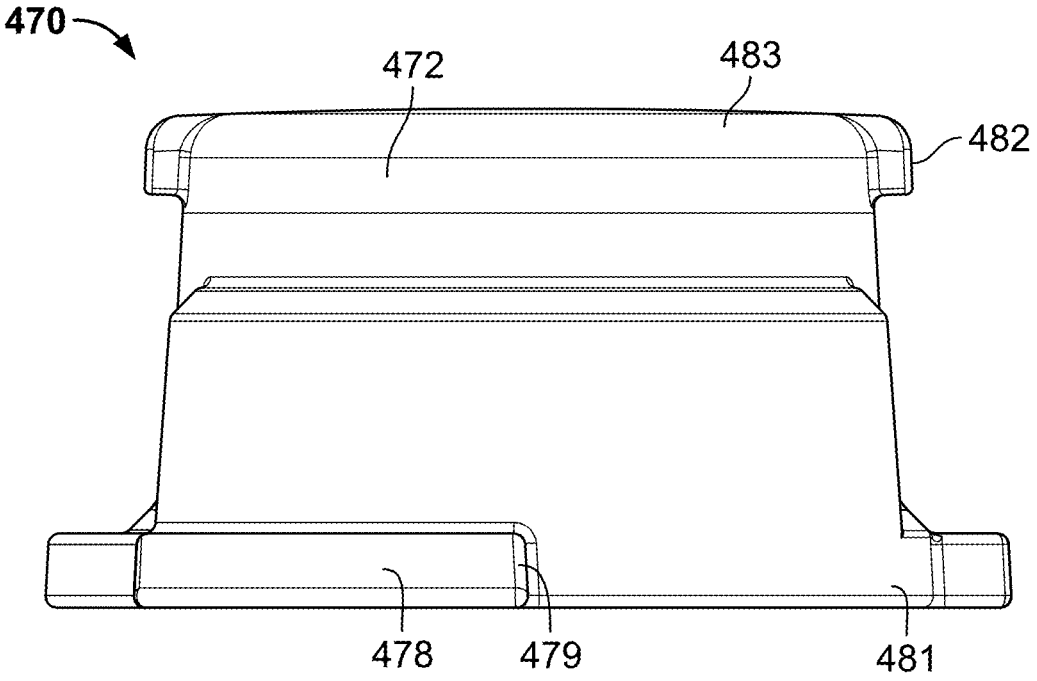
FIG. 42 illustrates a side view of the portion of the lid assembly of FIG. 41 with some components removed for clarity in accordance with aspects of this disclosure.

As discussed above, the lid assembly 400 has a closed configuration and an open configuration. When in the closed configuration, the lid assembly 400 prevents fluid or liquid from flowing through the lid assembly 400 from a container. When in an open configuration, fluid or liquid is allowed to flow through the lid assembly 400 from a container through flow path 402 that extends from below the lid assembly 400 through the primary opening 417 of the upper adapter 410 as shown in FIG. 35. To move the lid assembly 400 from a closed configuration to an open configuration, the upper adapter 410 is rotated in a first direction relative to the lower adapter 440, the shelf 414 of the upper adapter 410 moves away from the upper cylindrical portion 442 of the lower adapter 440 creating a space between the shelf 414 and the upper cylindrical portion 442 of the lower adapter 440. The upper adapter 410 may move away from the lower adapter 440 a vertical distance of approximately 5 mm or within a range of 3 mm and 8 mm. As the upper adapter 410 rotates in the first direction, the second upper adapter gasket 492 moves away from an interior surface 450 of the lower adapter 440 creating a gap between the upper adapter 410 and the lower adapter 440 that allows fluid to flow via the flow path 402 through the lid assembly 400 as shown in FIG. 35. The contact between the tabs 478 and the lower adapter 440 may limit movement between the upper adapter 410 relative to the lower adapter 440. The upper adapter 410 may continue to rotate in the first direction until the tabs 478 of the puck 470 contact the stop surfaces 462 of the lower adapter 440. In some examples, as the upper adapter 410 rotates, the ends and or upper surfaces of the tabs 478 may contact or be guided by the ramped surfaces 460 at the bottom region 458 of the lower adapter 440 as the tabs 478.

The threaded engagement between the external threaded portions 422 and the internal threaded portion 452 helps provide a controlled vertical movement of the upper adapter 410 relative to the lower adapter 440 as the upper adapter 410 is rotated. In addition, the interaction between tabs 478 and the ramped surfaces help with this guided movement. Once each contact surface 479 of each tab 478 contacts its corresponding stop surface 462, the upper adapter 410 is prevented from further rotation, and further vertical movement, providing a firm tactile feel for a user to know the lid assembly 400 has reached a fully open configuration. In some examples, the upper adapter 410 may rotate relative to the lower adapter 440 approximately 180 degrees from a closed orientation to a fully open orientation. A user may control the fluid amount by rotating the upper adapter 410 less than 180 degrees, such that an open configuration may have a variety of fluid flow options. To move the lid assembly 400 to a closed configuration, a user rotates the upper adapter 410 in a second direction, which is opposite the first direction, until the shelf 414 contacts the upper cylindrical portion 442. As the upper adapter 410 is rotated in the second direction the shelf 414 moves toward the upper cylindrical portion 442 of the lower adapter 440 and the second upper adapter gasket 492 moves into contact with the interior surface 450 of the lower adapter 440. Once the second upper adapter gasket 492 is fully engaged with the interior surface 450 of the lower adapter 440 preventing fluid from flowing from the lid assembly 400, the lid assembly 400 is in the closed configuration. In some examples, the area between the shelf 414 and the upper cylindrical portion 442 may also include a different color than the remainder of the lid assembly 400 to give a user a visual indication that the lid assembly 400 is in an open configuration.

The components of the lid assemblies such as the upper adapters 110, 210, 310, 410, the lower adapters, 140, 240, 340, 440, puck 170, 470 and the inner adapter 370 may be formed from polymeric materials and may be molded using techniques known to one skilled in the art. Additionally, the gaskets described herein may comprise silicone or other food safe materials suitable for sealing as known to one skilled in the art.

CLAUSES

A lid assembly 100 comprising:

an upper adapter 110 comprising: an upper cylindrical portion 112 with a shelf 114, a top wall 116 connected to the upper cylindrical portion 112, a lower cylindrical portion 120, and an upper adapter magnet 138 where the lower cylindrical portion includes a threaded portion 122 and a receiver 124;

the top wall comprising a primary opening 117 and a secondary opening 119;

a lower adapter 140 comprising an upper cylindrical portion 142, a lower cylindrical portion 146, an opening 148 comprising an interior surface 150, where the opening 148 at least partially receives the upper adapter 110;

the lower adapter also comprising a bottom end 158 that includes a ramped surface 160 and a stop surface 162; and a puck 170 that slidably engages with the receiver 124 in the upper adapter 110, where the puck includes a puck body 172, a puck magnet 174, and a tab extending outward from the puck body 172, where the puck 170 is rotationally fixed with the upper adapter 110 and is axially secured in the receiver 124 by an attractive force between the upper adapter magnet 138 and the puck magnet 174;

where the lid assembly 100 has a closed configuration and an open configuration, and where the upper adapter 110 is rotated relative to the lower adapter 140 to move the lid assembly from a closed configuration to an open configuration.

A lid assembly 200 comprising:

an upper adapter 210 comprising: an upper cylindrical portion 212 with a shelf surface 214, a top wall 216 connected to the upper cylindrical portion 212, a lower cylindrical portion 220, and an upper adapter gasket 290;

the top wall comprising a primary opening 217 and a secondary opening 219;

a lower adapter 240 comprising an upper cylindrical portion 242, a shelf surface 244, an indicator 245 that is located inboard of and extends from the shelf surface 244, a lower cylindrical portion 246, and an opening 248 comprising an interior surface 250, where the opening 248 at least partially receives the upper adapter 210;

where the lid assembly 200 has a closed configuration and an open configuration, and where the upper adapter 210 is rotated relative to the lower adapter 240 to move the lid assembly from a closed configuration to an open configuration; and where when the upper adapter 210 is rotated in a first direction to move the lid assembly 200 from the closed configuration to the open configuration, the first upper adapter gasket 290 contacts an overhang 247 of the indicator 245 to provide tactile feedback to a user that the lid assembly 200 is in the open configuration.

A lid assembly 300 comprising:

an upper adapter 310 comprising: a disc-shaped body 312 with an opening 314 on an edge of the disc-shaped body 312;

the upper adapter 310 further comprising an upper adapter magnet 318 and a key 320 that extends from a lower surface of the disc-shaped body 312;

an inner adapter 370 with a notch 380 that receives the key 320 to rotationally fix the inner adapter with the upper adapter 310, the inner adapter 370 further comprising an inner adapter gasket 378; and a lower adapter 340 comprising an upper cylindrical portion 342, a shelf surface 344, a lower cylindrical portion 346, an inner cylindrical portion 350, a bottom wall 348 that connects the lower cylindrical portion 346 and the inner cylindrical portion 350, an opening 358 comprising an interior surface 366, where the inner adapter 370 is received in the opening 358 and engages the inner cylindrical portion 350; and a lower adapter magnet 356;

where the upper adapter 310 is secured to the lower adapter by an attractive force between the upper adapter magnet 318 and the lower adapter magnet 356; and where the lid assembly 300 has a closed configuration and an open configuration, and where the upper adapter 310 is rotated relative to the lower adapter 340 to move the lid assembly from the closed configuration to the open configuration.

The various examples described herein enable a lid assembly for a container. It is also understood that in other embodiments, the various devices, components, and features of the lid assembly described herein may be constructed with similar structural and functional elements having different configurations, including different ornamental appearances. Still other benefits may be recognized by those skilled in the art. Accordingly, while the specific embodiments have been illustrated and described, numerous modifications come to mind without significantly departing from the spirit of the invention and the scope of protection is only limited by the scope of the accompanying claims.

We claim:

1. A lid assembly for a beverage container, the lid assembly comprising:

an upper adapter comprising:

a first upper cylindrical portion, a top wall connected to the first upper cylindrical portion, a first lower cylindrical portion connected to the first upper cylindrical portion;

wherein the top wall comprises a primary opening;

wherein the first lower cylindrical portion includes a receiver, wherein the receiver includes a side wall that surrounds a cavity that is open to an area below the lid assembly; and a lower adapter comprising:

a second upper cylindrical portion, a second lower cylindrical portion connected to the second upper cylindrical portion, and an opening extending through the second upper cylindrical portion and the second lower cylindrical portion, wherein the opening at least partially receives the upper adapter; and a puck that is removably coupled with the receiver of the upper adapter, wherein the puck includes a puck body and a tab extending outward from the puck body, and wherein the puck body is at least partially received within the cavity of the receiver;

wherein the lid assembly has a closed configuration and an open configuration, and wherein the upper adapter is moved relative to the lower adapter to move the lid assembly from the closed configuration to the open configuration; and wherein the tab of the puck contacts the lower adapter to limit movement of the upper adapter relative to the lower adapter.

2. The lid assembly of claim 1, wherein an end of the tab extends beyond an external surface of the first lower cylindrical portion of the upper adapter.

3. The lid assembly of claim 1, wherein the tab of the puck contacts a stop surface of the lower adapter when the lid assembly is in the open configuration.

4. The lid assembly of claim 1, wherein when the puck is installed into the receiver of the upper adapter, the puck is rotationally fixed with the upper adapter.

5. The lid assembly of claim 1, wherein the upper adapter includes an upper adapter magnet and the puck includes a puck magnet; and wherein the puck is axially secured in the receiver by an attractive force between the upper adapter magnet and the puck magnet.

6. The lid assembly of claim 5, wherein the upper adapter magnet is secured within an enclosed cavity formed between the top wall and the receiver.

7. The lid assembly of claim 1, wherein the first lower cylindrical portion includes an external threaded portion with a first channel that interrupts the external threaded portion; and wherein the second lower cylindrical portion includes an internal threaded portion wherein the internal threaded portion of the second lower cylindrical portion comprises a second channel and a third channel that interrupt the internal threaded portion in two locations; and wherein when the lid assembly is in the open configuration, the first channel and either the second channel or the third channel are substantially aligned with the primary opening on the top wall.

8. The lid assembly of claim 1, wherein when the upper adapter rotates relative to the lower adapter, an end of the tab is guided by a ramped surface of the lower adapter as the upper adapter moves vertically.

9. The lid assembly of claim 1, wherein when the puck is removed from the upper adapter, the upper adapter is removable from the lower adapter.

10. A lid assembly for a beverage container, the lid assembly comprising:

an upper adapter comprising:

a first upper cylindrical portion, a top wall connected to the first upper cylindrical portion, a first lower cylindrical portion connected to the first upper cylindrical portion, and an upper adapter magnet;

wherein the first lower cylindrical portion includes a receiver; and a lower adapter comprising:

a second upper cylindrical portion, a second lower cylindrical portion connected to the second upper cylindrical portion, and an opening extending through the second upper cylindrical portion and the second lower cylindrical portion, wherein the opening at least partially receives the upper adapter; and a puck that is removably coupled with the receiver of the upper adapter, wherein the puck includes a puck body, a puck magnet, and a tab extending outward from the puck body;

wherein when the puck is coupled to the upper adapter, the upper adapter is movably coupled to the lower adapter; and wherein the puck is axially secured to the receiver by an attractive force between the upper adapter magnet and the puck magnet.

11. The lid assembly of claim 10, wherein the lid assembly has a closed configuration that prevents fluid from flowing through the lid assembly, and an open configuration that allows fluid to flow through the opening on the top wall of the lid assembly; and wherein the upper adapter is rotated relative to the lower adapter to move the lid assembly from the closed configuration to the open configuration.

12. The lid assembly of claim 11, wherein the upper adapter includes an upper gasket and a lower gasket, wherein when the lid assembly is in the closed configuration, the upper gasket contacts the lower adapter and the lower gasket contacts the lower adapter, and wherein when the lid assembly is in the open configuration, the upper gasket contacts the lower adapter and the lower gasket is free of contact with the lower adapter.

13. The lid assembly of claim 12, wherein the upper gasket and the lower gasket are both located above an external threaded portion of the first lower cylindrical portion of the upper adapter.

14. The lid assembly of claim 10, wherein the tab of the puck contacts a stop surface of the lower adapter to limit movement of the upper adapter relative to the lower adapter.

15. The lid assembly of claim 14, wherein the stop surface is located at an end of a ramped surface, wherein the stop surface and the ramped surface are located on the second lower cylindrical portion of the lower adapter.

16. The lid assembly of claim 10, wherein when the puck is coupled with the receiver of the upper adapter, the puck is rotationally fixed with the upper adapter.

17. The lid assembly of claim 10, wherein the upper adapter magnet comprises a pair of upper adapter magnets, and wherein the puck magnet comprises a pair of puck magnets; and wherein a first upper adapter magnet of the pair of upper adapter magnets is substantially aligned with a first puck magnet of the pair of puck magnets.

18. A lid assembly for a beverage container, the lid assembly comprising:

an upper adapter comprising:

a first upper cylindrical portion, a top wall connected to the first upper cylindrical portion, a first lower cylindrical portion connected to the first upper cylindrical portion, and an upper adapter magnet;

wherein the first lower cylindrical portion includes a receiver, wherein the receiver comprises a cavity; and a lower adapter comprising:

a second upper cylindrical portion, a second lower cylindrical portion connected to the second upper cylindrical portion, and an opening extending through the second upper cylindrical portion and the second lower cylindrical portion, wherein the opening at least partially receives the upper adapter; and a puck that is removably coupled with the receiver of the upper adapter, wherein the puck includes a puck body, a puck magnet, and a tab extending outward from the puck body;

wherein the puck body is at least partially received within the cavity of the receiver;

wherein the puck is axially secured to the receiver by an attractive force between the upper adapter magnet and the puck magnet; and wherein the lid assembly has a closed configuration and an open configuration, and wherein the upper adapter is rotated relative to the lower adapter to move the lid assembly from the closed configuration to the open configuration.

19. The lid assembly of claim 18, wherein the puck includes a projection that extends from an outer surface of the puck body, and wherein the cavity of the receiver is surrounded by a side wall and a protrusion extends from the side wall into the cavity; and wherein when the puck is coupled to the receiver, the projection and the protrusion are substantially aligned.

20. The lid assembly of claim 18, wherein the upper adapter includes an upper gasket and a lower gasket, wherein when the lid assembly is in the closed configuration, the upper gasket contacts the lower adapter and the lower gasket contacts the lower adapter, and wherein when the lid assembly is in the open configuration, the upper gasket contacts the lower adapter and the lower gasket is free of contact with the lower adapter.

* * * * *